US011664625B2

(12) United States Patent
Morishita et al.

(10) Patent No.: US 11,664,625 B2
(45) Date of Patent: May 30, 2023

(54) CONNECTOR ASSEMBLY

(71) Applicant: JAPAN AVIATION ELECTRONICS INDUSTRY, LIMITED, Tokyo (JP)

(72) Inventors: Yukuya Morishita, Tokyo (JP); Yusuke Obata, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 49 days.

(21) Appl. No.: 17/508,032

(22) Filed: Oct. 22, 2021

(65) Prior Publication Data

US 2022/0181823 A1 Jun. 9, 2022

(30) Foreign Application Priority Data

Dec. 8, 2020 (JP) ..... JP2020-203588

(51) Int. Cl.

| | |
|---|---|
| ***H01R 13/641*** | (2006.01) |
| ***H01R 13/506*** | (2006.01) |
| ***H01R 13/627*** | (2006.01) |
| ***H01R 13/631*** | (2006.01) |
| ***H01R 13/639*** | (2006.01) |

(52) U.S. Cl.

CPC ..... *H01R 13/641* (2013.01); *H01R 13/506* (2013.01); *H01R 13/6272* (2013.01); *H01R 13/631* (2013.01); *H01R 13/639* (2013.01)

(58) Field of Classification Search

CPC ..... H01R 13/641; H01R 13/505; H01R 13/6272; H01R 13/631; H01R 13/639

See application file for complete search history.

(56) References Cited

U.S. PATENT DOCUMENTS 6,068,507 A 5/2000 Popa
7,326,074 B1 2/2008 Lim et al.
(Continued)

FOREIGN PATENT DOCUMENTS

EP 3651285 A1 5/2020
JP 3060296 B2 7/2000
(Continued)

OTHER PUBLICATIONS

Extended European Search Report dated Apr. 4, 2022, issued in counterpart European Application No. 21203767.5.

*Primary Examiner* — Tho D Ta
(74) *Attorney, Agent, or Firm* — Holtz, Holtz & Volek PC

(57) ABSTRACT

A connector assembly comprises a first connector and a second connector. The first connector comprises a first housing provided with a stopper. The second connector comprises a second housing, a mating detecting member and a shift mechanism. The second housing is mateable with the first housing along a front-rear direction. The mating detecting member has an abutment portion. The abutment portion is movable in a direction intersecting with the front-rear direction by an operation of the shift mechanism. When the second housing is mated with the first housing under a state where the mating detecting member is positioned at a regulating position, the abutment portion abuts against the stopper, and the mating detecting member is moved from the regulating position toward an allowable position. The mating detecting member is positioned at the allowable position when a mating of the second housing with the first housing is completed.

9 Claims, 32 Drawing Sheets

(56) References Cited

U.S. PATENT DOCUMENTS

| | | | | |
|---|---|---|---|---|
| 9,742,116 | B1 | 8/2017 | Nishiyama | |
| 10,069,241 | B2 * | 9/2018 | Hayasaka | H01R 13/641 |
| 10,283,904 | B2 * | 5/2019 | Amemiya | H01R 13/641 |
| 10,847,918 | B2 | 11/2020 | Tanaka et al. | |

FOREIGN PATENT DOCUMENTS

| | | | |
|---|---|---|---|
| JP | 2009043648 | A | 2/2009 |
| JP | 6422908 | B2 | 10/2018 |
| JP | 2019008971 | A | 1/2019 |

* cited by examiner

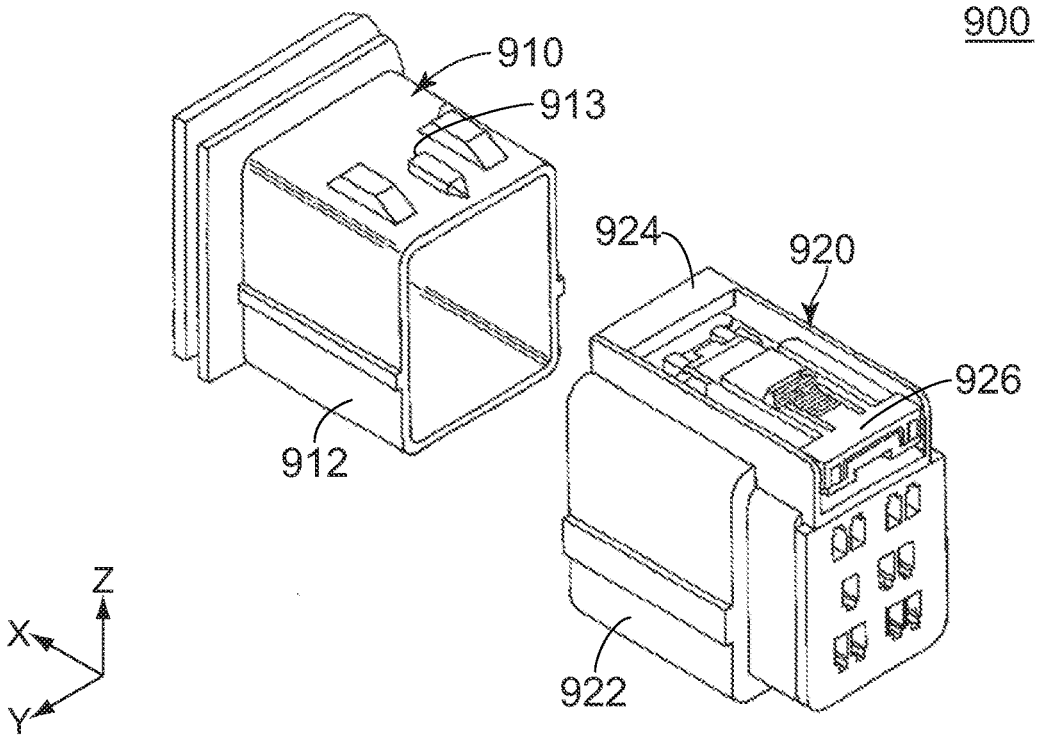
FIG. 60
PRIOR ART
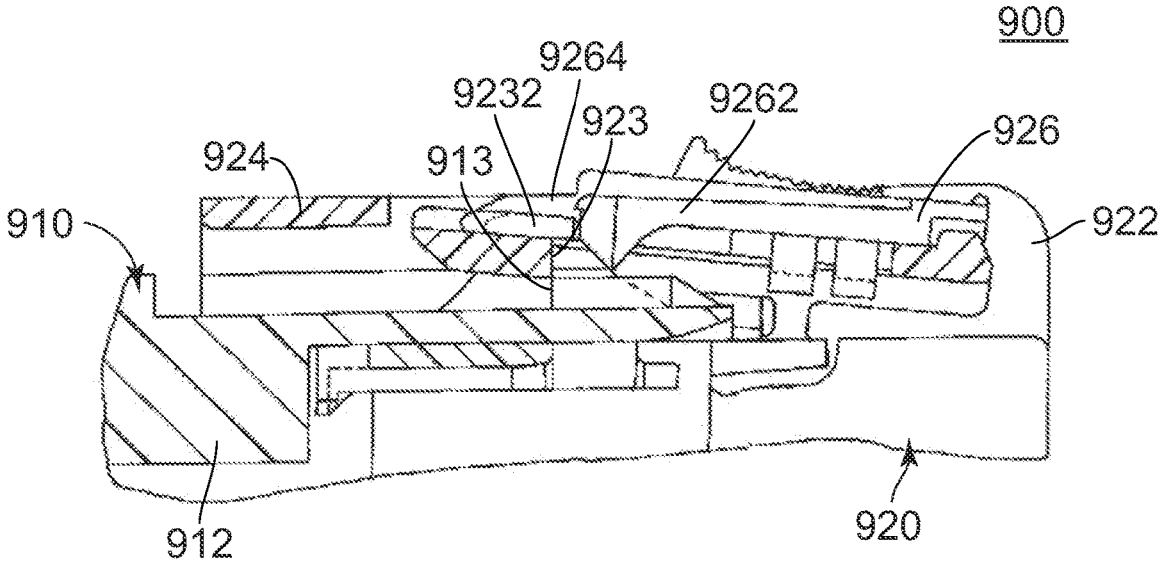
FIG. 61
PRIOR ART
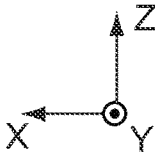

CONNECTOR ASSEMBLY

CROSS REFERENCE TO RELATED APPLICATIONS

This application is based on and claims priority under 35 U.S.C. § 119 to Japanese Patent Application No. JP2020-203588 filed Dec. 8, 2020, the contents of which are incorporated herein in their entirety by reference.

BACKGROUND OF THE INVENTION

This invention relates to a connector assembly comprising a first connector and a second connector with a mating detecting member.

Referring to FIGS. 60 to 63, JPB3060296 (Patent Document 1) discloses a connector assembly 900 of this type. The connector assembly 900 comprises a first connector 910 and a second connector 920. The first connector 910 comprises a first housing 912. The first housing 912 is provided with a first lock portion 913. The second connector 920 comprises a second housing 922 and a positioning assurance device 926, or a mating detecting member 926. The second housing 922 is mateable with the first housing 912 along an X-direction. The second housing 922 is provided with a second lock portion 923 and a traverse piece 924. The second lock portion 923 is positionable at any of a lock position, which is shown in FIG. 63, and a release position shown in FIG. 61. The second lock portion 923 has a stop wing 9232. When the second lock portion 923 is positioned at the lock position, the first lock portion 913 and the second lock portion 923 lock a mated state where the second housing 922 is mated with the first housing 912. The mating detecting member 926 is movable relative to the second housing 922 in the X-direction between an allowable position, which is shown in FIG. 60, and a regulating position shown in FIG. 63. The mating detecting member 926 has a stopping arm 9262 and a blocking tongue piece 9264.

Referring to FIG. 61, when the mating detecting member 926 is positioned at the allowable position, a movement of the second lock portion 923 from the lock position to the release position is allowed. When the mating detecting member 926 is positioned at the allowable position in a middle of a mating process of the second housing 922 with the first housing 912, the stopping arm 9262 of the mating detecting member 926 is positioned in a negative X-direction beyond the stop wing 9232 of the second lock portion 923 so that the mating detecting member 926 is immovable to the regulating position. Referring to FIG. 62, when the mating detecting member 926 is positioned at the allowable position under a state where the mating of the second housing 922 with the first housing 912 is completed, the stopping arm 9262 of the mating detecting member 926 is positioned in a positive Z-direction beyond the stop wing 9232 of the second lock portion 923 so that the mating detecting member 926 is movable to the regulating position. Referring to FIG. 63, when the mating detecting member 926 is positioned at the regulating position, the blocking tongue piece 9264 of the mating detecting member 926 is positioned in a negative Z-direction beyond the traverse piece 924 of the second housing 922 so that the movement of the second lock portion 923 from the lock position to the release position is regulated.

The connector assembly 900 of Patent Document 1 is configured so that an operator can continuously perform an operation of mating the first connector 910 with the second connector 920 and an operation of moving the mating detecting member 926 by applying force to the mating detecting member 926 when the first connector 910 and the second connector 920 are mated with each other. When an operator continuously performs the mating operation and the movement operation, the operator perceives, at about the same time, two clicking sensations: a clicking sensation produced by the completion of the mating of the first connector 910 with the second connector 920; and a clicking sensation produced by a movement of the mating detecting member 926 from the allowable position to the regulating position. Accordingly, if there occurs a fault that the mating detecting member 926 is erroneously moved from the allowable position to the regulating position under a state where the mating of the second connector 920 with the first connector 910 is not completed, an operator cannot recognize the incompletion of the mating of the second connector 920 with the first connector 910.

SUMMARY OF THE INVENTION

It is therefore an object of the present invention to provide a connector assembly which is configured so that an operation of mating a second connector with a first connector and an operation of moving a mating detecting member are independently performed and which enables an operator to reliably recognize an incompletion of the mating of the second connector with the first connector upon the incompletion due to some reason.

One aspect of the present invention provides a connector assembly comprising a first connector and a second connector. The first connector comprises a first housing. The first housing is provided with a first lock portion and a stopper. The second connector comprises a second housing, a mating detecting member and a shift mechanism. The second housing is mateable with the first housing along a front-rear direction. The first housing is positioned forward of the second housing in the front-rear direction. The second housing is provided with a second lock portion. The second lock portion is positionable at any of a lock position and a release position. When the second lock portion is positioned at the lock position, the first lock portion and the second lock portion lock a mated state where the second housing is mated with the first housing. The mating detecting member is movable relative to the second housing in the front-rear direction between a regulating position and an allowable position. The allowable position is positioned rearward of the regulating position in the front-rear direction. A movement of the second lock portion from the lock position to the release position is regulated when the mating detecting member is positioned at the regulating position. The movement of the second lock portion from the lock position to the release position is allowed when the mating detecting member is positioned at the allowable position. The mating detecting member has an abutment portion. The abutment portion is movable in a direction intersecting with the front-rear direction by an operation of the shift mechanism. When the second housing starts to be mated with the first housing, the abutment portion is positioned on an imaginary line which extends in the front-rear direction and passes through the stopper. When the second housing is mated with the first housing under a state where the mating detecting member is positioned at the regulating position, the abutment portion abuts against the stopper, and the mating detecting member is moved from the regulating position toward the allowable position. The mating detecting member is positioned at the allowable position when a mating of the second housing with the first housing is completed.

When the shift mechanism is operated under a state where the mating detecting member is positioned at the allowable position, the abutment portion is moved to a position which is deviated from the imaginary line. The mating detecting member is moved from the allowable position to the regulating position when the mating detecting member is pushed forward in the front-rear direction under a state where the abutment portion is deviated from the imaginary line.

The connector assembly of the present invention is configured as follows: when the second housing is mated with the first housing under the state where the mating detecting member is positioned at the regulating position, the abutment portion abuts against the stopper, and the mating detecting member is moved from the regulating position toward the allowable position; and the mating detecting member is positioned at the allowable position when the mating of the second housing with the first housing is completed. Accordingly, the connector assembly of the present invention is configured so that the mating detecting member is always moved from the allowable position to the regulating position after the mating of the second housing with the first housing is completed. Specifically, an operation of mating the second connector with the first connector and an operation of moving the mating detecting member from the allowable position to the regulating position are independently performed in the connector assembly of the present invention. Thus, the connector assembly of the present invention enables an operator to reliably recognize an incompletion of the mating of the second connector with the first connector upon the incompletion due to some reason.

An appreciation of the objectives of the present invention and a more complete understanding of its structure may be had by studying the following description of the preferred embodiment and by referring to the accompanying drawings.

BRIEF DESCRIPTION OF THE DRAWINGS

FIG. 60 is a perspective view showing a connector assembly of Patent Document 1.

FIG. 61 is a cross-sectional view showing the connector assembly of FIG. 60. In the figure, a first lock portion and a second lock portion do not lock a mated state where a second housing is mated with a first housing.

Figure 1:
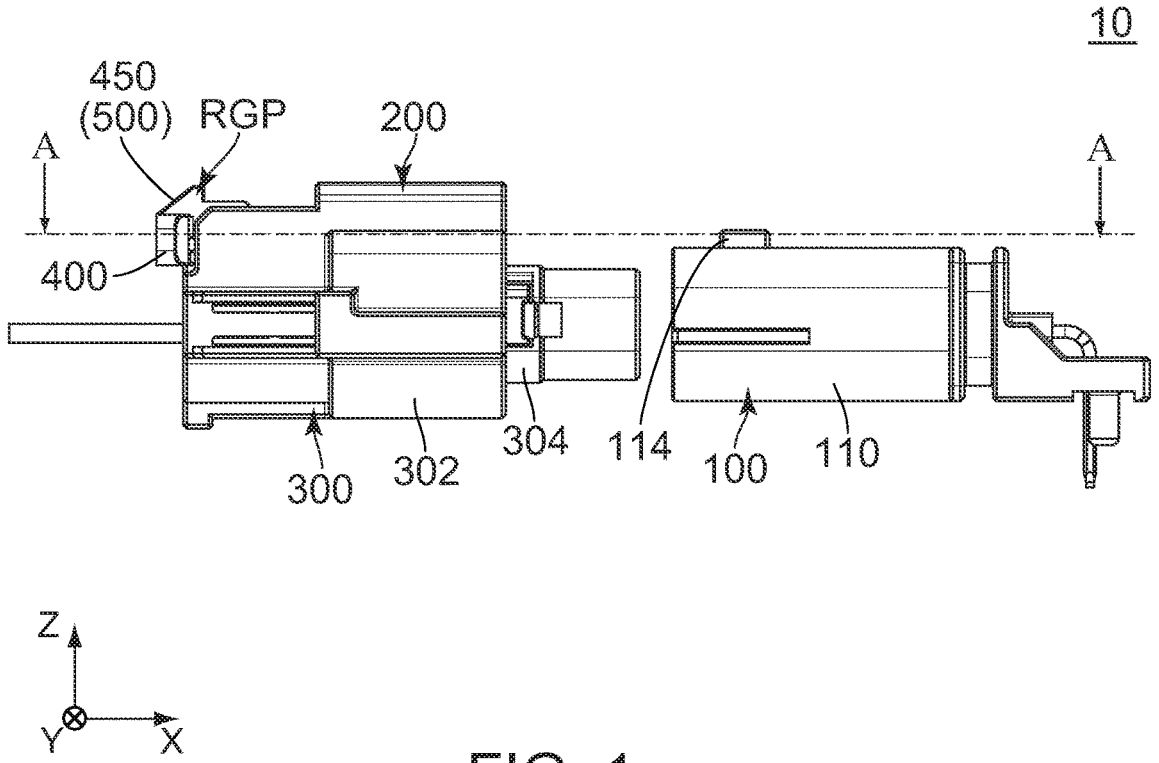
FIG. 1 is a side view showing a connector assembly according to an embodiment of the present invention. In the figure, a first connector and a second connector are not mated with each other while a mating detecting member of the second connector is positioned at a regulating position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector assembly 10 according to an embodiment of the present invention comprises a first connector 100 and a second connector 200. The first connector 100 and the second connector 200 are mateable with each other along a front-rear direction. In the present embodiment, the front-rear direction is an X-direction. Specifically, it is assumed that forward is a positive X-direction while rearward is a negative X-direction.

Figure 57:
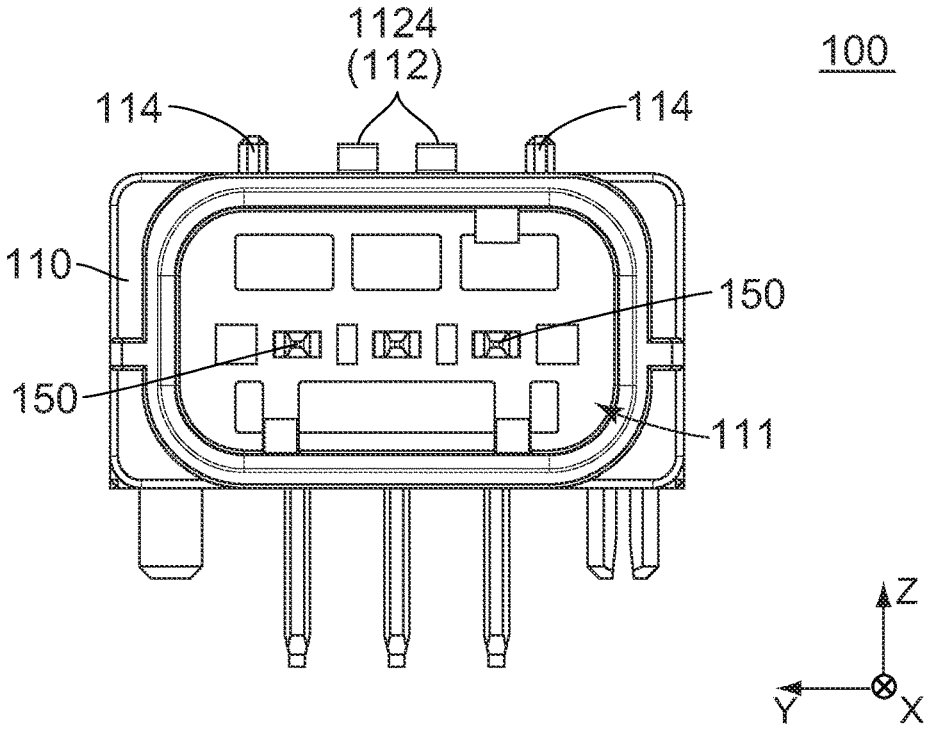
FIG. 57 is a front view showing the first connector of FIG. 56.

As shown in FIG. 57, the first connector 100 of the present embodiment comprises a first housing 110 and first terminals 150.

Figure 56:
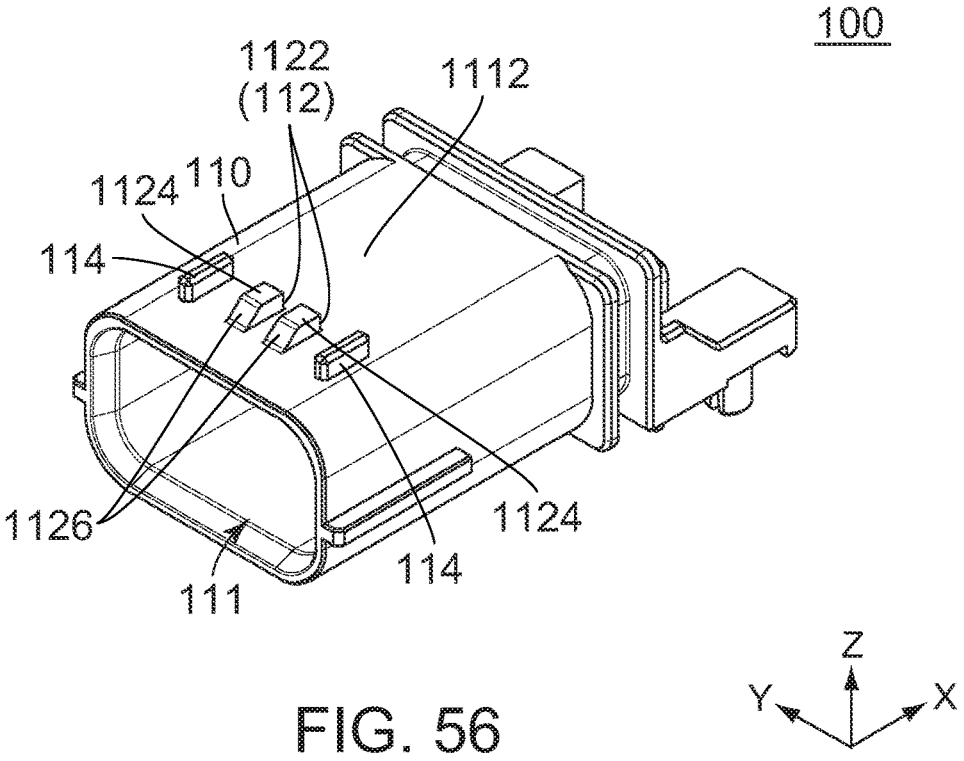
FIG. 56 is a perspective view showing the first connector which is included in the connector assembly of FIG. 1.

Referring to FIG. 56, the first housing 110 of the present embodiment is made of insulator. The first housing 110 is provided with a socket housing accommodating portion 111, an upper surface 1112, two first lock portions 112 and two stoppers 114.

As shown in FIG. 56, the socket housing accommodating portion 111 of the present embodiment is a space which is opened at its rear end and extends in the front-rear direction.

As shown in FIG. 56, the upper surface 1112 of the present embodiment defines an upper end of the socket housing accommodating portion 111 in an up-down direction. The upper surface 1112 has a flat-plate shape perpendicular to the up-down direction. In the present embodiment, the up-down direction is a Z-direction. Specifically, upward is a positive Z-direction while downward is a negative Z-direction.

As shown in FIG. 56, each of the first lock portions 112 of the present embodiment is positioned around a middle of the first housing 110 in a right-left direction. In the present embodiment, the right-left direction is a Y-direction. Specifically, it is assumed that rightward is a positive Y-direction while leftward is a negative Y-direction. Each of the first lock portions 112 is provided on the upper surface 1112. Each of the first lock portions 112 extends upward in the up-down direction from the upper surface 1112. Each of the first lock portions 112 extends in the front-rear direction.

Figure 58:
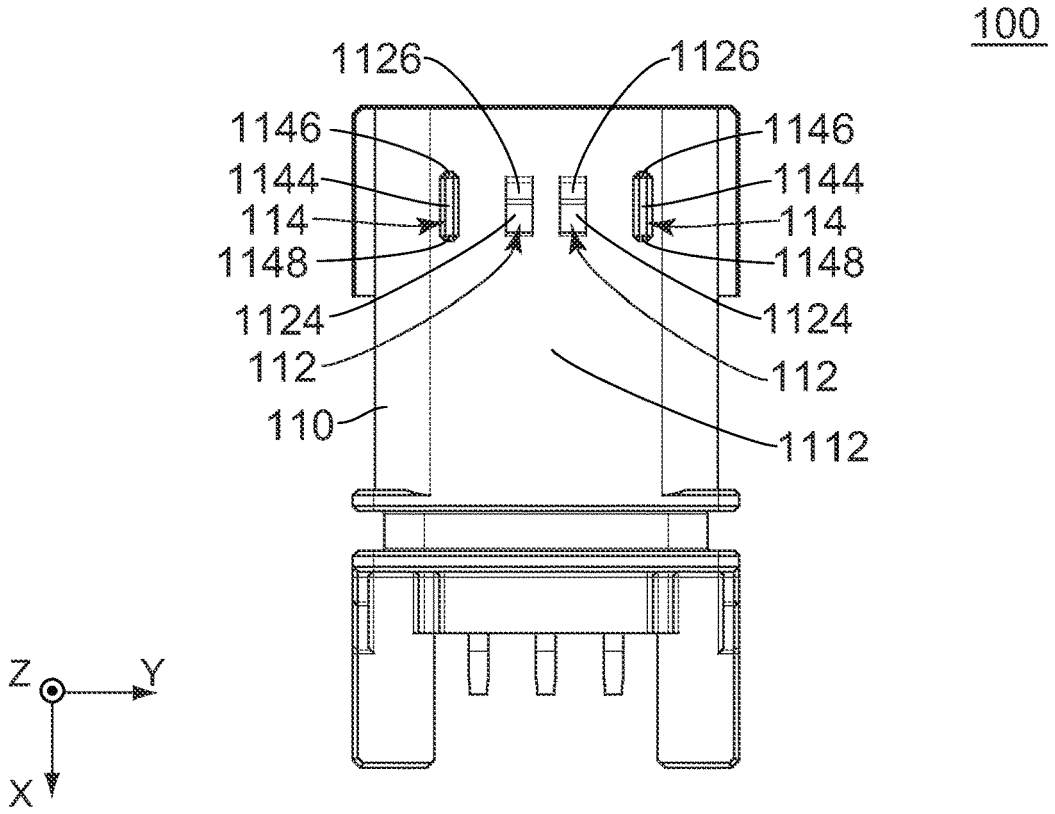
FIG. 58 is a top view showing the first connector of FIG. 56.
Figure 59:
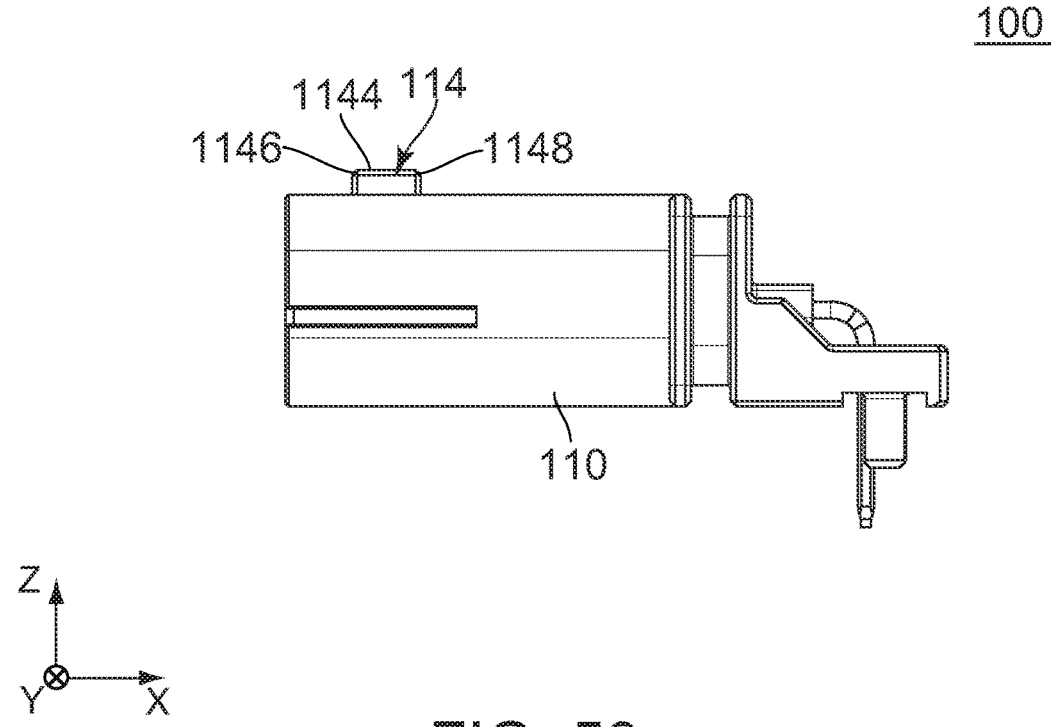
FIG. 59 is a side view showing the first connector of FIG. 56.
Figure 62:
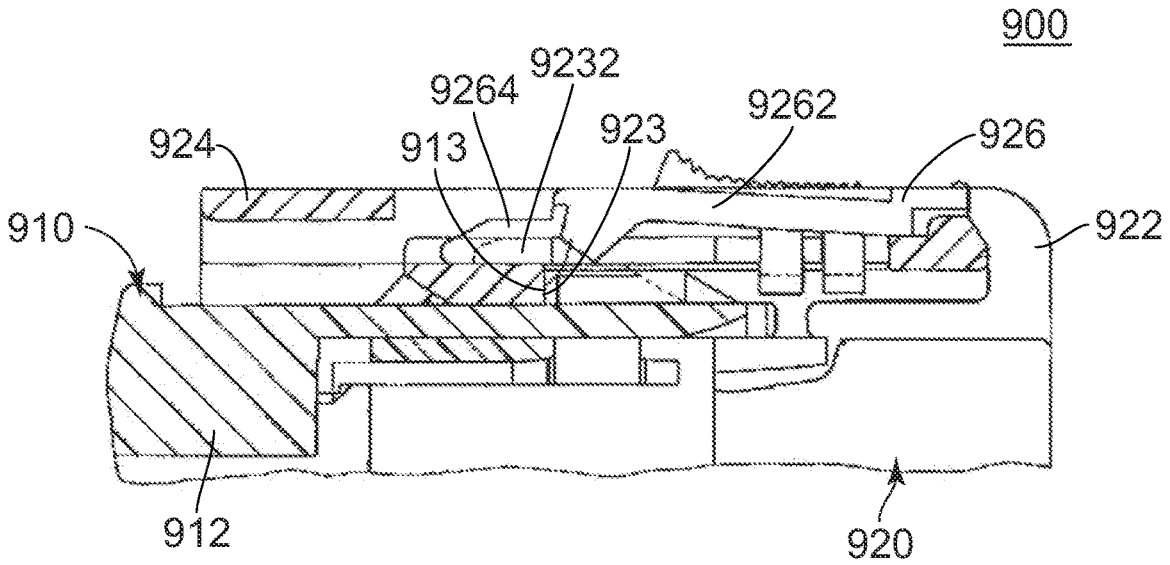
FIG. 62 PRIOR ART
FIG. 62 is another cross-sectional view showing the connector assembly of FIG. 60. In the figure, the first lock portion and the second lock portion lock the mated state of the second housing with the first housing while a mating detecting member is positioned at an allowable position.
Figure 62:
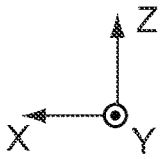
FIG. 62 PRIOR ART
Figure 63:
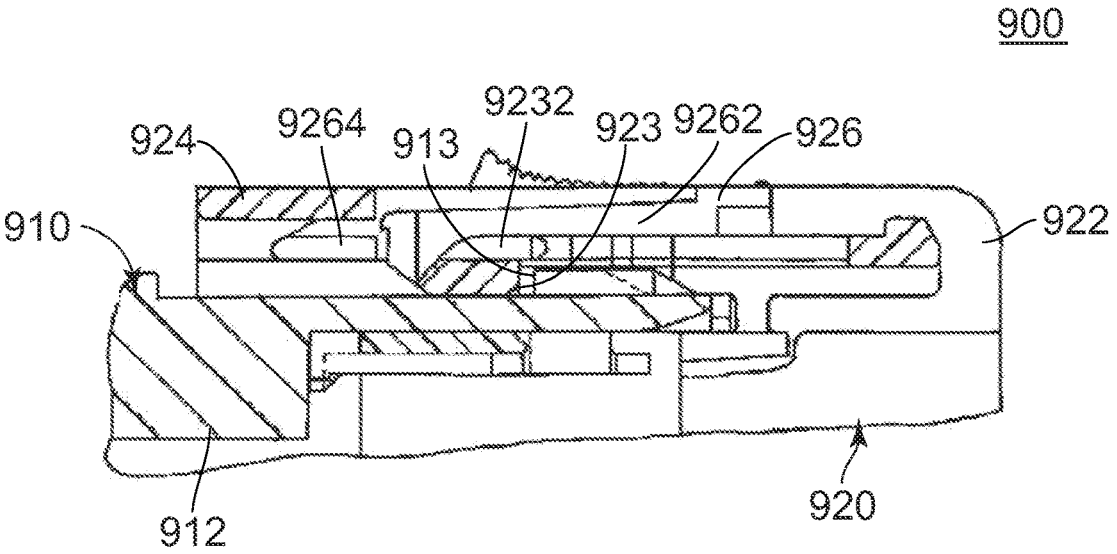
FIG. 63 PRIOR ART
FIG. 63 is still another cross-sectional view showing the connector assembly of FIG. 60. In the figure, the first lock portion and the second lock portion lock the mated state of the second housing with the first housing while the mating detecting member is positioned at a regulating position.
Figure 63:
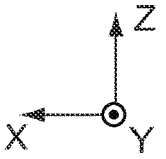
FIG. 63 PRIOR ART

As shown in FIGS. 56 and 58, each of the first lock portions 112 has a first lock surface 1122, an upper surface 1124 and an oblique surface 1126.

As shown in FIG. 56, the first lock surface 1122 of the present embodiment defines a front end of the first lock portion 112 in the front-rear direction. The first lock surface 1122 is a plane perpendicular to the front-rear direction.

As shown in FIG. 57, the upper surface 1124 of the present embodiment defines an upper end of the first lock portion 112 in the up-down direction. The upper surface 1124 is a plane perpendicular to the up-down direction.

As shown in FIG. 58, the oblique surface 1126 of the present embodiment is positioned rearward of the upper surface 1124 in the front-rear direction. As shown in FIG. 56, the oblique surface 1126 is a plane oblique to the front-rear direction. The oblique surface 1126 extends forward and upward.

As shown in FIG. 58, each of the stoppers 114 of the present embodiment is provided on the upper surface 1112. The stoppers 114 correspond to the first lock portions 112, respectively, and each of the stoppers 114 is positioned outward in the right-left direction beyond the first lock portion 112 corresponding thereto. As shown in FIG. 56, each of the stoppers 114 extends upward in the up-down direction from the upper surface 1112. Each of the stoppers 114 extends in the front-rear direction.

Referring to FIG. 57, each of the first terminals 150 of the present embodiment is made of metal. Each of the first terminals 150 is a so-called pin contact.

Figure 6:
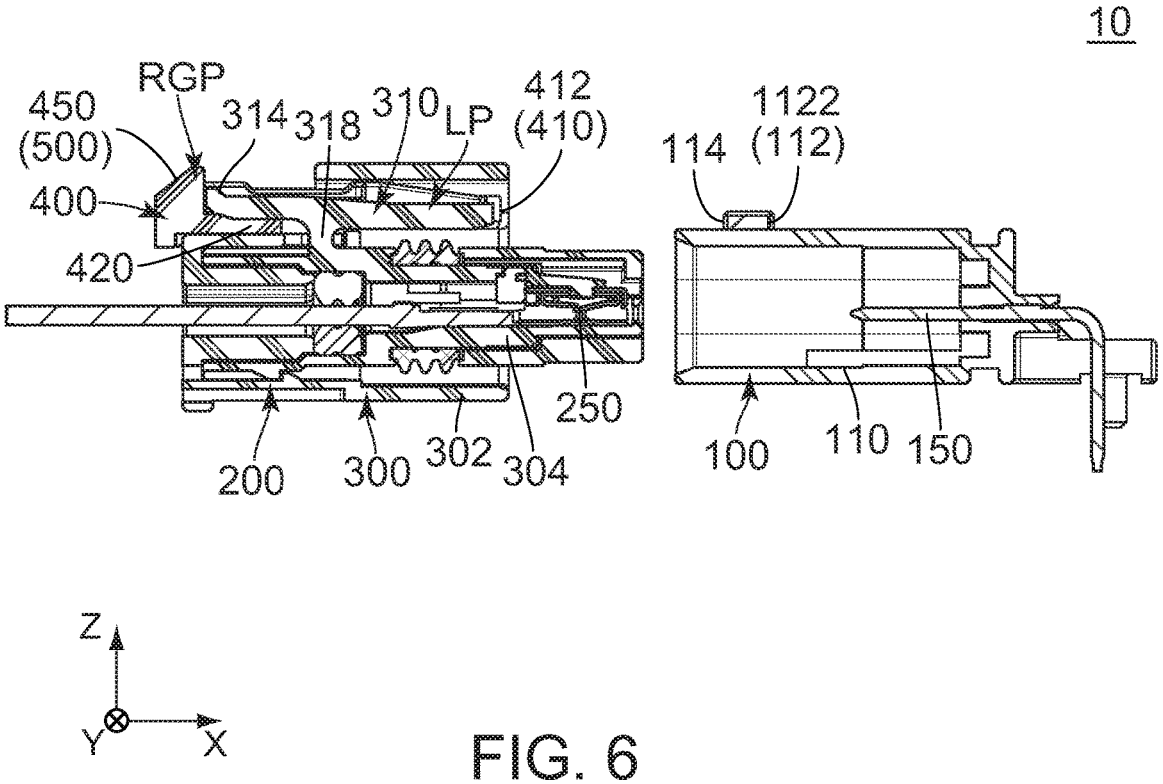
FIG. 6 is a cross-sectional view showing the connector assembly of FIG. 3, taken along line D-D.
Figure 7:
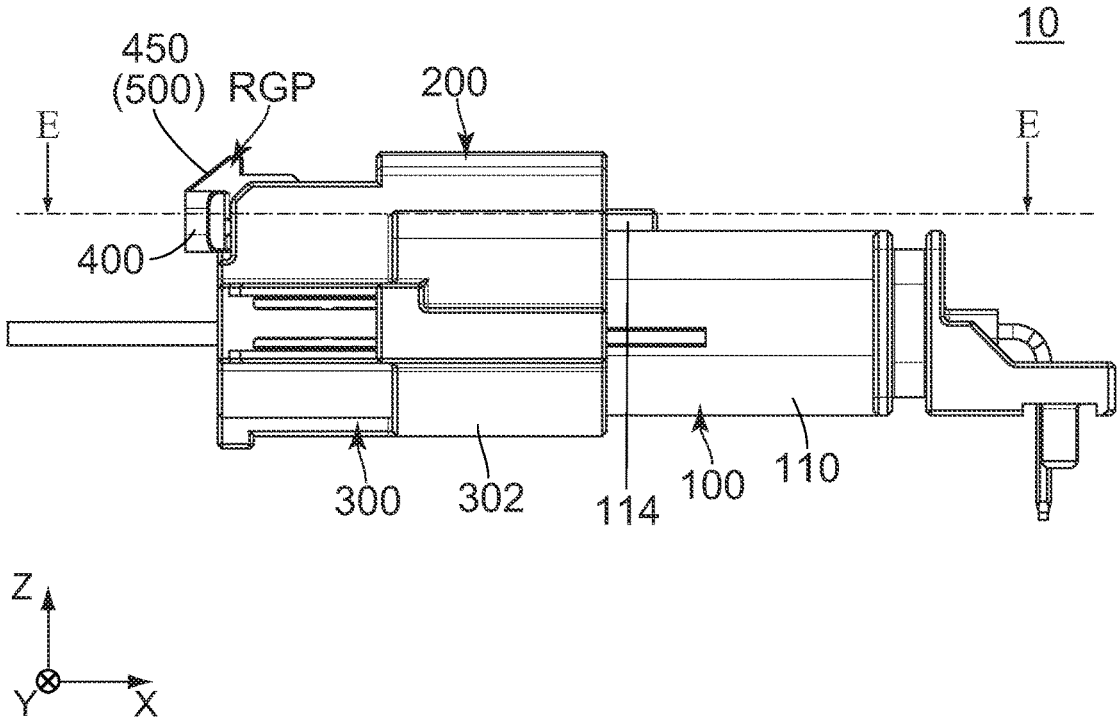
FIG. 7 is another side view showing the connector assembly of FIG. 1. In the figure, the second connector is in a middle of a mating process of being mated with the first connector while the mating detecting member is positioned at the regulating position.
Figure 8:
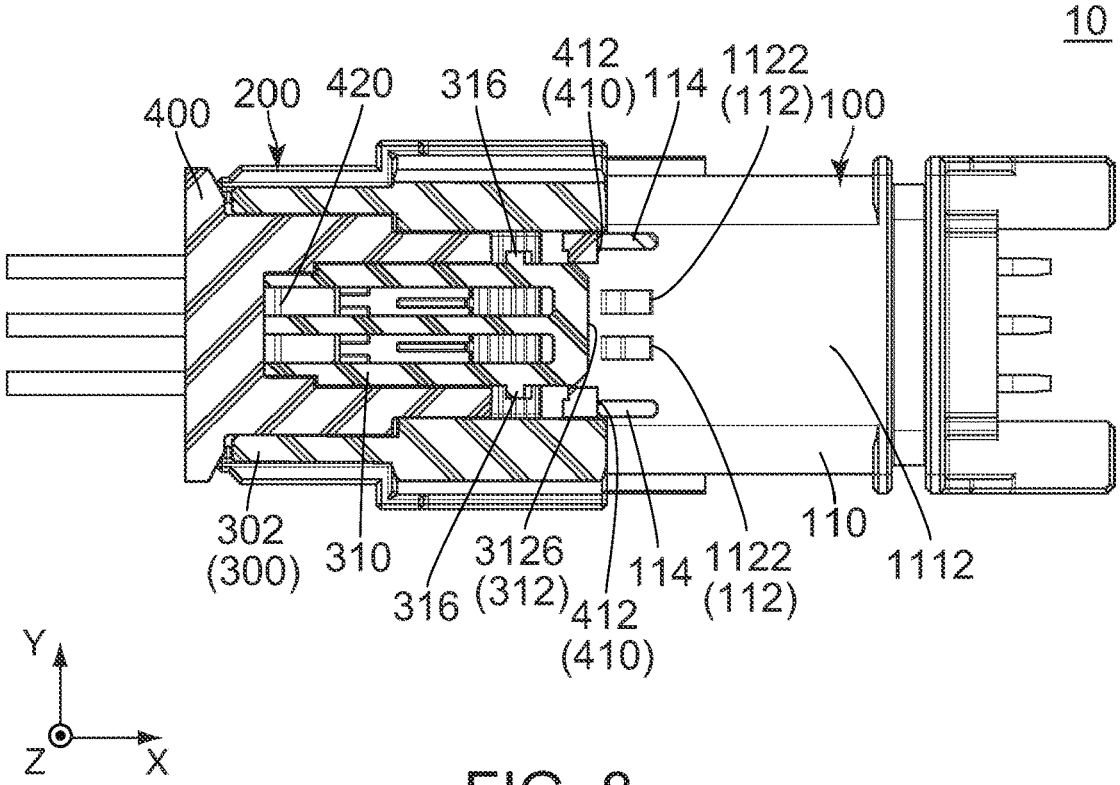
FIG. 8 is a cross-sectional view showing the connector assembly of FIG. 7, taken along line E-E.
Figure 9:
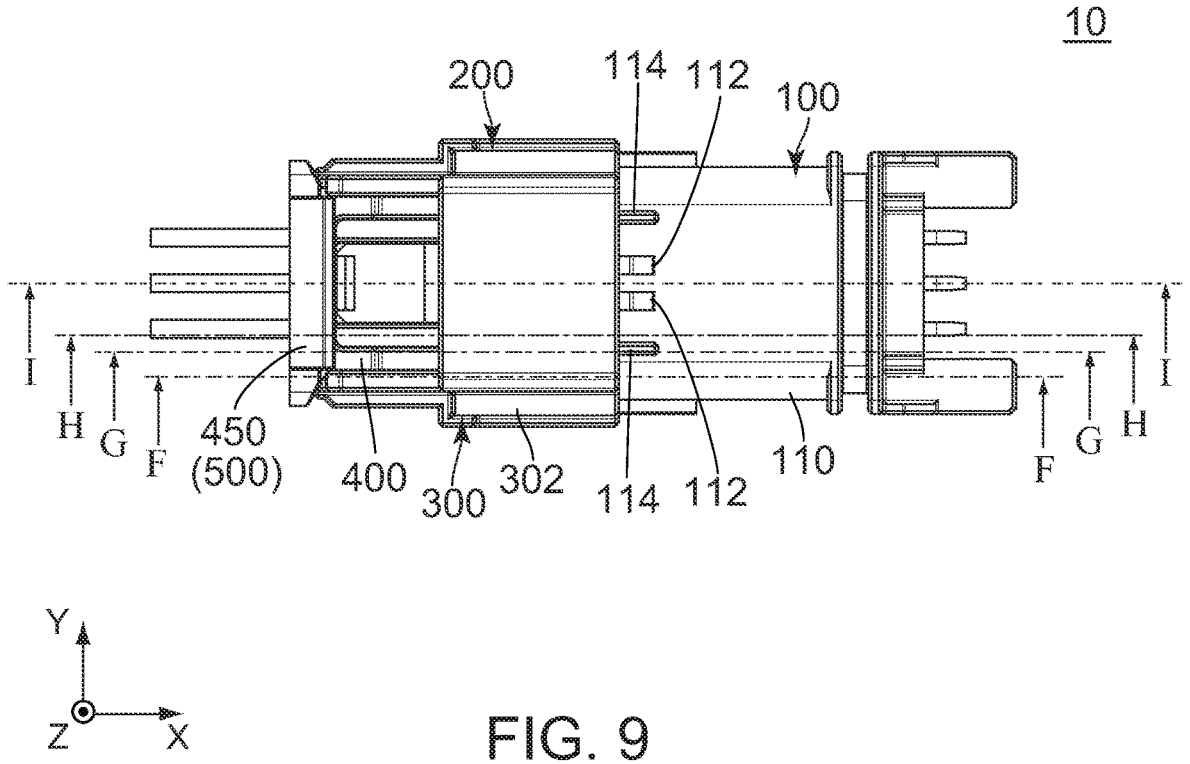
FIG. 9 is a top view showing the connector assembly of FIG. 7.

As shown in FIG. 6, the second connector 200 of the present embodiment comprises a second housing 300, a mating detecting member 400, a shift mechanism 500 and second terminals 250.

Figure 32:
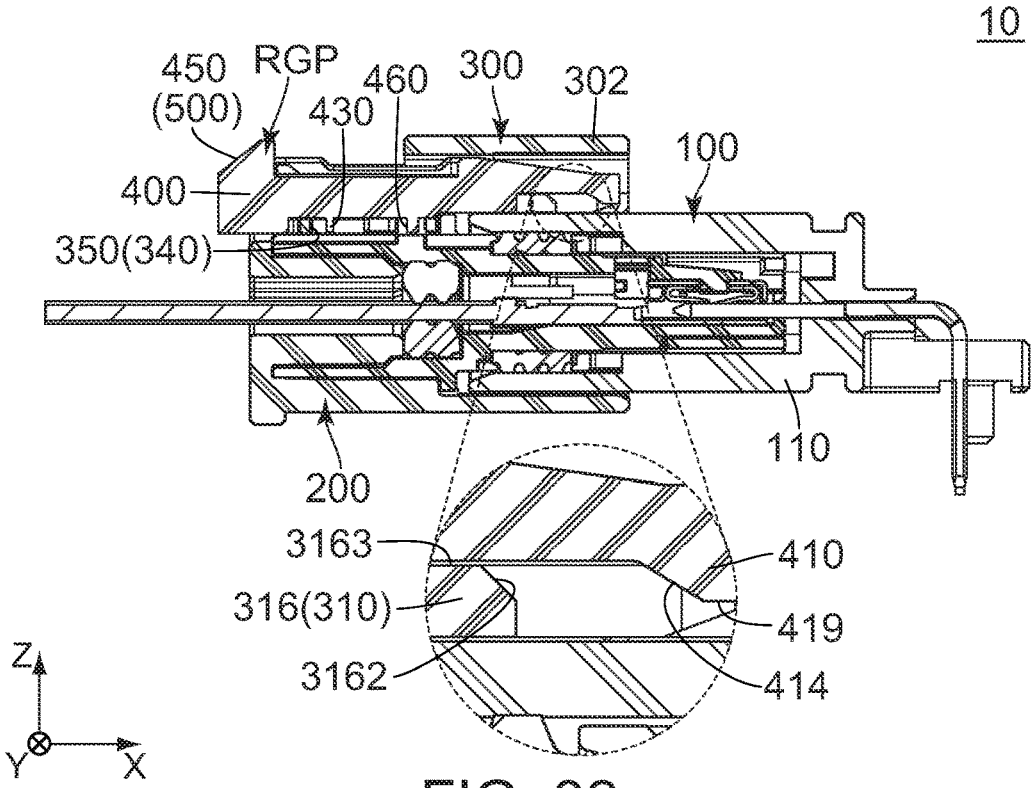
FIG. 32 is a cross-sectional view showing the connector assembly of FIG. 29, taken along line V-V. In the figure, a part of the connector assembly is illustrated enlarged.
Figure 33:
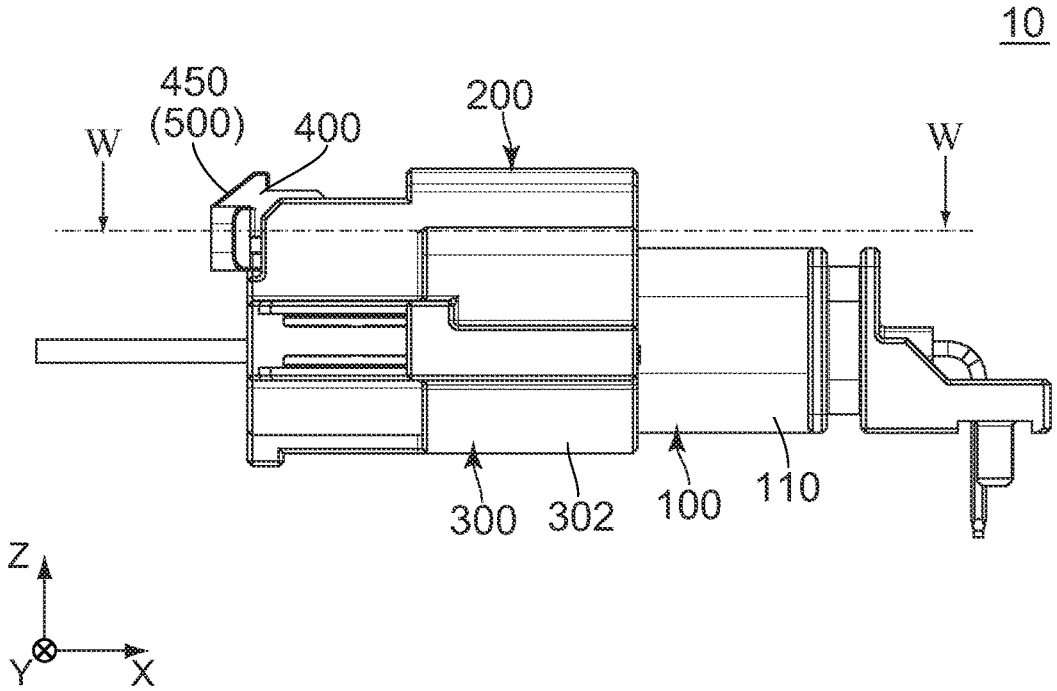
FIG. 33 is yet still another side view showing the connector assembly of FIG. 1. In the figure, the first lock portion of the first connector and the second lock portion of the second connector lock the mated state of the second housing with the first housing while the mating detecting member starts to be moved from the regulating position toward the allowable position.
Figure 34:
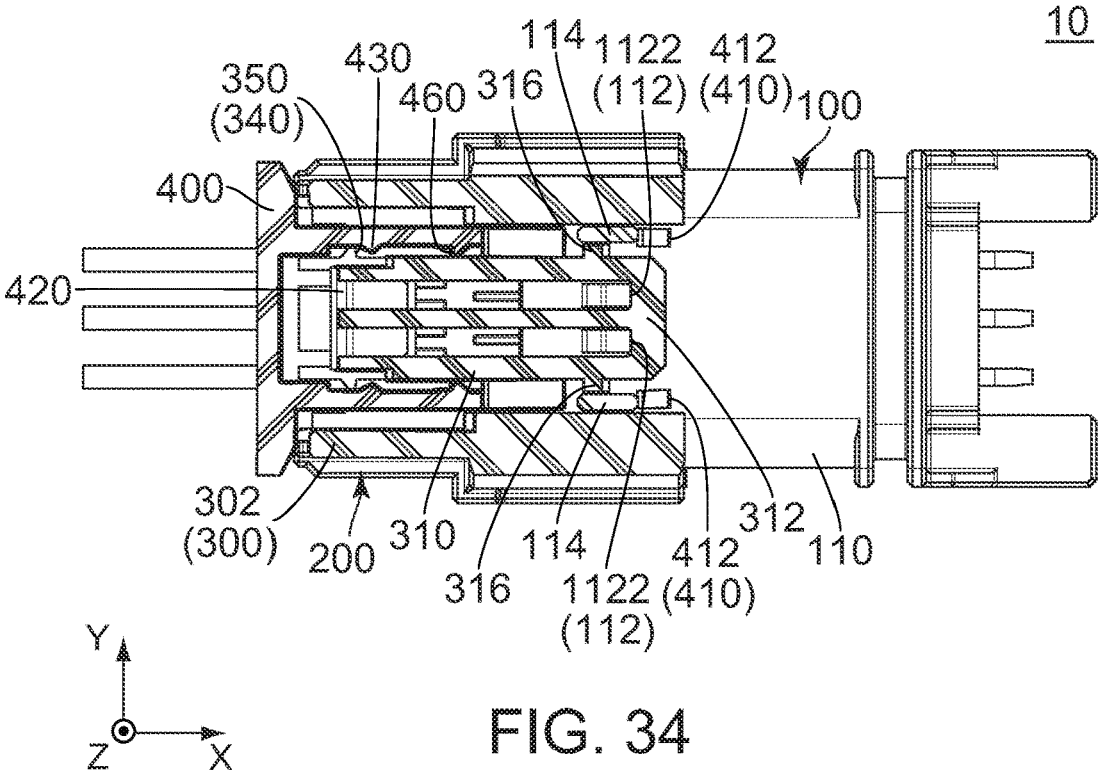
FIG. 34 is a cross-sectional view showing the connector assembly of FIG. 33, taken along line W-W.
Figure 35:
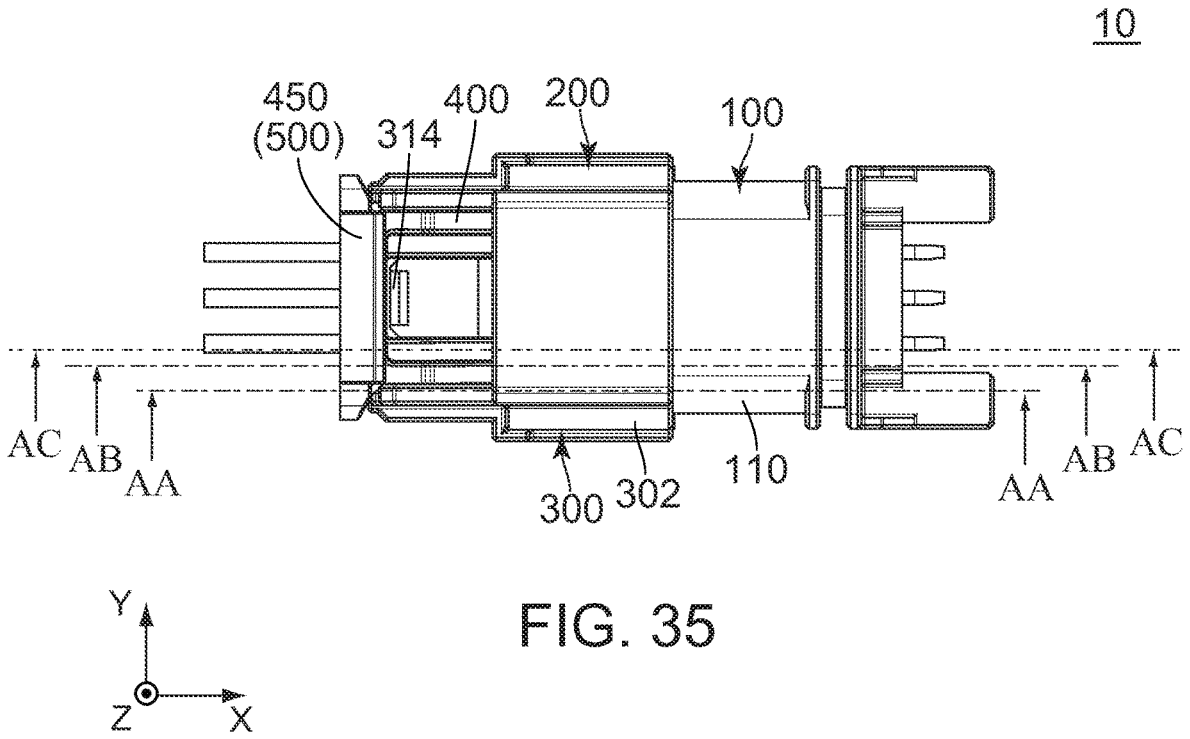
FIG. 35 is a top view showing the connector assembly of FIG. 33.
Figure 36:
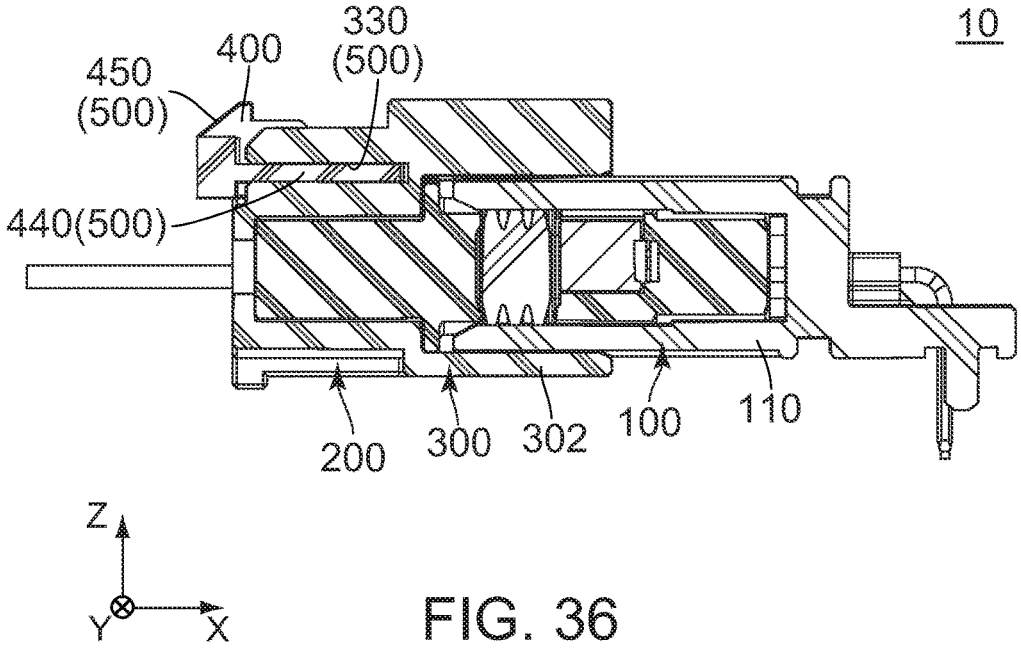
FIG. 36 is a cross-sectional view showing the connector assembly of FIG. 35, taken along line AA-AA.
Figure 37:
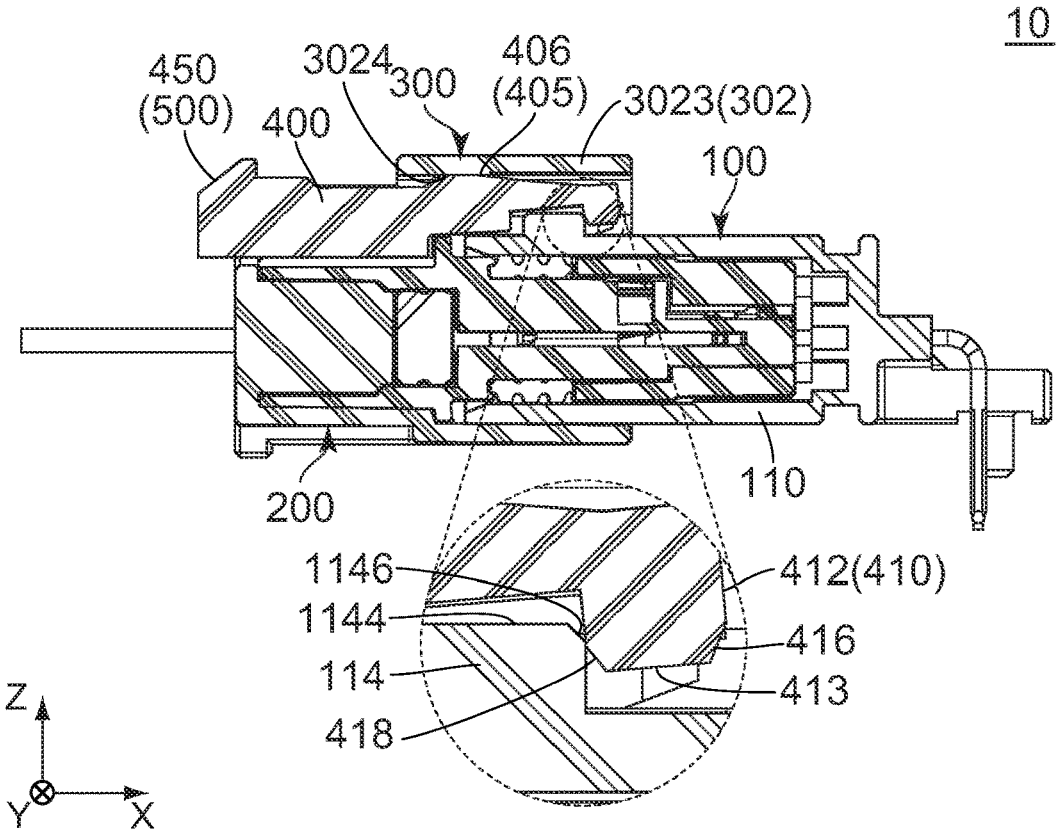
FIG. 37 is a cross-sectional view showing the connector assembly of FIG. 35, taken along line AB-AB. In the figure, a part of the connector assembly is illustrated enlarged.
Figure 38:
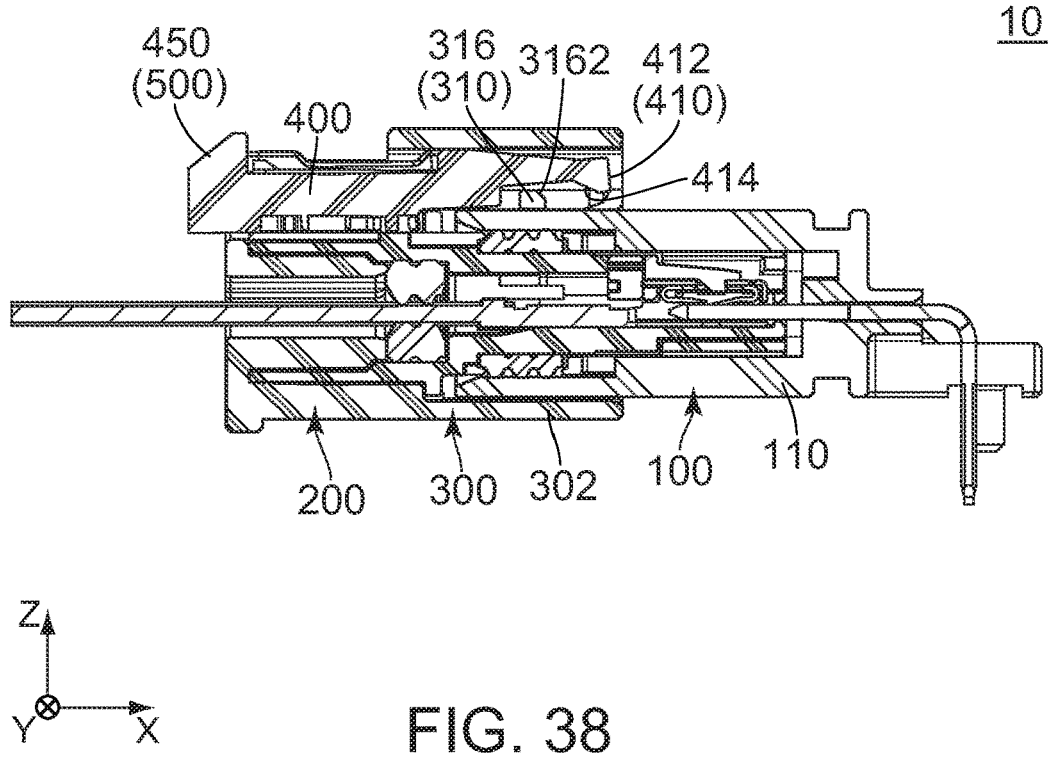
FIG. 38 is a cross-sectional view showing the connector assembly of FIG. 35, taken along line AC-AC.
Figure 39:
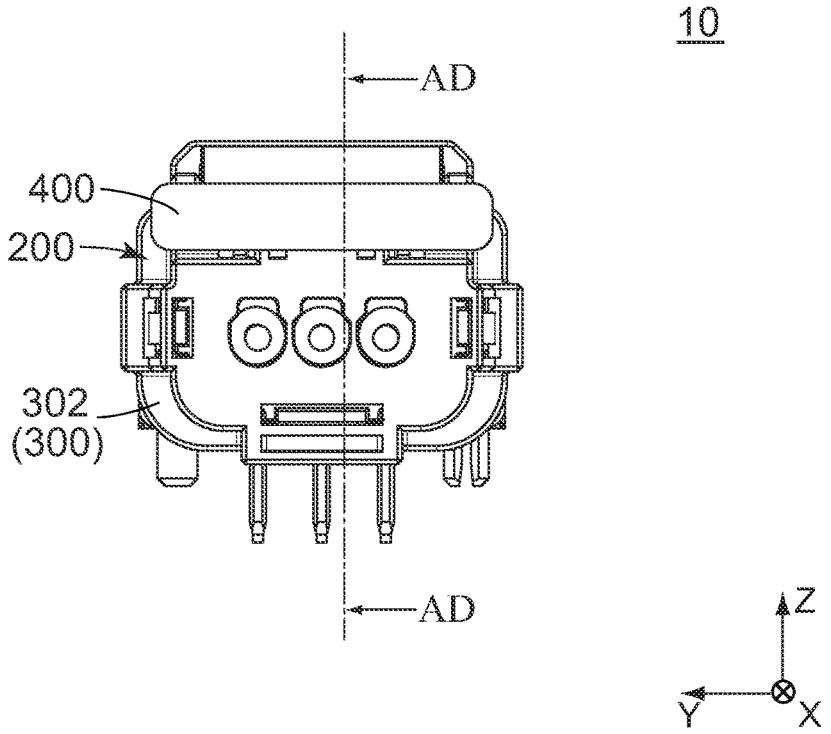
FIG. 39 is a rear view showing the connector assembly of FIG. 1. In the figure, the mating detecting member is positioned at the allowable position while the second lock portion is positioned at a release position.
Figure 49:
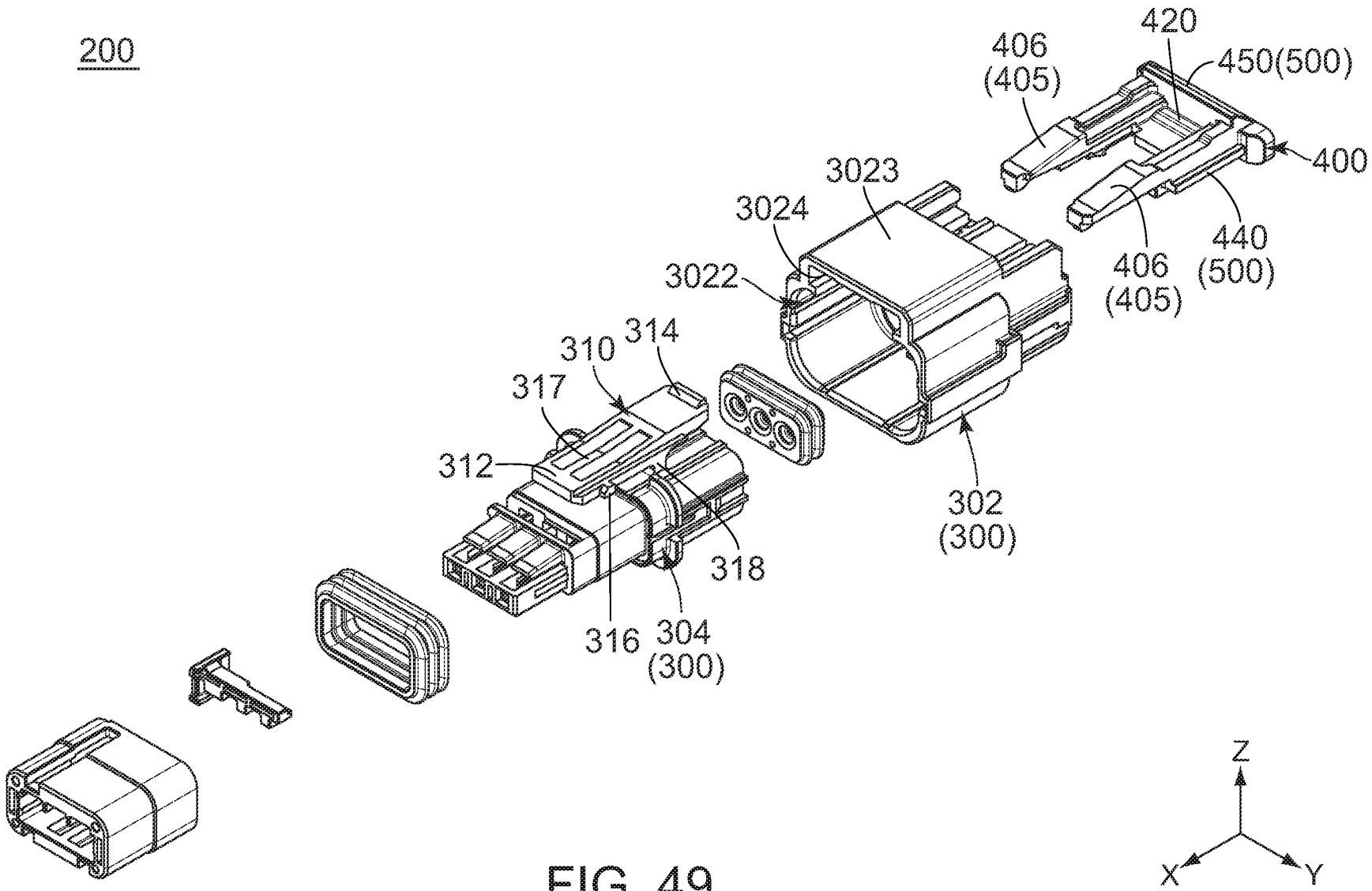
FIG. 49 is an exploded, perspective view showing the second connector of FIG. 45.

Referring to FIGS. 6 and 32, the second housing 300 of the present embodiment is mateable along the front-rear direction with the first housing 110 which is positioned forward of the second housing 300 in the front-rear direction. As shown in FIG. 49, the second housing 300 consists of a shroud cover 302 and a socket housing 304.

Figure 54:
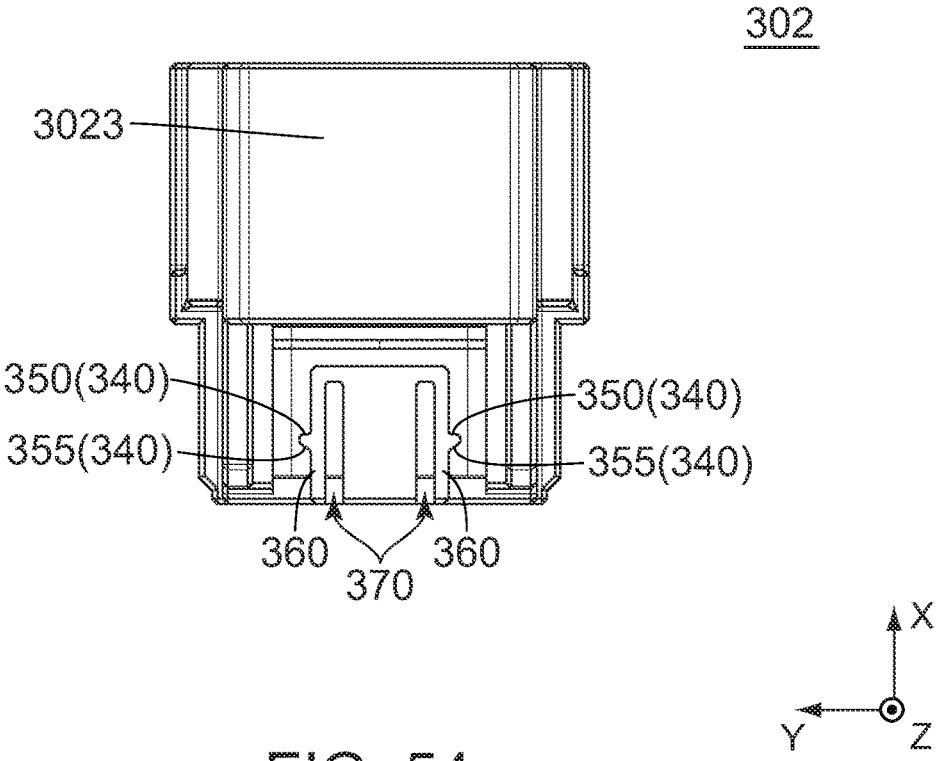
FIG. 54 is a top view showing a shroud cover which is included in the second connector of FIG. 49.
Figure 55:
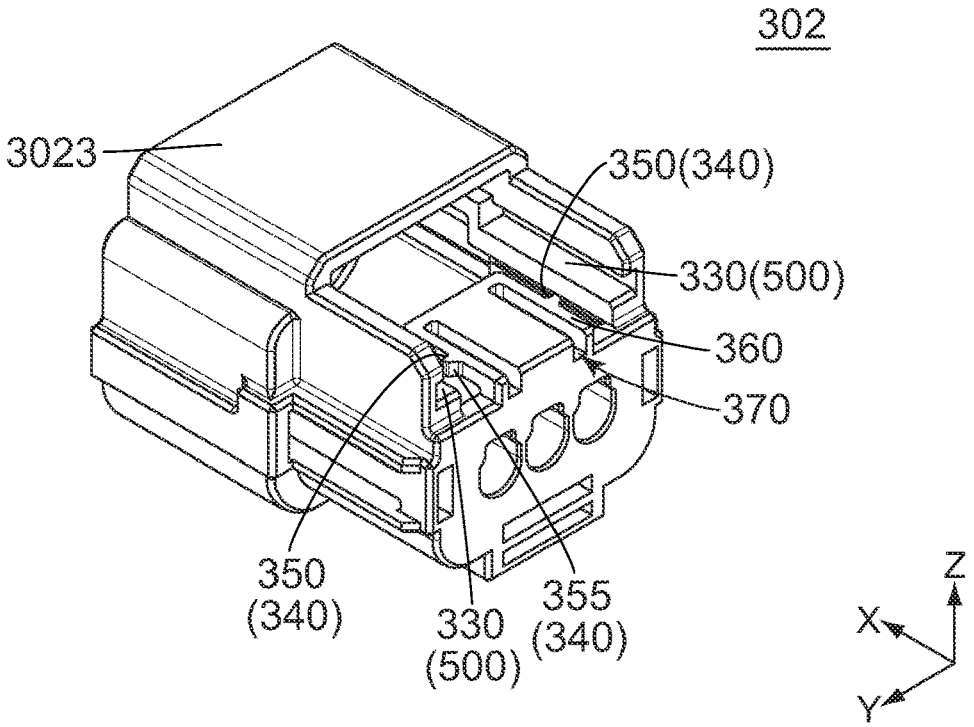
FIG. 55 is a rear, perspective view showing the shroud cover of FIG. 54.

As shown in FIGS. 49, 54 and 55, the shroud cover 302 of the present embodiment has a first housing accommodating portion 3022, a top plate 3023, a preventing portion 3024, guiding portions 330, two protrusions 340, two resilient portions 360 and two hole portions 370. In other words, the second housing 300 is provided with the guiding portions 330.

As shown in FIG. 49, the first housing accommodating portion 3022 of the present embodiment is a space which is opened at its front end and extends in the front-rear direction.

As shown in FIG. 55, the top plate 3023 of the present embodiment defines an upper end of the shroud cover 302. The top plate 3023 has a flat-plate shape perpendicular to the up-down direction.

As shown in FIG. 49, the preventing portion 3024 of the present embodiment is positioned above the first housing accommodating portion 3022 in the up-down direction. The preventing portion 3024 is a part of the top plate 3023.

As shown in FIG. 55, each of the guiding portions 330 of the present embodiment is a guide rail extending in the front-rear direction. Each of the guiding portions 330 is opened at a rear end of the shroud cover 302.

As shown in FIG. 54, each of the protrusions 340 of the present embodiment protrudes outward in the right-left direction. The protrusions 340 correspond to the resilient portions 360, respectively. Each of the protrusions 340 protrudes outward in the right-left direction from the resilient portion 360 corresponding thereto. Each of the protrusions 340 has a retaining portion 350 and a slope portion 355. In other words, the second housing 300 has the retaining portions 350.

As shown in FIG. 54, each of the retaining portions 350 of the present embodiment is positioned at a rear part of the shroud cover 302. The retaining portion 350 defines a front end of the protrusion 340 in the front-rear direction. The retaining portion 350 is a plane perpendicular to the front-rear direction, As shown in FIG. 54, the slope portion 355 of the present embodiment is positioned rearward of the retaining portion 350 in the front-rear direction. The slope portion 355 faces rearward in the front-rear direction and outward in the right-left direction. The slope portion 355 extends forward in the front-rear direction and outward in the right-left direction.

As shown in FIG. 54, each of the resilient portions 360 of the present embodiment extends forward from the rear end of the shroud cover 302. Each of the resilient portions 360 is resiliently deformable. Specifically, each of the resilient portions 360 resiliently supports the protrusion 340 corresponding thereto.

As shown in FIG. 54, each of the hole portions 370 of the present embodiment is an elongated hole extending in the front-rear direction. The hole portions 370 correspond to the resilient portions 360, respectively. Each of the hole portions 370 is positioned inward in the right-left direction beyond the resilient portion 360 corresponding thereto.

As described above, the resilient portion 360 is resiliently deformable and the hole portion 370 is positioned inward in the right-left direction beyond the resilient portion 360 corresponding thereto. Accordingly, the resilient portion 360 is resiliently deformable inwardly in the right-left direction so that the protrusion 340 is movable inward in the right-left direction.

As shown in FIG. 6, the socket housing 304 of the present embodiment is fixed to the shroud cover 302. As shown in FIG. 49, the socket housing 304 is provided with a second lock portion 310. In other words, the second housing 300 is provided with the second lock portion 310.

Figure 15:
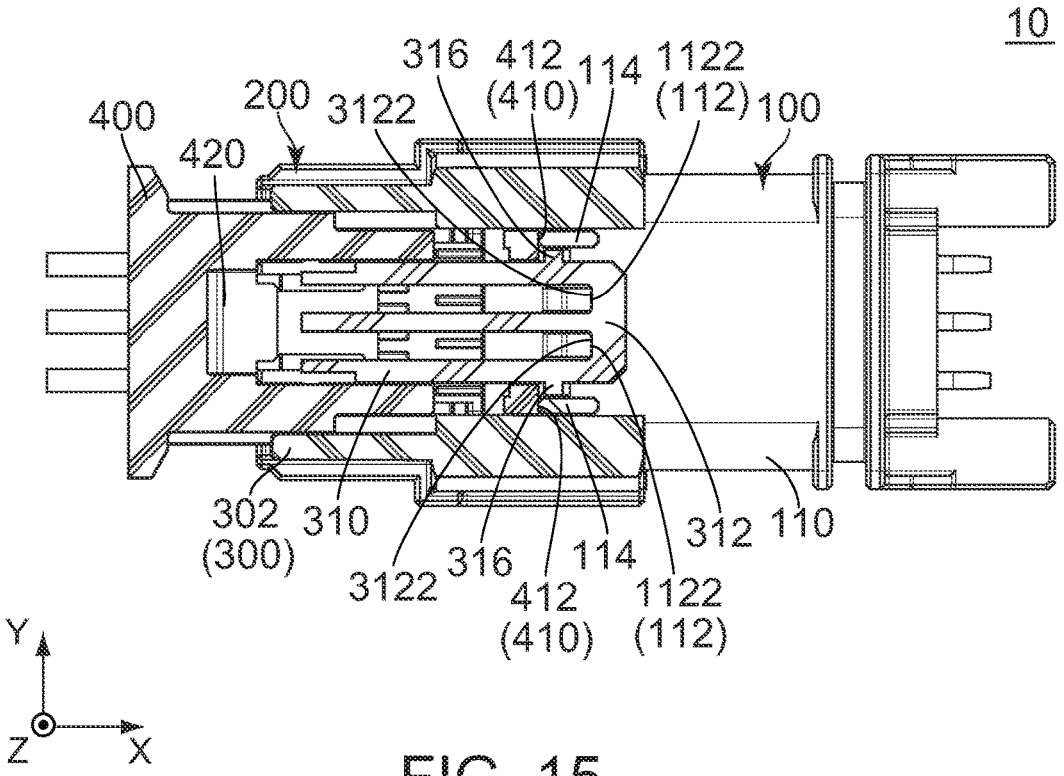
FIG. 15 is a cross-sectional view showing the connector assembly of FIG. 14, taken along line J-J.
Figure 16:
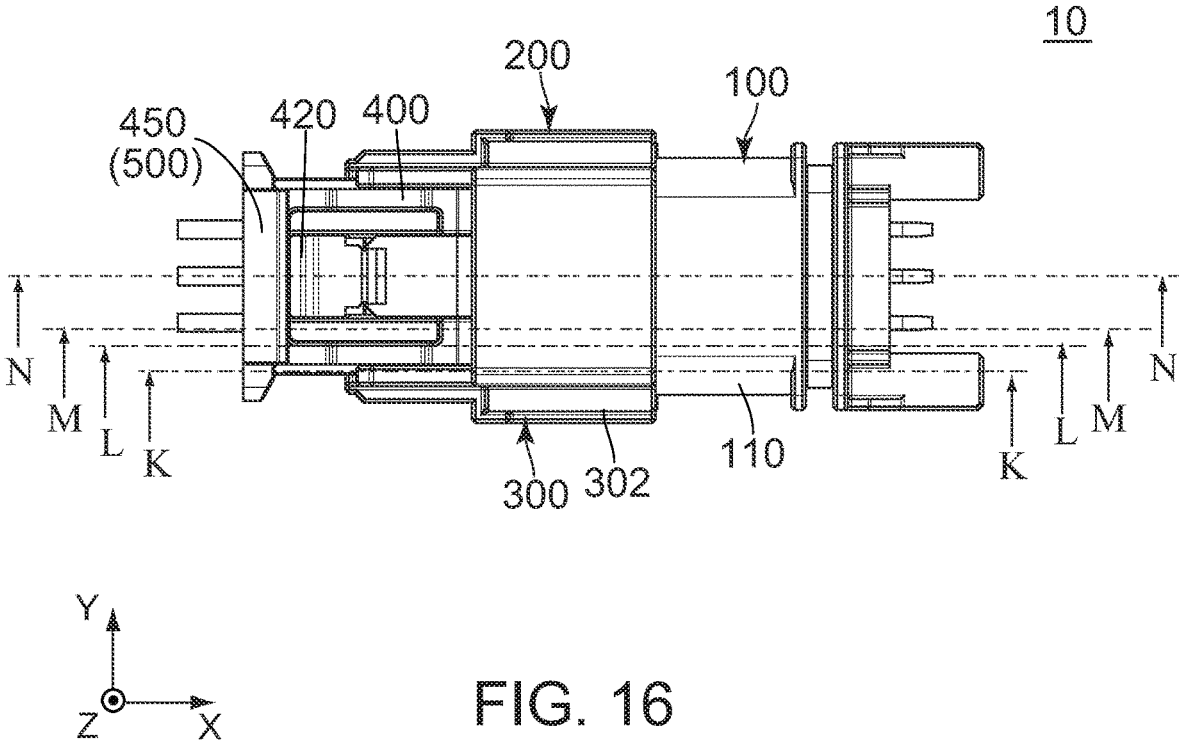
FIG. 16 is a top view showing the connector assembly of FIG. 14.
Figure 20:
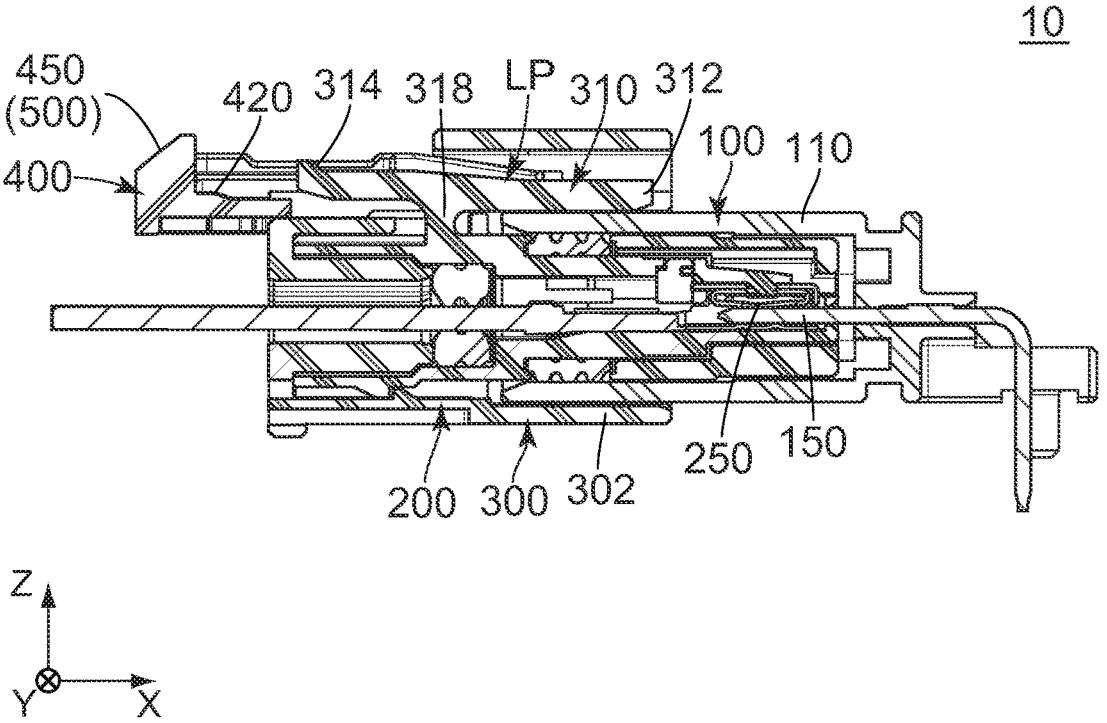
FIG. 20 is a cross-sectional view showing the connector assembly of FIG. 16, taken along line N-N.
Figure 21:
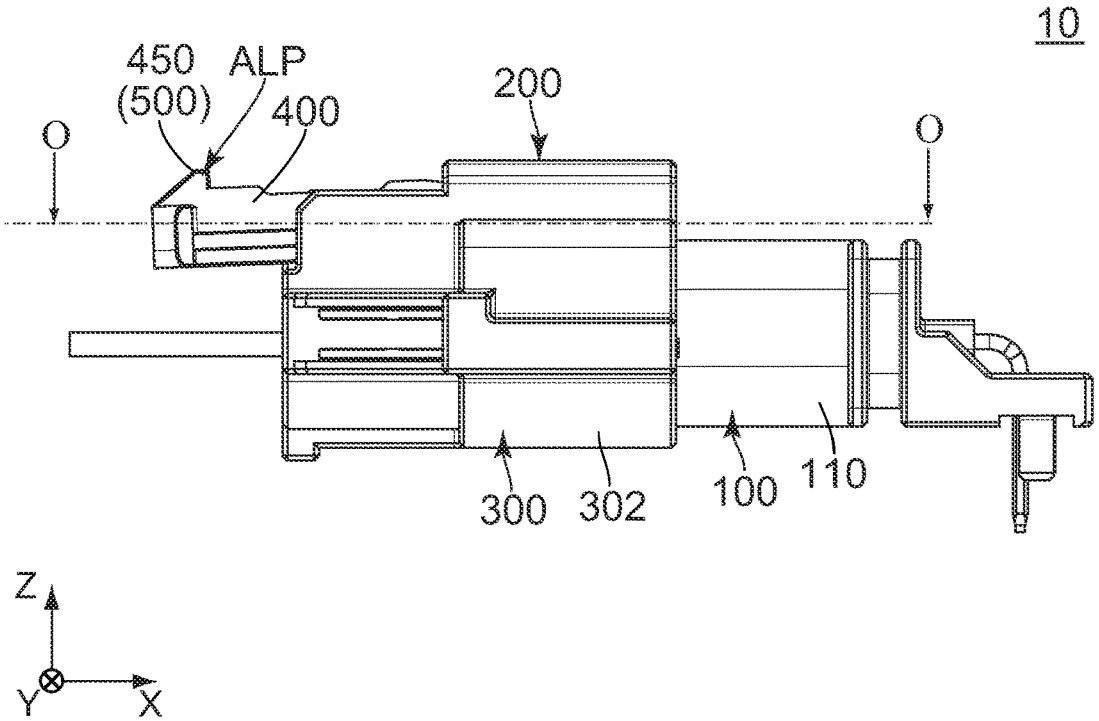
FIG. 21 is yet another side view showing the connector assembly of FIG. 1. In the figure, the first lock portion of the first connector and the second lock portion of the second connector lock the mated state of the second housing with the first housing while a shift operation portion of the mating detecting member is pushed down.
Figure 22:
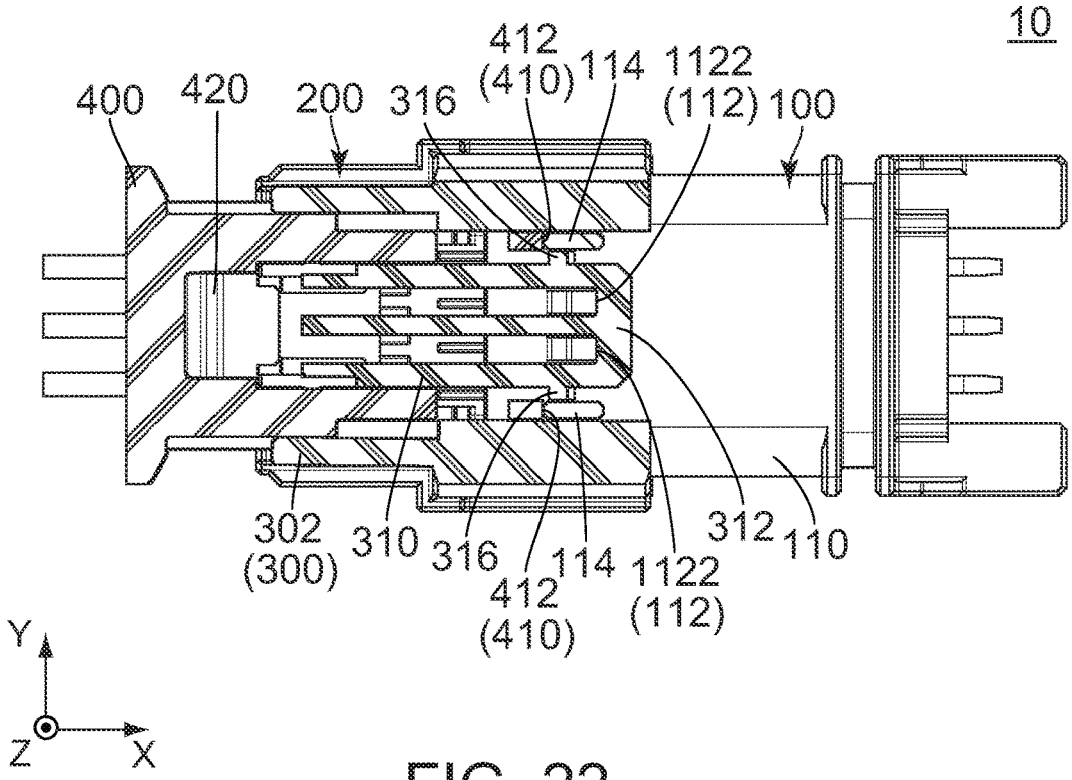
FIG. 22 is a cross-sectional view showing the connector assembly of FIG. 21, taken along line O-O.
Figure 23:
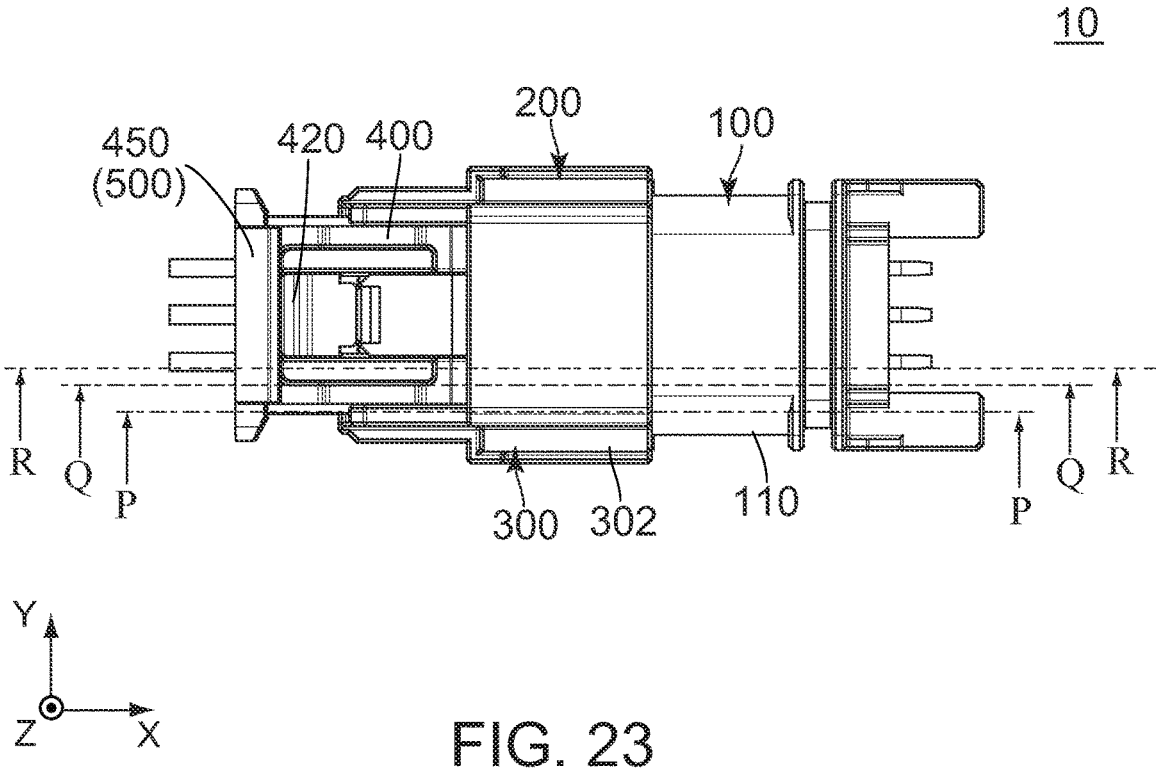
FIG. 23 is a top view showing the connector assembly of FIG. 21.
Figure 24:
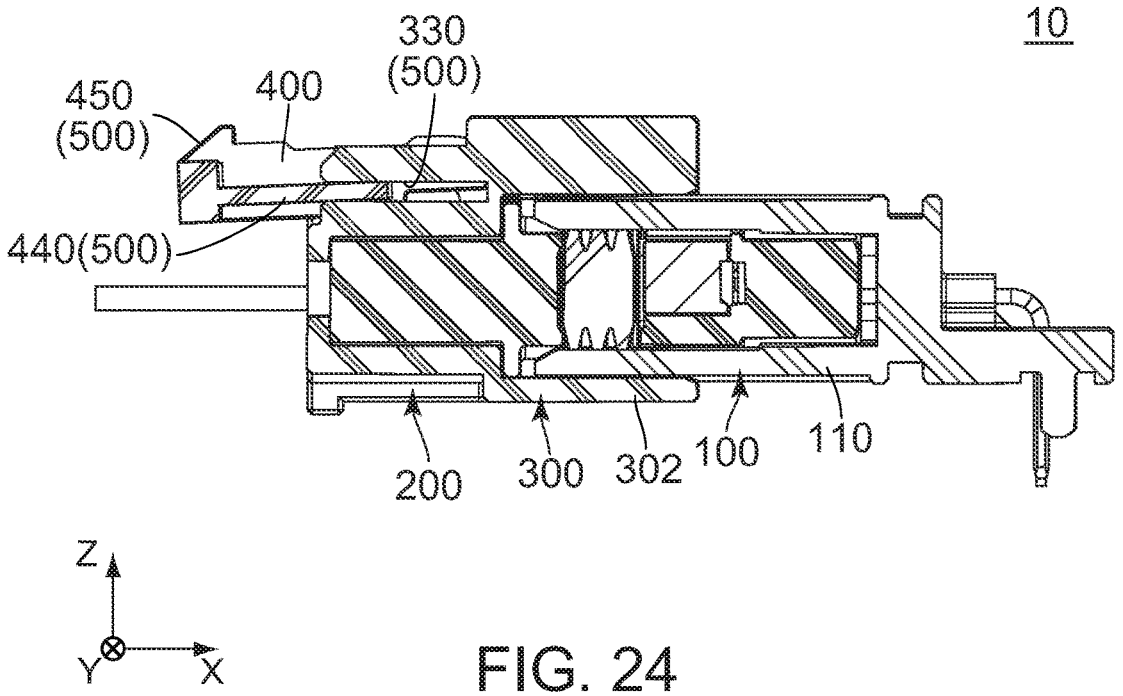
FIG. 24 is a cross-sectional view showing the connector assembly of FIG. 23, taken along line P-P.
Figure 40:
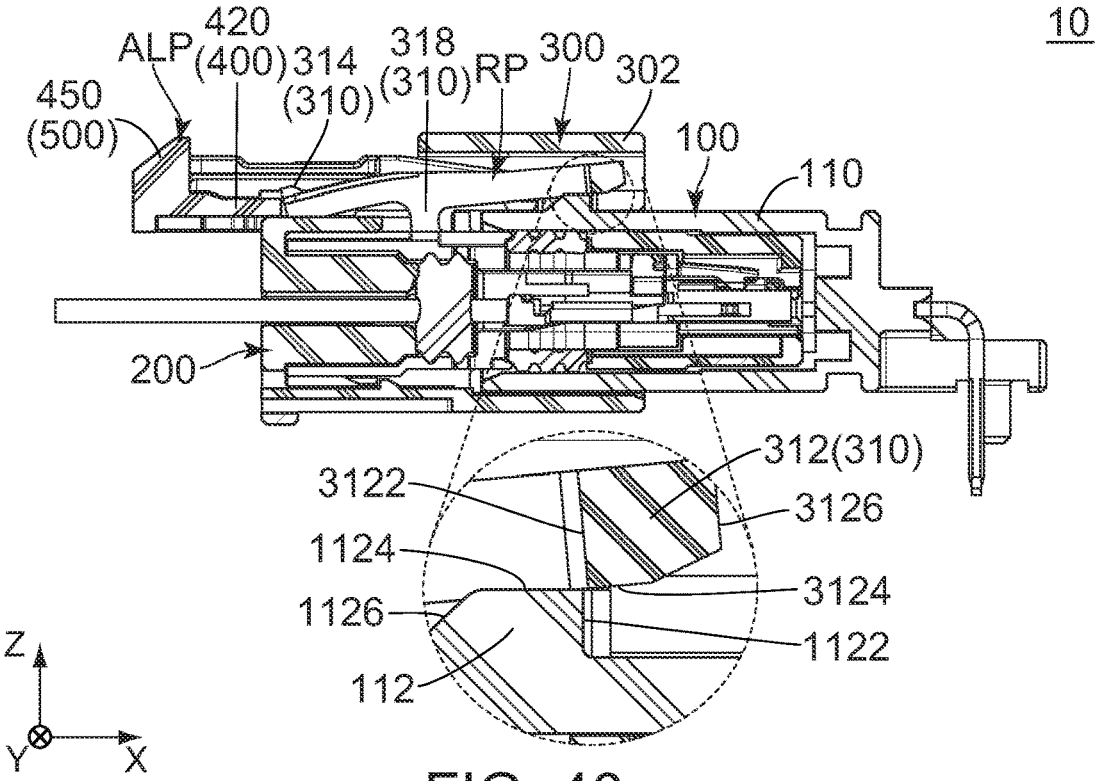
FIG. 40 is a cross-sectional view showing the connector assembly of FIG. 39, taken along line AD-AD. In the figure, a part of the connector assembly is illustrated enlarged.
Figure 41:
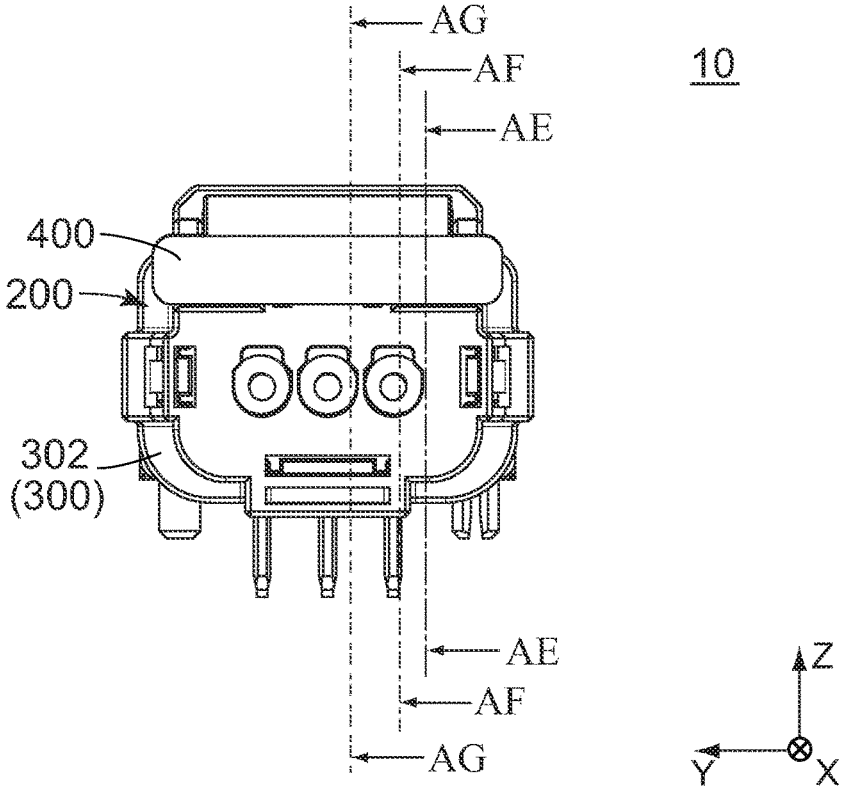
FIG. 41 is another rear view showing the connector assembly of FIG. 1, wherein: the second lock portion is positioned between a lock position and the release position; the first lock portion and the second lock portion do not lock the mated state of the second housing with the first housing; and the mating detecting member is positioned between the allowable position and the regulating position.
Figure 42:
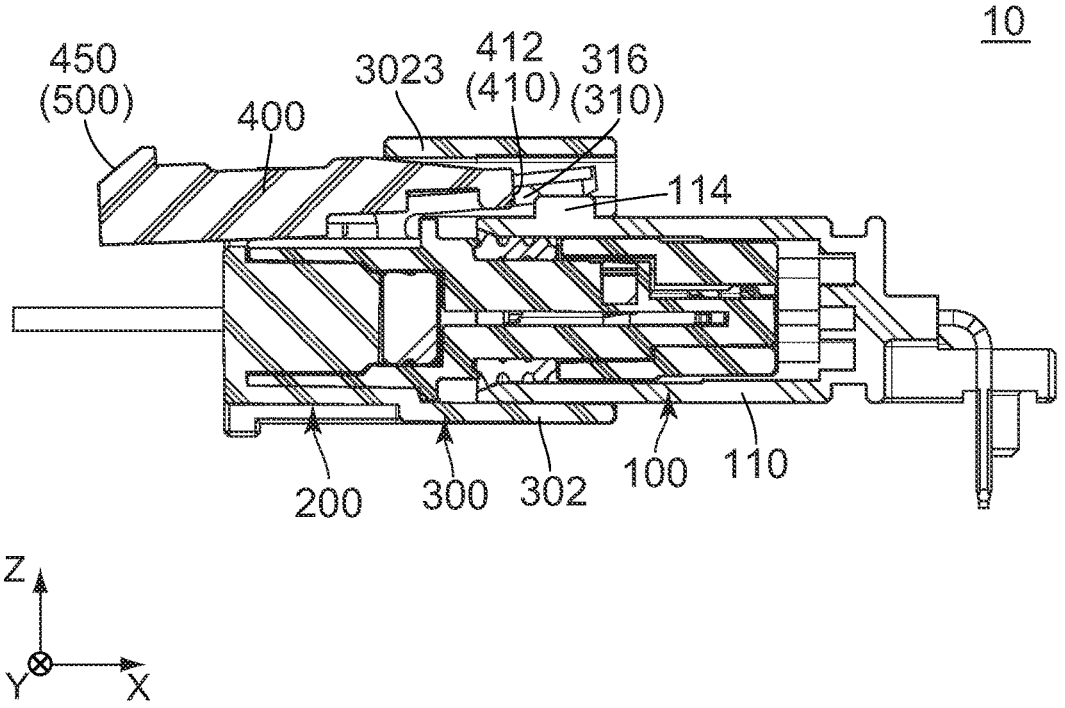
FIG. 42 is a cross-sectional view showing the connector assembly of FIG. 41, taken along line AE-AE.

As shown in FIGS. 20 and 40, the second lock portion 310 of the present embodiment is positionable at any of a lock position LP and a release position RP. The second lock portion 310 is movable in the up-down direction. However, the present invention is not limited thereto. A movement direction of the second lock portion 310 may be, for example, the right-left direction. Specifically, the second lock portion 310 should be movable in a perpendicular direction perpendicular to the front-rear direction. In other words, the movement direction of the second lock portion 310 should be the perpendicular direction. The second lock portion 310 is positioned at the lock position LP when in its initial state. Referring to FIGS. 15 and 20, when the second lock portion 310 is positioned at the lock position LP, the first lock portions 112 and the second lock portion 310 lock a mated state where the second housing 300 is mated with the first housing 110.

As shown in FIG. 49, the second lock portion 310 has a locking lug 312, a release operation portion 314 and a resilient supporting portion 317.

As shown in FIG. 49, the locking lug 312 of the present embodiment is positioned at a front end of the second lock portion 310 in the front-rear direction. Referring to FIGS. 20 and 40, a position of the locking lug 312 upon the second lock portion 310 being at the lock position LP is positioned below a position of the locking lug 312 upon the second lock portion 310 being at the release position RP.

As shown in FIG. 40, the locking lug 312 has second lock surfaces 3122, a lower surface 3124 and a front end 3126.

As shown in FIG. 40, each of the second lock surfaces 3122 of the present embodiment is a surface facing rearward in the front-rear direction. The second lock surface 3122 defines a rear end of the locking lug 312 in the front-rear direction.

As shown in FIG. 40, the lower surface 3124 of the present embodiment is a surface facing downward in the up-down direction. The lower surface 3124 defines a lower end of the locking lug 312 in the up-down direction.

As shown in FIG. 40, the front end 3126 of the present embodiment is positioned at a front end of the locking lug 312 in the front-rear direction. The front end 3126 is also the front end of the second lock portion 310.

As shown in FIG. 49, the release operation portion 314 of the present embodiment defines a rear end of the second lock portion 310. Referring to FIGS. 20 and 40, when the release operation portion 314 is pushed down, the locking lug 312 is moved upward in the up-down direction perpendicular to the front-rear direction so that the second lock portion 310 is moved to the release position RP. More specifically, when the release operation portion 314 is pushed down, the locking lug 312 is moved upward in the up-down direction perpendicular to the front-rear direction so that the second lock portion 310 is moved from the lock position LP to the release position RP.

As shown in FIG. 49, the resilient supporting portion 317 of the present embodiment extends in the front-rear direction. The resilient supporting portion 317 is positioned rearward of the locking lug 312 in the front-rear direction. The resilient supporting portion 317 is positioned forward of the release operation portion 314 in the front-rear direction. The resilient supporting portion 317 is resiliently deformable.

Figure 2:
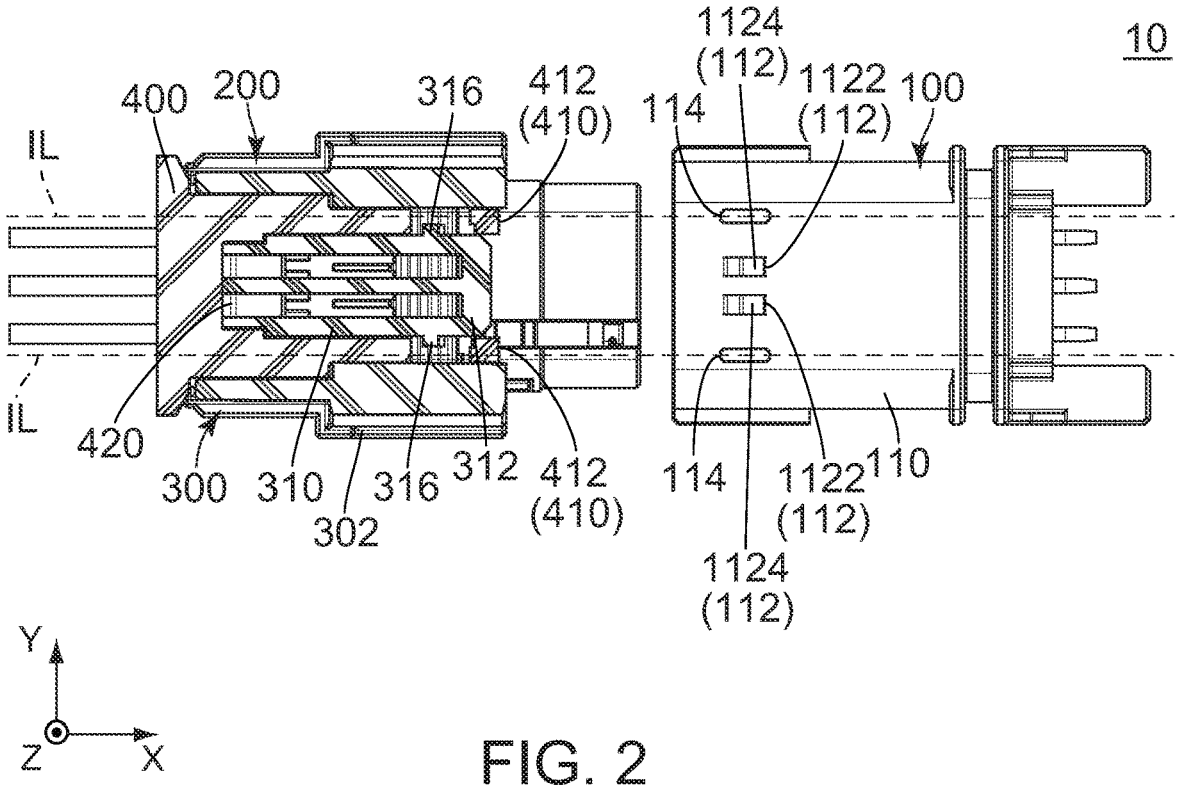
FIG. 2 is a cross-sectional view showing the connector assembly of FIG. 1, taken along line A-A.
Figure 3:
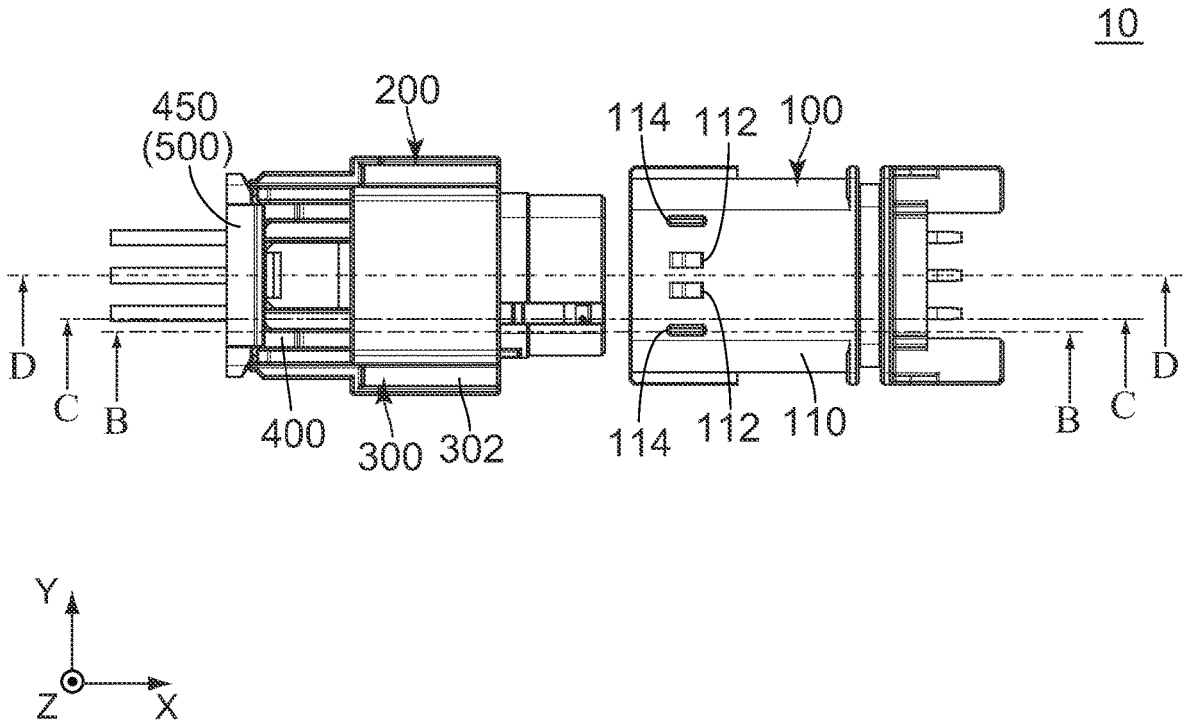
FIG. 3 is a top view showing the connector assembly of FIG. 1.
Figure 4:
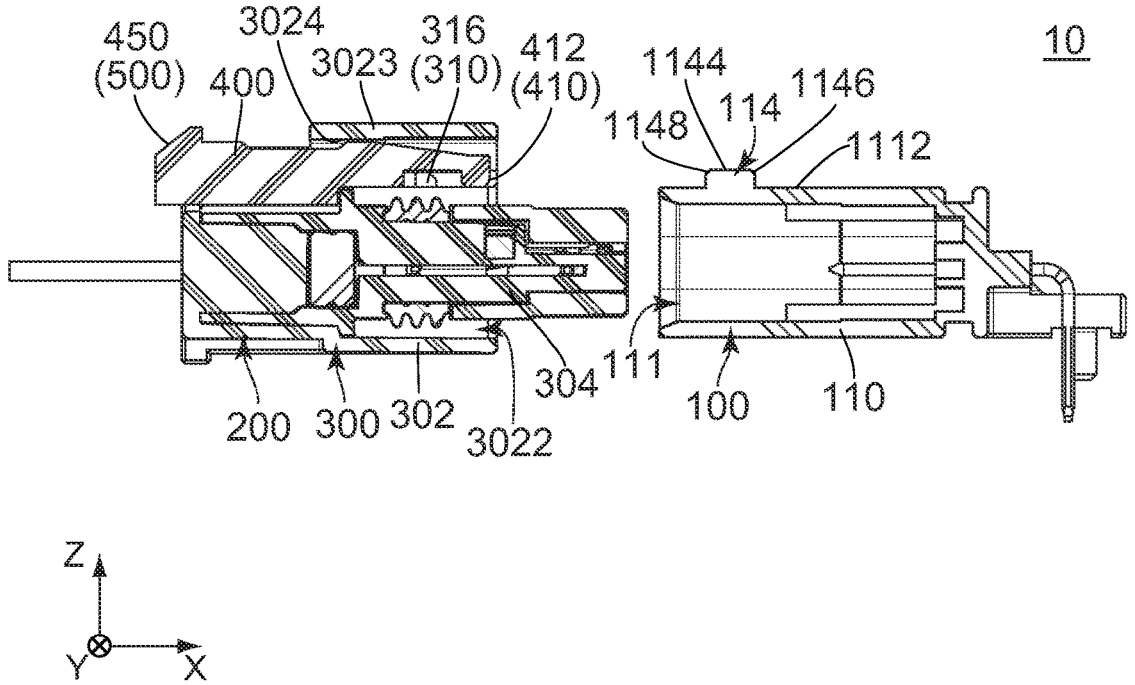
FIG. 4 is a cross-sectional view showing the connector assembly of FIG. 3, taken along line B-B.
Figure 5:
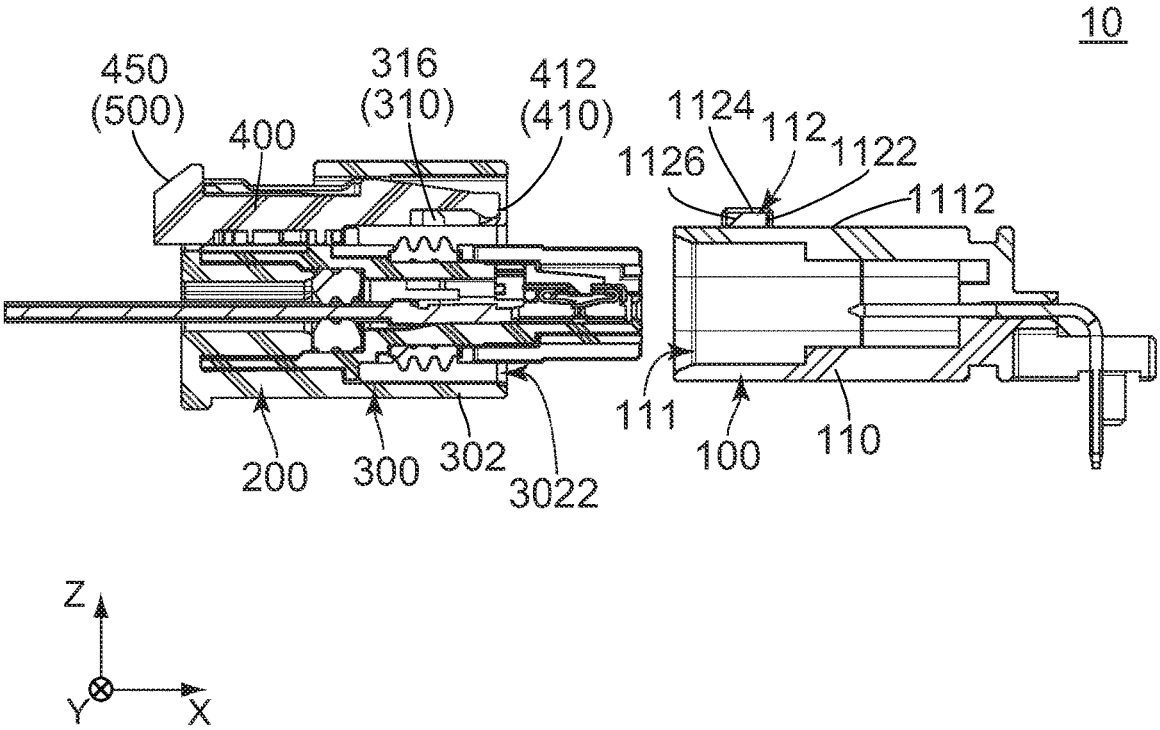
FIG. 5 is a cross-sectional view showing the connector assembly of FIG. 3, taken along line C-C.

As shown in FIG. 2, the second lock portion 310 of the present embodiment is provided with two movement regulating projections 316.

As shown in FIG. 2, each of the movement regulating projections 316 of the present embodiment protrudes outward in the right-left direction. The movement regulating projections 316 are positioned at opposite ends, respectively, of the second lock portion 310 in the right-left direction. Each of the movement regulating projections 316 is positioned around the front end of the second lock portion 310 in the front-rear direction. Each of the movement regulating projections 316 is positioned rearward of the locking lug 312 in the front-rear direction. As shown in FIG. 49, the movement regulating projections 316 protrude outward in the right-left direction from outward ends, respectively, of the resilient supporting portion 317 in the right-left direction. Each of the movement regulating projections 316 is positioned forward of the release operation portion 314 in the front-rear direction. When the release operation portion 314 is pushed downward, each of the movement regulating projections 316 is moved upward in the up-down direction perpendicular to the front-rear direction.

Figure 43:
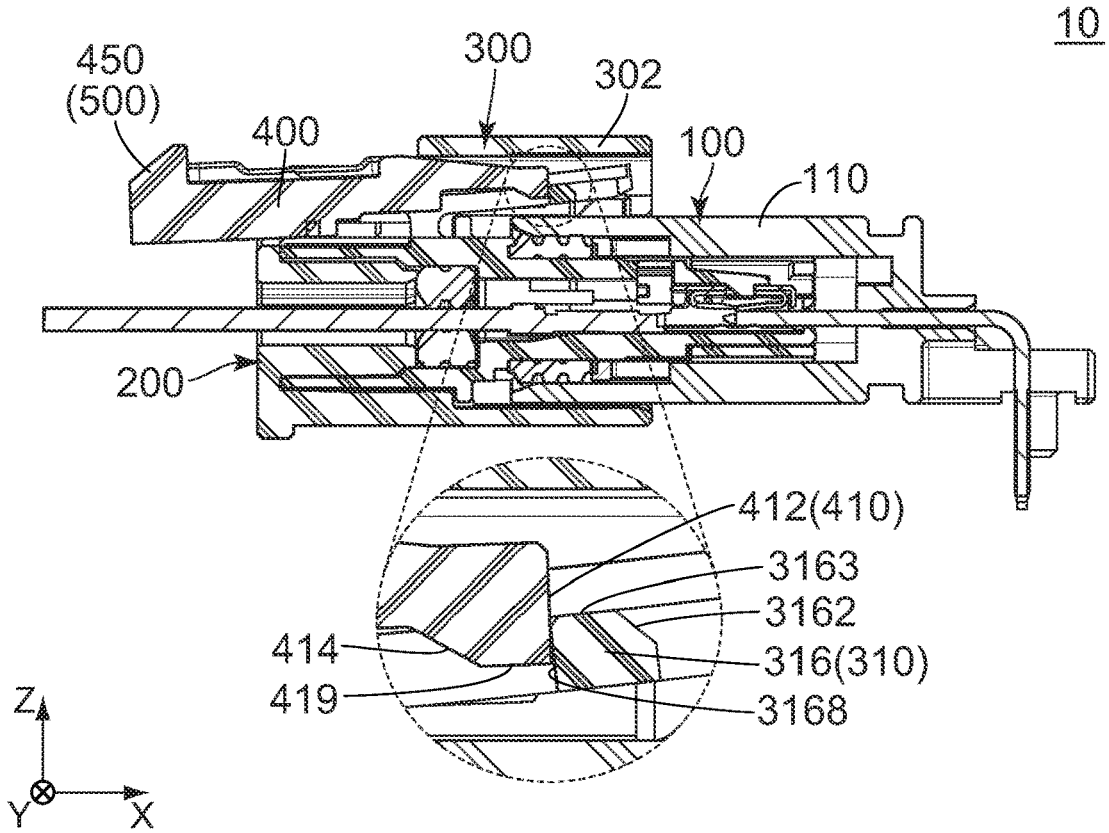
FIG. 43 is a cross-sectional view showing the connector assembly of FIG. 41, taken along line AF-AF. In the figure, a part of the connector assembly is illustrated enlarged.
Figure 44:
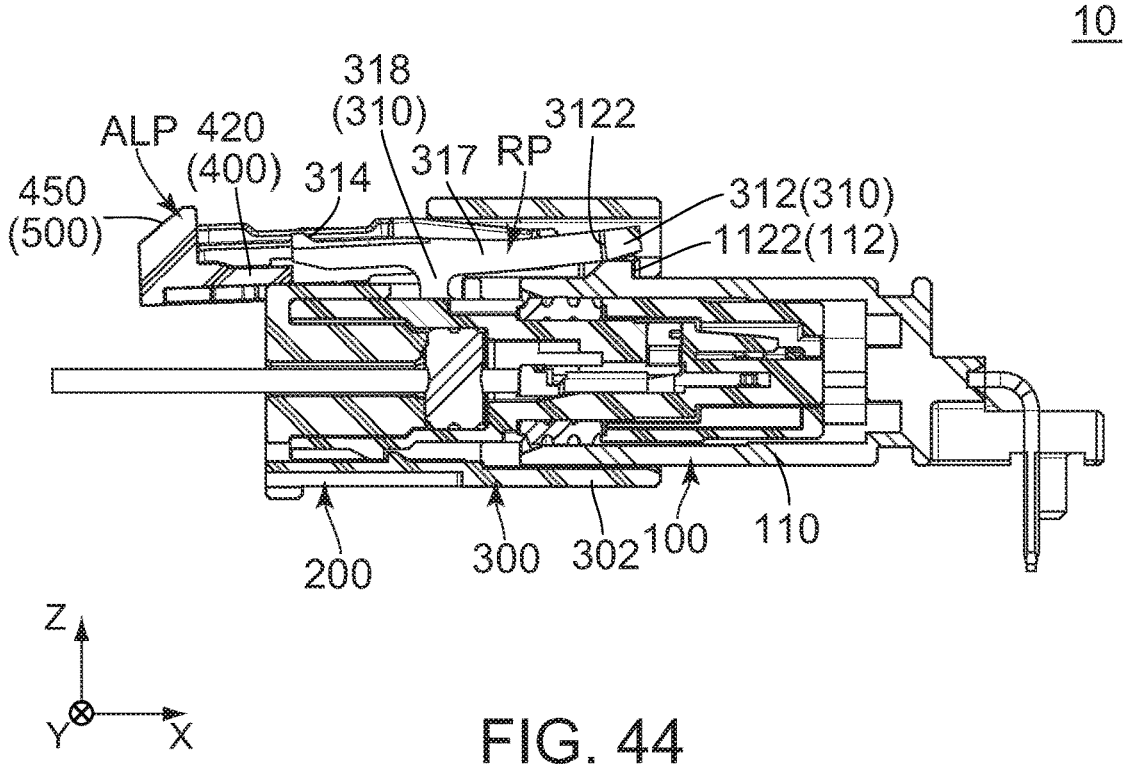
FIG. 44 is a cross-sectional view showing the connector assembly of FIG. 41, taken along line AG-AG.
Figure 45:
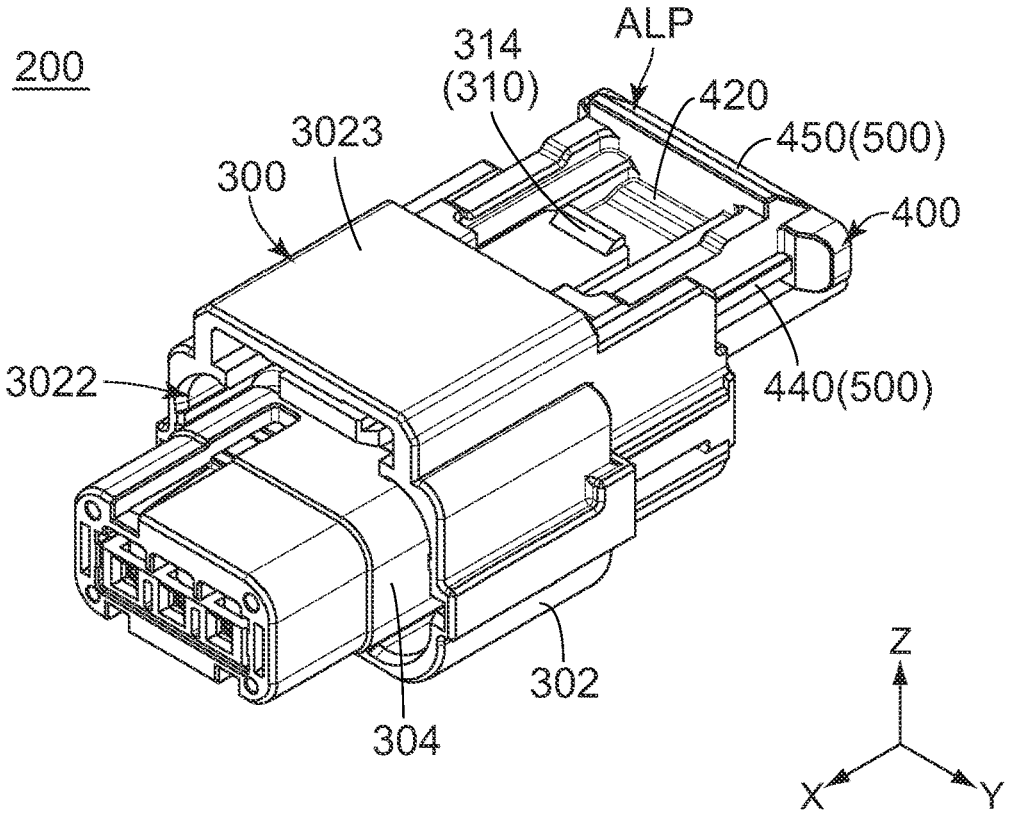
FIG. 45 is a perspective view showing the second connector which is included in the connector assembly of FIG. 1. In the figure, the mating detecting member is positioned at the allowable position.
Figure 46:
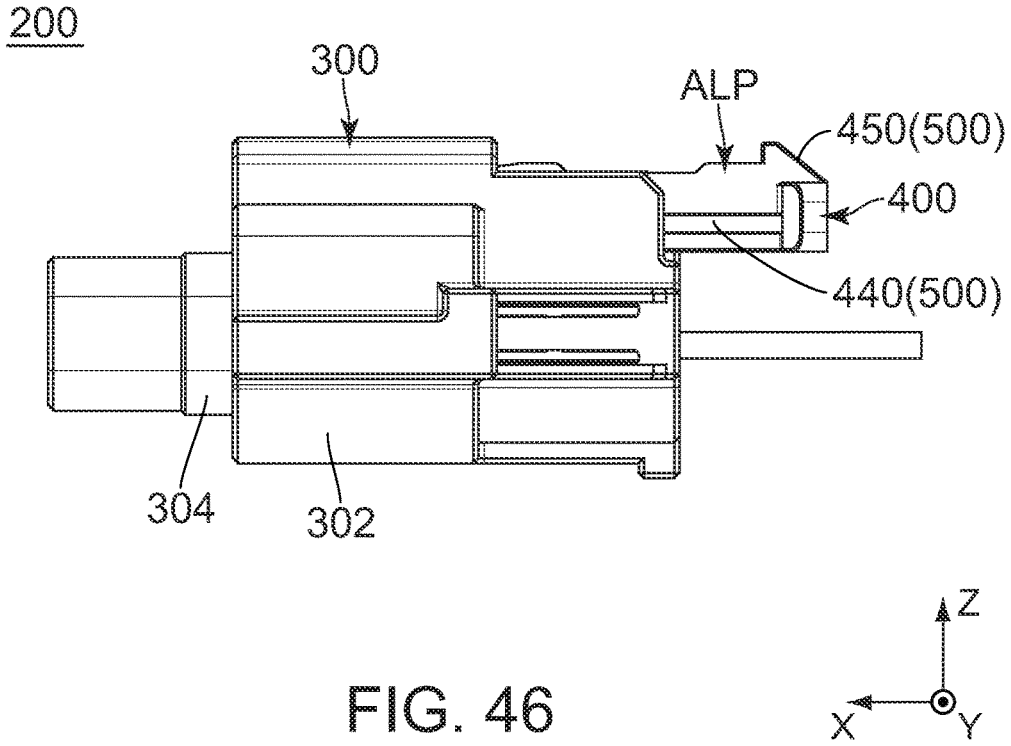
FIG. 46 is a side view showing the second connector of FIG. 45.
Figure 47:
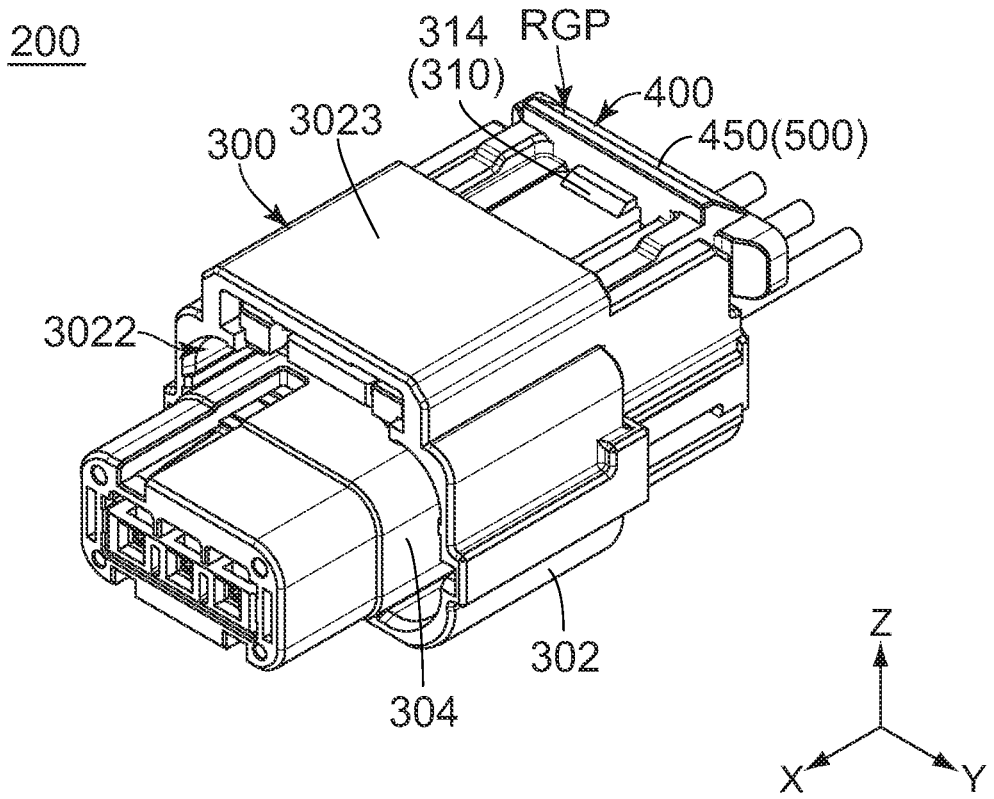
FIG. 47 is another perspective view showing the second connector of FIG. 45. In the figure, the mating detecting member is positioned at the regulating position.
Figure 48:
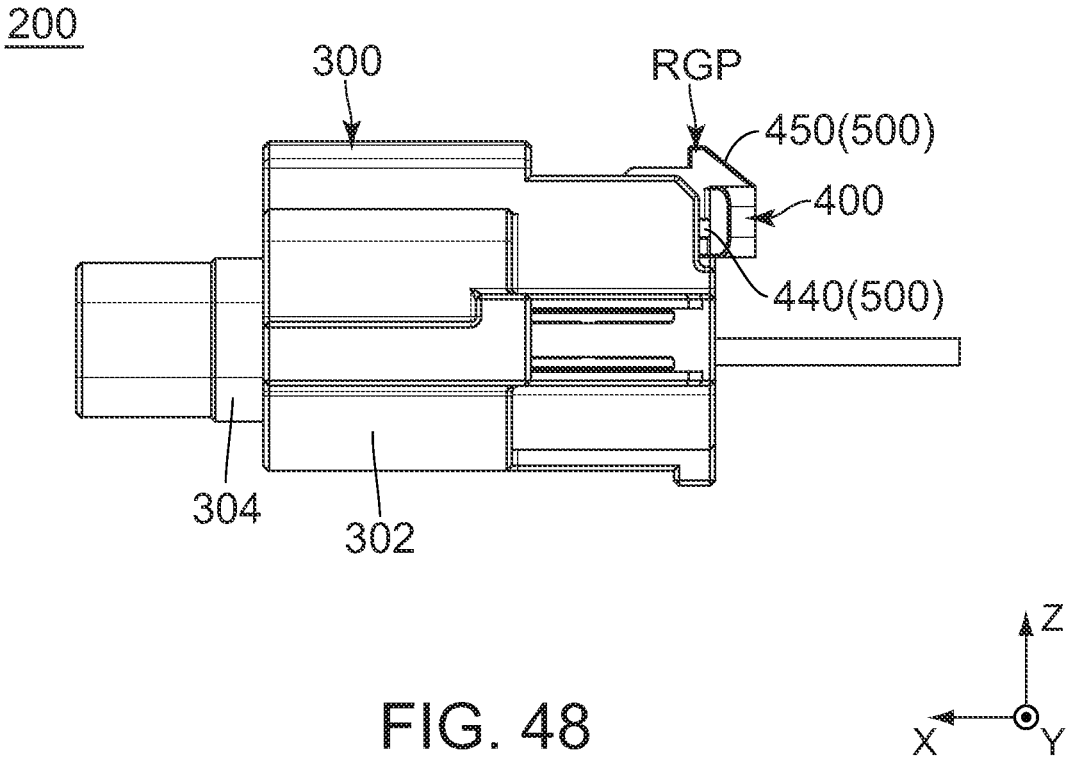
FIG. 48 is a side view showing the second connector of FIG. 47.

As shown in FIG. 43, each of the movement regulating projections 316 has an oblique surface 3162, an upper surface 3163 and a rear surface 3168.

As shown in FIG. 43, the oblique surface 3162 of the present embodiment is a plane intersecting with the front-rear direction. The oblique surface 3162 extends forward in the front-rear direction and downward in the up-down direction. The oblique surface 3162 faces forward and upward.

As shown in FIG. 43, the upper surface 3163 of the present embodiment defines an upper end of the movement regulating projection 316 in the up-down direction. The upper surface 3163 is a plane intersecting with the up-down direction. The upper surface 3163 faces upward in the up-down direction.

As shown in FIG. 43, the rear surface 3168 of the present embodiment defines a rear end of the movement regulating projection 316 in the front-rear direction. The rear surface 3168 is a plane intersecting with the front-rear direction. The rear surface 3168 faces rearward in the front-rear direction.

As shown in FIG. 6, the second lock portion 310 of the present embodiment has a fulcrum portion 318.

Figure 13:
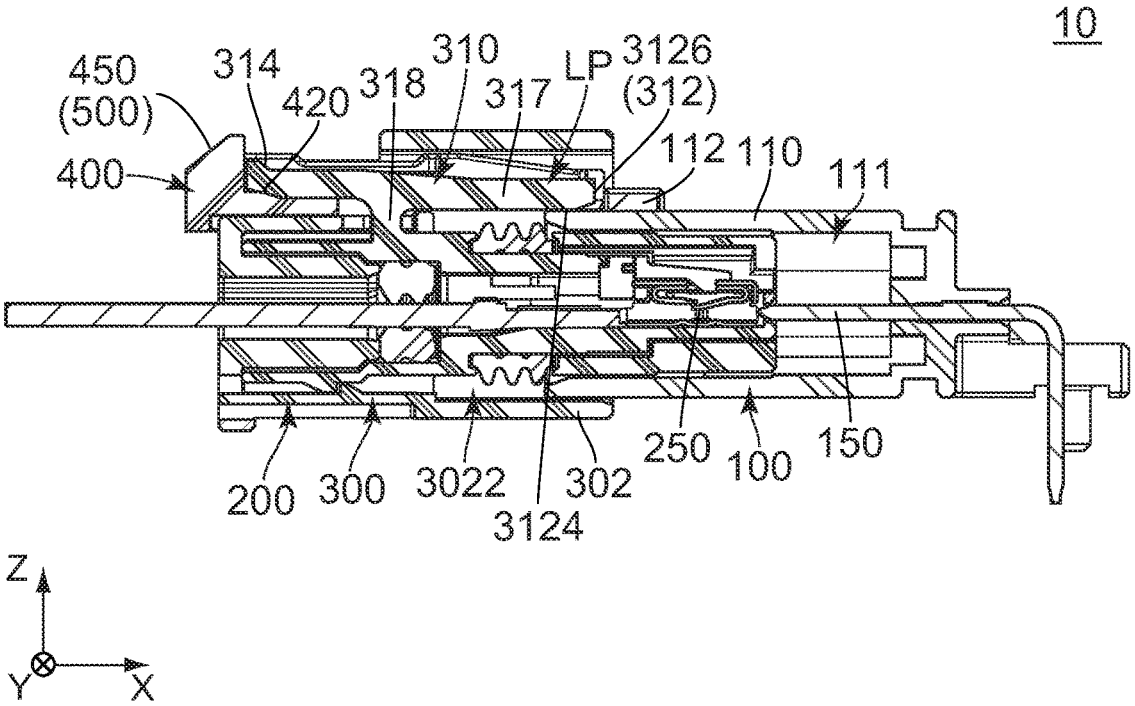
FIG. 13 is a cross-sectional view showing the connector assembly of FIG. 9, taken along line I-I.

As shown in FIG. 13, the fulcrum portion 318 is positioned around a middle of the second lock portion 310 in the front-rear direction. Referring to FIGS. 13 and 40, the second lock portion 310 is movable in a seesaw manner with the fulcrum portion 318 acting as a fulcrum. As shown in FIG. 49, the locking lug 312 is positioned forward of the fulcrum portion 318 in the front-rear direction. The release operation portion 314 is positioned rearward of the fulcrum portion 318 in the front-rear direction. Each of the movement regulating projections 316 is positioned between the fulcrum portion 318 and the locking lug 312. Each of the movement regulating projections 316 is nearer to the locking lug 312 than to the fulcrum portion 318.

Figure 14:
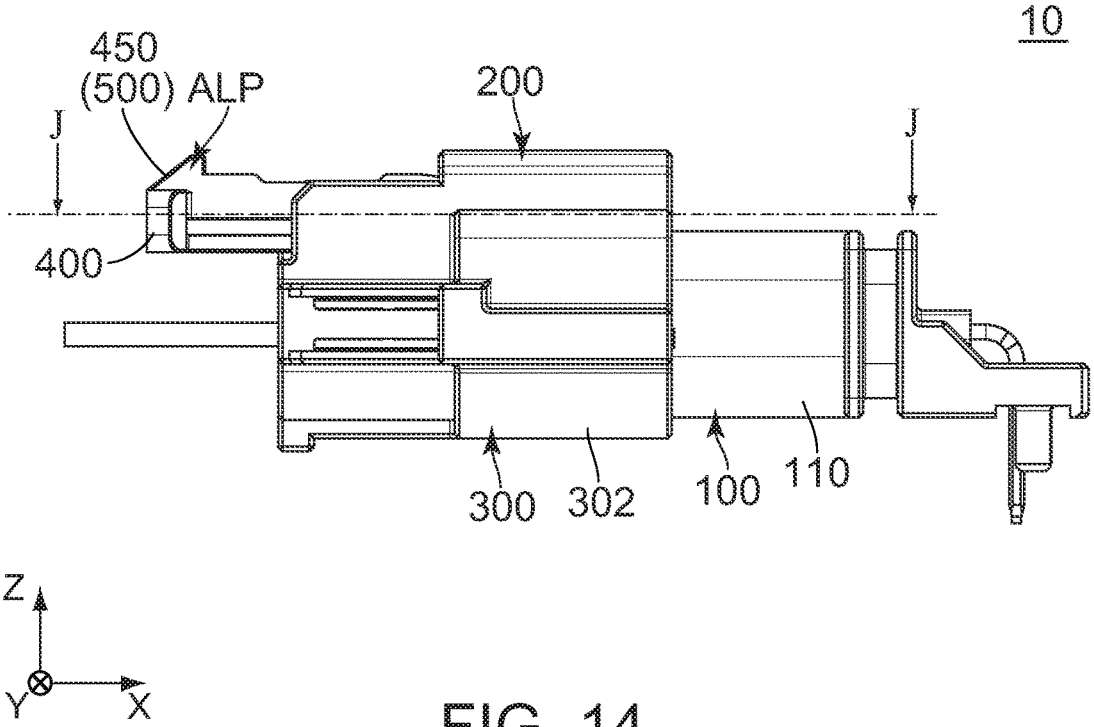
FIG. 14 is still another side view showing the connector assembly of FIG. 1. In the figure, a first lock portion of the first connector and a second lock portion of the second connector lock a mated state where a second housing is mated with a first housing, while the mating detecting member is positioned at an allowable position.

Referring to FIG. 49, the mating detecting member 400 of the present embodiment is made of resin. Referring to FIG. 2, the mating detecting member 400 is attached to the shroud cover 302. Referring to FIGS. 1 and 14, the mating detecting member 400 of the present embodiment is movable relative to the second housing 300 in the front-rear direction between a regulating position RGP and an allowable position ALP. The allowable position ALP is positioned rearward of the regulating position RGP in the front-rear direction.

Figure 50:
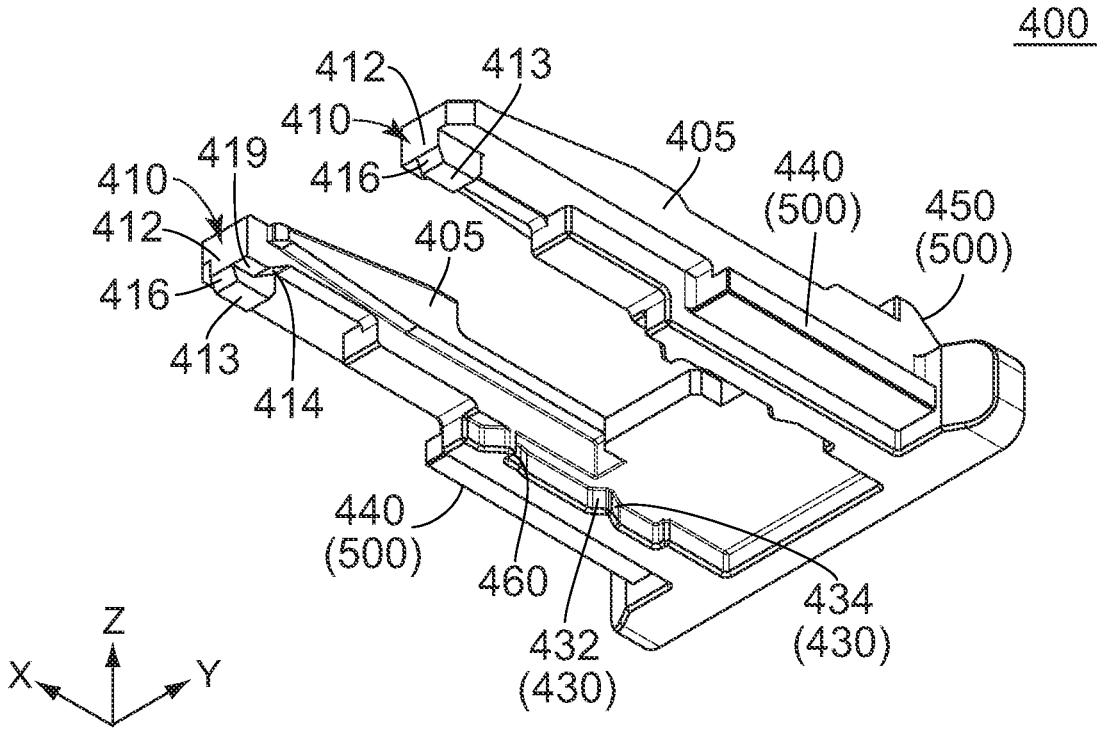
FIG. 50 is a perspective view showing the mating detecting member which is included in the second connector of FIG. 49.
Figure 51:
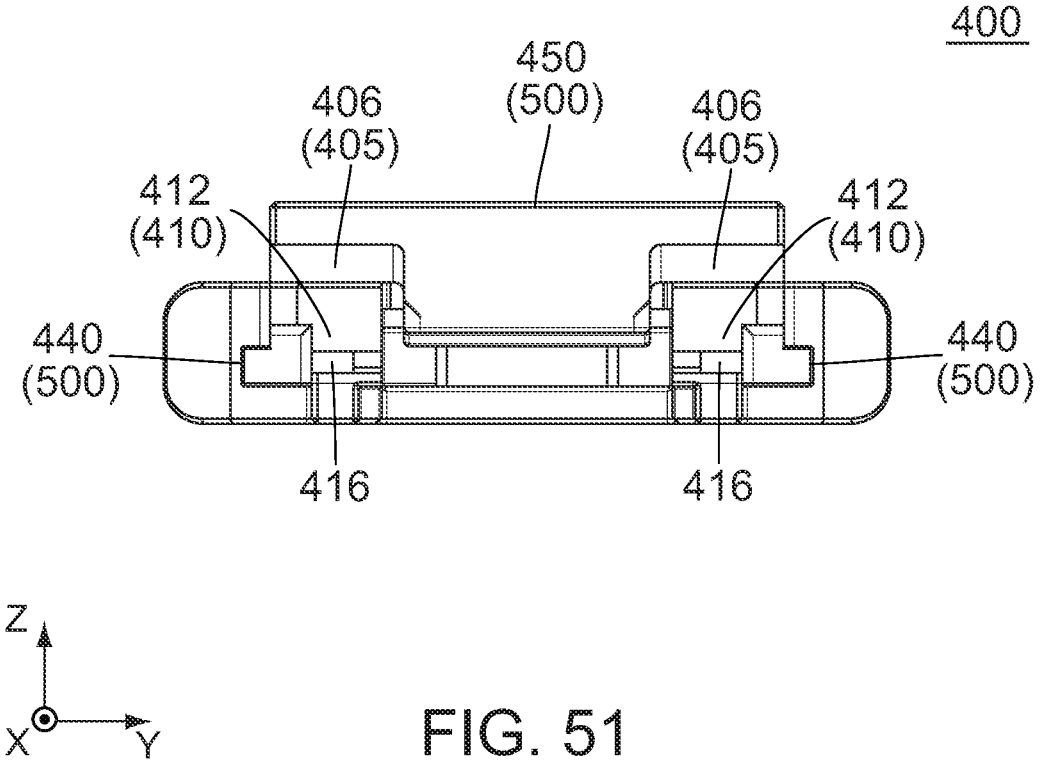
FIG. 51 is a front view showing the mating detecting member of FIG. 50.

As shown in FIG. 50, the mating detecting member 400 has two arm portions 405 and two projecting portions 410.

As shown in FIG. 49, each of the arm portions 405 of the present embodiment extends forward in the front-rear direction. Each of the arm portions 405 has an upper surface 406. The upper surface 406 faces upward in the up-down direction.

As shown in FIG. 50, the projecting portions 410 of the present embodiment correspond to the arm portions 405, respectively. Each of the projecting portions 410 is positioned at a front end of the arm portion 405 corresponding thereto. Each of the projecting portions 410 protrudes downward from the front end of the arm portion 405 corresponding thereto.

Figure 52:
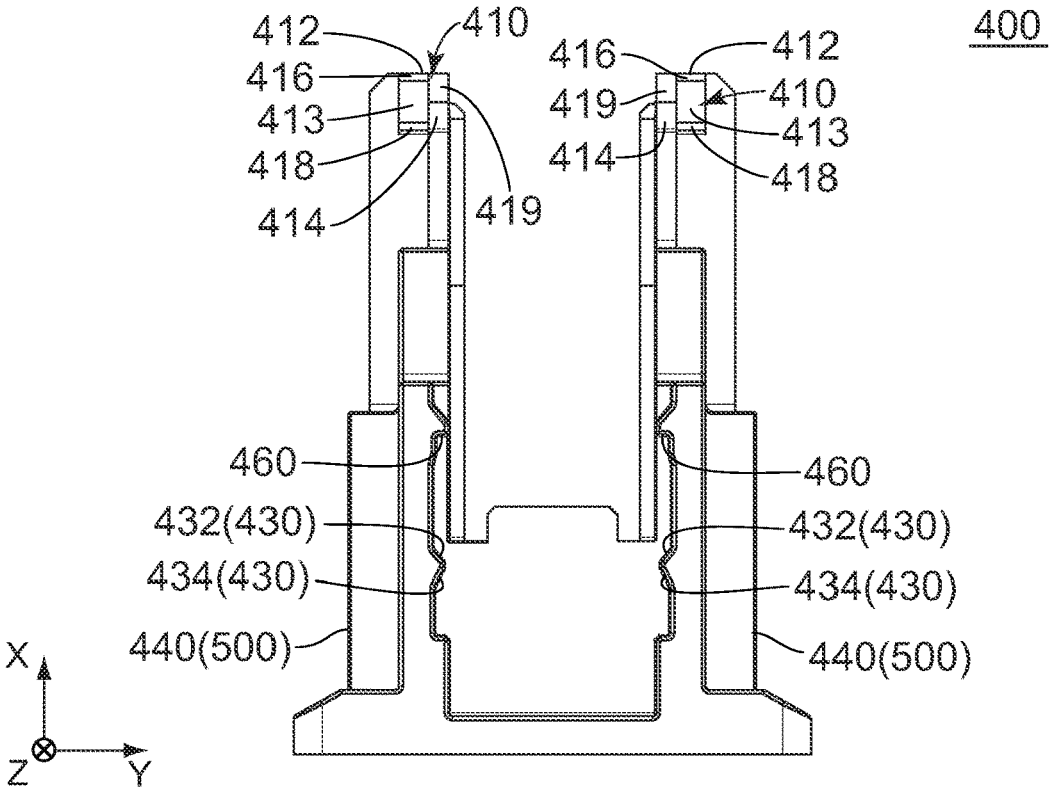
FIG. 52 is a bottom view showing the mating detecting member of FIG. 50.

As shown in FIGS. 50 and 52, each of the projecting portions 410 has an abutment portion 412, a first lower surface 413, a front slope portion 416, a rear slope portion 418 and a second lower surface 419. In other words, the mating detecting member 400 has the abutment portions 412.

As shown in FIG. 50, the abutment portion 412 of the present embodiment faces forward in the front-rear direction. The abutment portion 412 defines a front end of the projecting portion 410 in the front-rear direction. In other words, the abutment portion 412 defines a front end of the mating detecting member 400. The abutment portion 412 is a plane perpendicular to the front-rear direction.

As shown in FIG. 50, the first lower surface 413 of the present embodiment faces downward in the up-down direction. The first lower surface 413 defines a lower end of the projecting portion 410 in the up-down direction. The first lower surface 413 is a plane perpendicular to the up-down direction.

Figure 53:
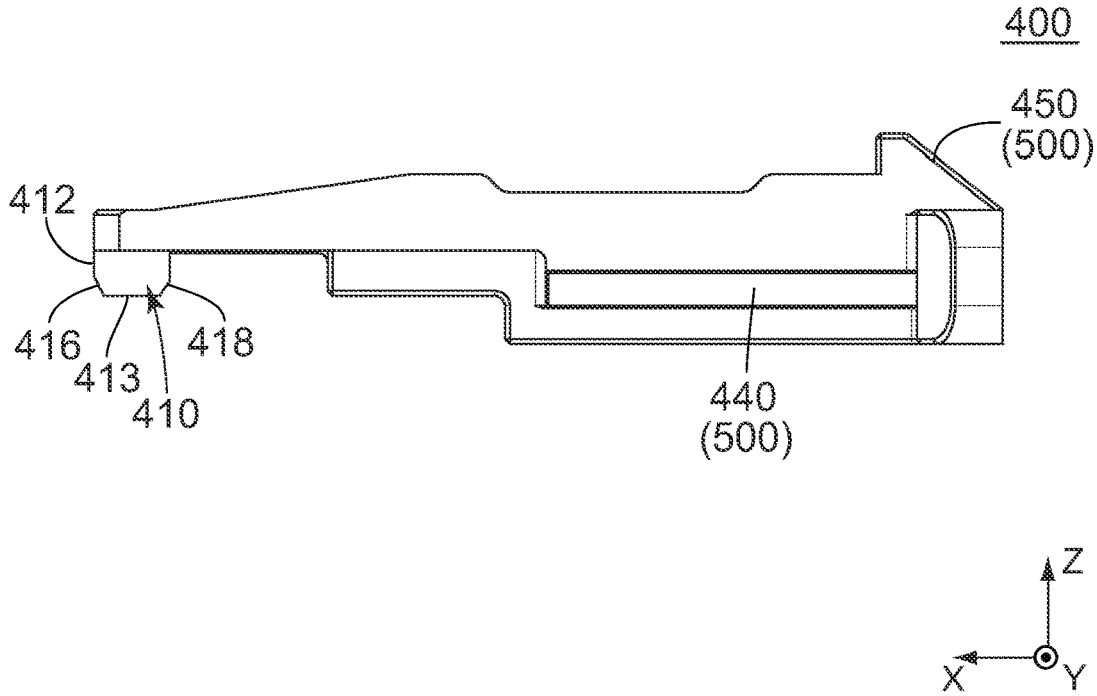
FIG. 53 is a side view showing the mating detecting member of FIG. 50.

As shown in FIG. 53, the front slope portion 416 of the present embodiment is positioned rearward of the abutment portion 412 in the front-rear direction. The front slope portion 416 is positioned below the abutment portion 412 in the up-down direction. The front slope portion 416 is positioned forward of the first lower surface 413 in the front-rear direction. The front slope portion 416 is positioned above the first lower surface 413 in the up-down direction. The front slope portion 416 faces forward and downward. The front slope portion 416 extends forward and upward.

As shown in FIG. 53, the rear slope portion 418 of the present embodiment is positioned rearward of the abutment portion 412 in the front-rear direction. The rear slope portion 418 is positioned below the abutment portion 412 in the up-down direction. The rear slope portion 418 is positioned rearward of the first lower surface 413 in the front-rear direction. The rear slope portion 418 is positioned above the first lower surface 413 in the up-down direction. The rear slope portion 418 faces rearward and downward. The rear slope portion 418 extends rearward and upward.

As shown in FIG. 52, the second lower surface 419 of the present embodiment is positioned at the front end of the mating detecting member 400. The second lower surface 419 is positioned inward of the first lower surface 413 in the right-left direction. As shown in FIG. 50, the second lower surface 419 faces downward in the up-down direction. The second lower surface 419 is a plane perpendicular to the up-down direction. The second lower surface 419 is positioned above the first lower surface 413 in the up-down direction.

As shown in FIGS. 49 and 52, the mating detecting member 400 has a regulating portion 420, click protrusions 430 and retained portions 460.

As shown in FIG. 49, the regulating portion 420 of the present embodiment is positioned around a rear end of the mating detecting member 400 in the front-rear direction. The regulating portion 420 is positioned rearward of any of the arm portions 405 in the front-rear direction. The regulating portion 420 has a substantially plate-like shape.

As shown in FIG. 6, when the mating detecting member 400 is positioned at the regulating position RGP, the regulating portion 420 is positioned below the release operation portion 314 in the up-down direction to regulate the pushing down of the release operation portion 314. Specifically, a movement of the second lock portion 310 from the lock position LP to the release position RP shown in FIG. 40 is regulated when the mating detecting member 400 is positioned at the regulating position RGP.

As shown in FIG. 40, when the mating detecting member 400 is positioned at the allowable position ALP, the regulating portion 420 is positioned rearward in the front-rear direction beyond the release operation portion 314 so that the pushing down of the release operation portion 314 is allowed. Specifically, a movement of the second lock portion 310 from the lock position LP, which is shown in FIG. 6, to the release position RP is allowed when the mating detecting member 400 is positioned at the allowable position ALP.

As shown in FIG. 52, the click protrusions 430 of the present embodiment are positioned rearward of the retained portions 460, respectively, in the front-rear direction. Each of the click protrusions 430 has a front slope portion 432 and a rear slope portion 434.

As shown in FIG. 52, the front slope portion 432 of the present embodiment faces forward in the front-rear direction and inward in the right-left direction. The front slope portion 432 extends forward in the front-rear direction and outward in the right-left direction. The front slope portion 432 of each of the click protrusions 430 is positioned rearward of the retained portion 460 corresponding thereto in the front-rear direction.

As shown in FIG. 52, the rear slope portion 434 of the present embodiment faces rearward in the front-rear direction and inward in the right-left direction. The rear slope portion 434 extends rearward in the front-rear direction and outward in the right-left direction. The rear slope portion 434 is positioned rearward of the front slope portion 432 in the front-rear direction.

Figure 19:
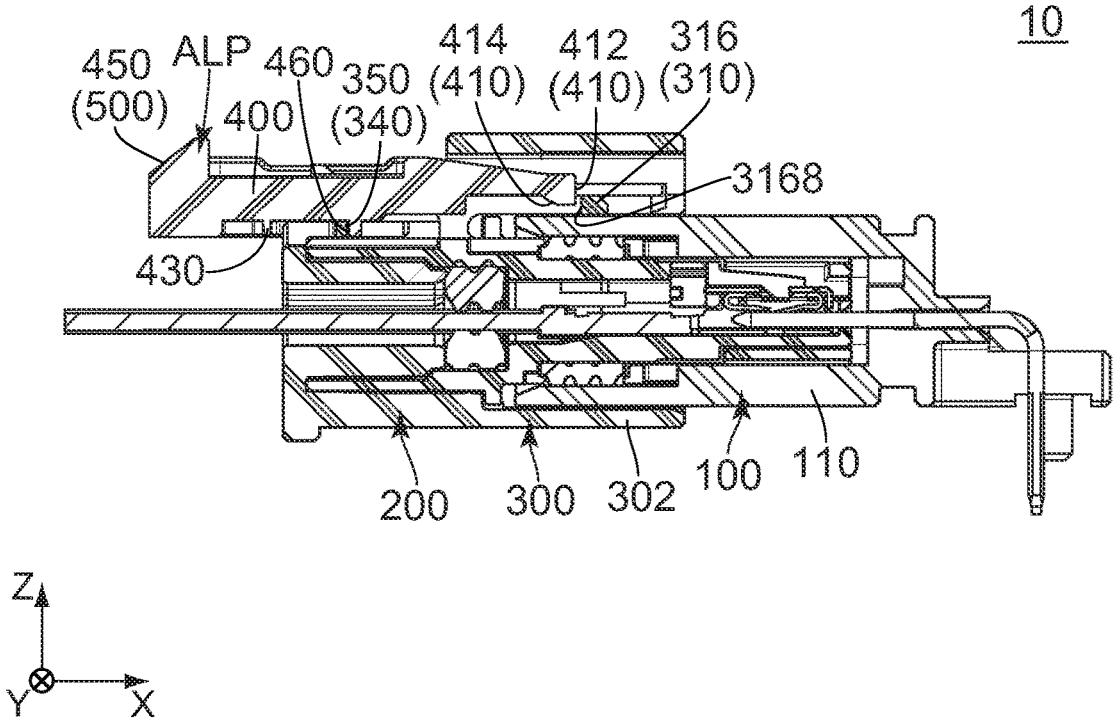
FIG. 19 is a cross-sectional view showing the connector assembly of FIG. 16, taken along line M-M.

As shown in FIG. 52, each of the retained portions 460 of the present embodiment is positioned around a middle of the mating detecting member 400 in the front-rear direction. As shown in FIG. 50, the retained portions 460 are positioned below the arm portions 405, respectively, in the up-down direction. Referring to FIGS. 49 and 50, each of the retained portions 460 is positioned below the regulating portion 420 in the up-down direction. As shown in FIG. 52, each of the retained portions 460 is positioned forward of the click protrusion 430 corresponding thereto in the front-rear direction. The retained portions 460 correspond to projecting portions 410, respectively. Each of the retained portions 460 is positioned inward of the first lower surface 413 of the projecting portion 410 corresponding thereto in the right-left direction. Each of the retained portions 460 faces rearward in the front-rear direction. Each of the retained portions 460 is a plane perpendicular to the front-rear direction, As shown in FIG. 19, the retaining portions 350 correspond to the retained portions 460, respectively, and the retaining portion 350 and the retained portion 460 corresponding thereto prevent a rearward movement of the mating detecting member 400 in the front-rear direction relative to the second housing 300 beyond the allowable position ALP.

As shown in FIG. 53, the mating detecting member 400 is provided with guided portions 440 and a shift operation portion 450.

Figure 10:
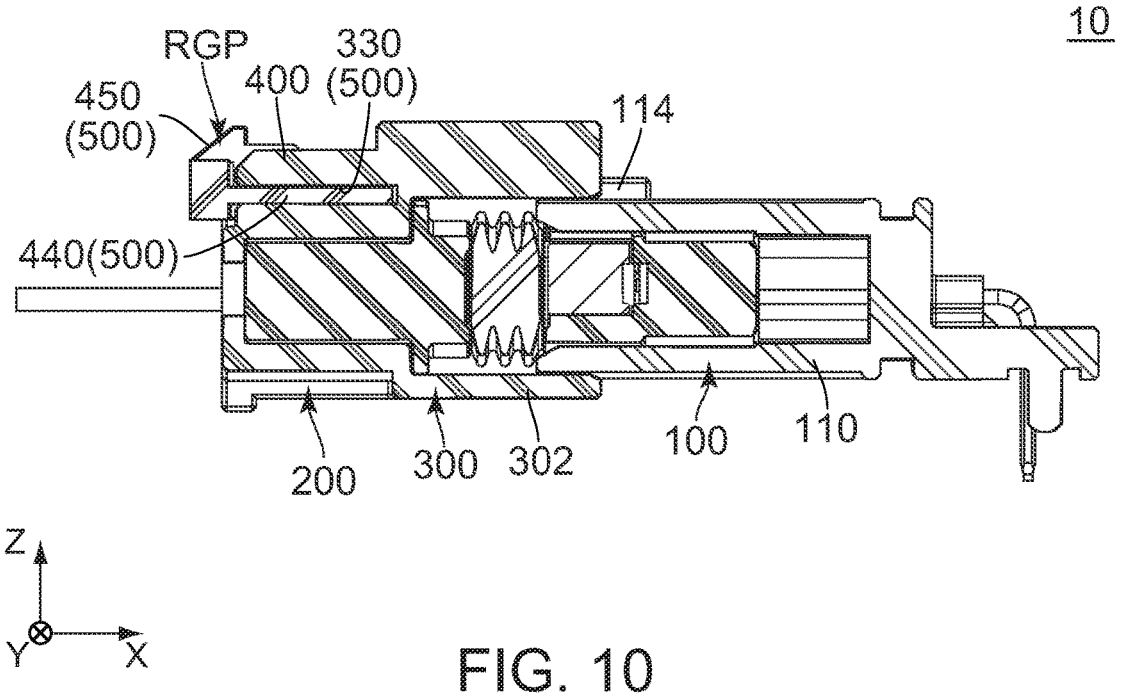
FIG. 10 is a cross-sectional view showing the connector assembly of FIG. 9, taken along line F-F.
Figure 11:
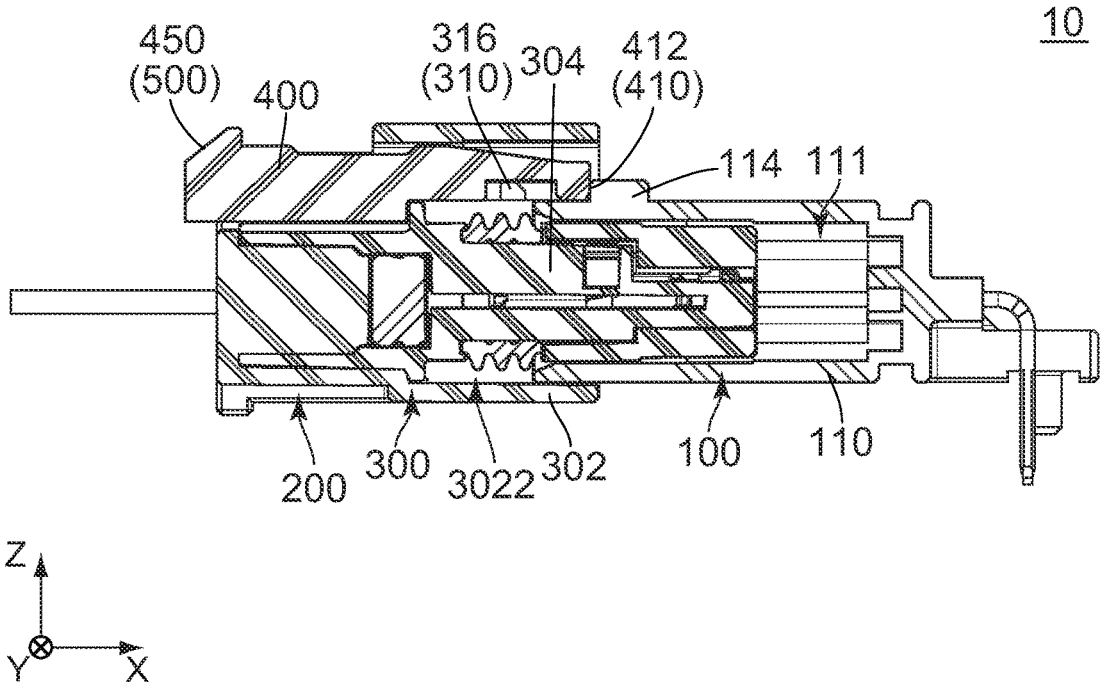
FIG. 11 is a cross-sectional view showing the connector assembly of FIG. 9, taken along line G-G.
Figure 17:
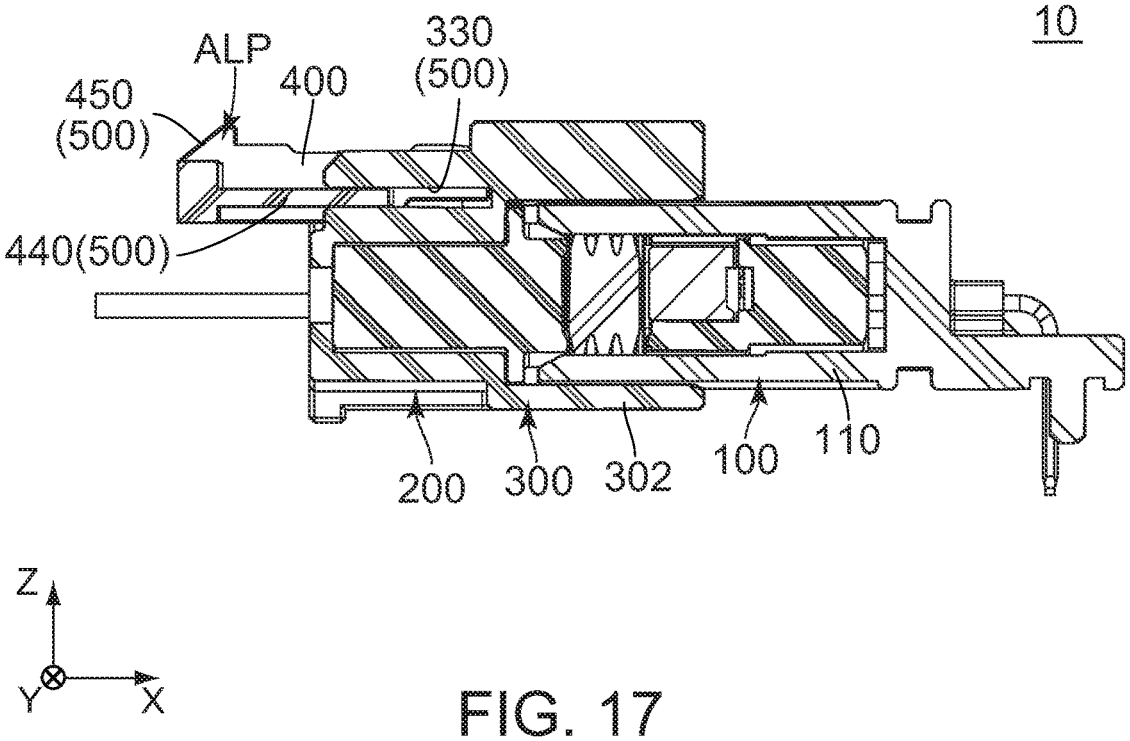
FIG. 17 is a cross-sectional view showing the connector assembly of FIG. 16, taken along line K-K.

As shown in FIG. 50, each of the guided portions 440 is an elongated protrusion extending in the front-rear direction. Referring to FIGS. 10 and 17, the guided portions 440 correspond to the guiding portions 330, respectively, and the guiding portion 330 and the guided portion 440 corresponding thereto guide a movement of the mating detecting member 400 between the regulating position RGP and the allowable position ALP. The guided portion 440 and the guiding portion 330 corresponding thereto have sizes in the up-down direction which are large enough for the guided portion 440 to be smoothly guided by the guiding portion 330 corresponding thereto.

Referring to FIG. 10, when the mating detecting member 400 is positioned at the regulating position RGP, almost the whole of the guided portion 440 is accommodated in the guiding portion 330 corresponding thereto. In other words, when the mating detecting member 400 is positioned at the regulating position RGP, the guiding portion 330 and the guided portion 440 corresponding thereto have overlapping parts each extending long in the front-rear direction. Referring to FIG. 17, when the mating detecting member 400 is positioned at the allowable position ALP, a greater part of the guided portion 440 is not accommodated in the guiding portion 330 corresponding thereto and is positioned rearward beyond the guiding portion 330 corresponding thereto to be exposed to the outside of the second connector 200. In other words, when the mating detecting member 400 is positioned at the allowable position ALP, the guiding portion 330 and the guided portion 440 corresponding thereto have overlapping parts each extending short in the front-rear direction.

As described above, the second connector 200 of the present embodiment is configured so that each of the guiding portions 330 is the guide rail extending in the front-rear direction while each of the guided portions 440 is the elongated protrusion extending in the front-rear direction. However, the present invention is not limited thereto. Specifically, the second connector 200 should be configured so that one of the guiding portion 330 and the guided portion 440 is an elongated protrusion extending in the front-rear direction while a remaining one of the guiding portion 330 and the guided portion 440 is a guide rail which extends in the front-rear direction and guides the elongated protrusion.

As shown in FIG. 53, the shift operation portion 450 is positioned at the rear end of the mating detecting member 400 in the front-rear direction. When the shift operation portion 450 is operated in the up-down direction, each of the abutment portions 412 is moved in the up-down direction perpendicular to the front-rear direction. However, the present invention is not limited thereto. The second connector 200 may be configured so that the abutment portion 412 is moved in a direction intersecting with the front-rear direction when the shift operation portion 450 is operated in the perpendicular direction perpendicular to the front-rear direction.

As described above, the guiding portion 330 and the guided portion 440 corresponding thereto have the overlapping parts each extending long in the front-rear direction when the mating detecting member 400 is positioned at the regulating position RGP. Accordingly, when the mating detecting member 400 is positioned at the regulating position RGP, a rear end of the guided portion 440 is almost immovable in the up-down direction relative to the guiding portion 330 corresponding thereto, and thereby the operation of the shift operation portion 450 in the up-down direction perpendicular to the front-rear direction is regulated. However, the present invention is not limited thereto. Specifically, the second connector 200 may be configured so that the operation of the shift operation portion 450 in the perpendicular direction perpendicular to the front-rear direction is regulated when the mating detecting member 400 is positioned at the regulating position RGP.

As described above, when the mating detecting member 400 is positioned at the allowable position ALP, the guiding portion 330 and the guided portion 440 corresponding thereto have the overlapping parts each extending short in the front-rear direction. Accordingly, when the mating detecting member 400 is positioned at the allowable position ALP, the rear end of the guided portion 440 is movable, to a great extent, in the up-down direction relative to the guiding portion 330 corresponding thereto, and thereby the shift operation portion 450 is operable in the up-down direction perpendicular to the front-rear direction. However, the present invention is not limited thereto. Specifically, the second connector 200 may be configured so that the shift operation portion 450 is operable in the perpendicular direction when the mating detecting member 400 is positioned at the allowable position ALP. Specifically, provided that the abutment portion 412 is movable in the direction intersecting with the front-rear direction, the shift operation portion 450 may be operable, for example, in the right-left direction when the mating detecting member 400 is positioned at the allowable position ALP.

As described above, the second connector 200 is configured so that the guided portion 440 and the guiding portion 330 corresponding thereto have the sizes in the up-down direction which are large enough for the guided portion 440 to be smoothly guided by the guiding portion 330 corresponding thereto. By this configuration, when the mating detecting member 400 is positioned at the regulating position RGP, the pushing down of the shift operation portion 450 only gives a slight shake to the shift operation portion 450 and hardly moves the shift operation portion 450. Also, by this configuration, when the mating detecting member 400 is positioned at the allowable position ALP, the shift operation portion 450 is movable over a large distance upon the pushing down of the shift operation portion 450.

Figure 18:
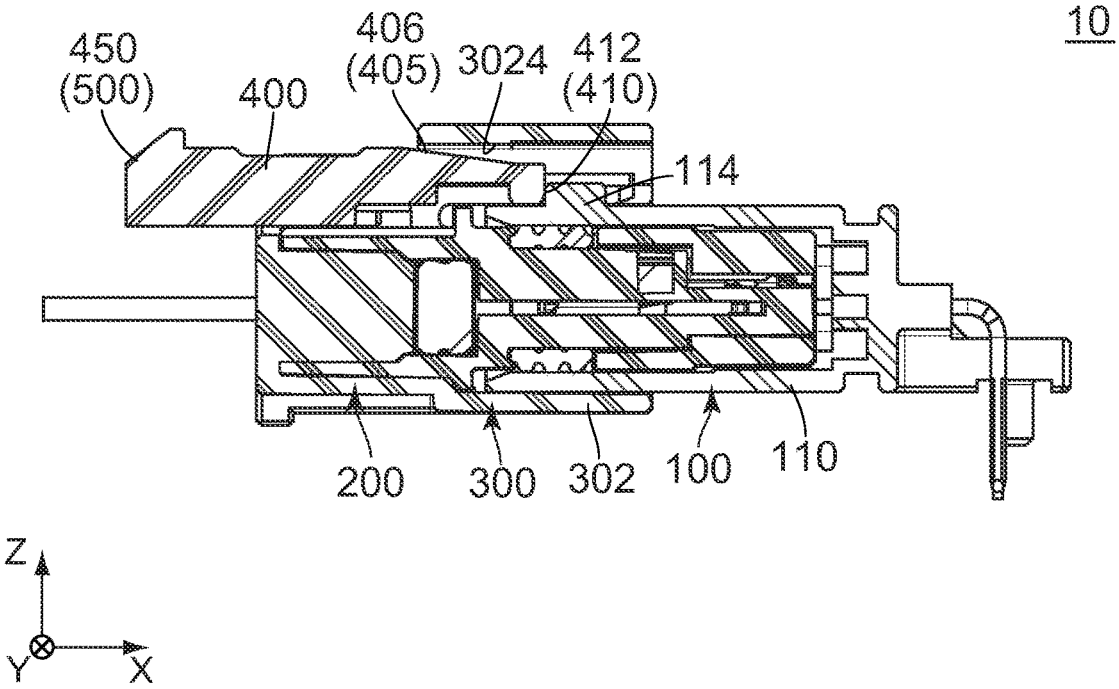
FIG. 18 is a cross-sectional view showing the connector assembly of FIG. 16, taken along line L-L.
Figure 25:
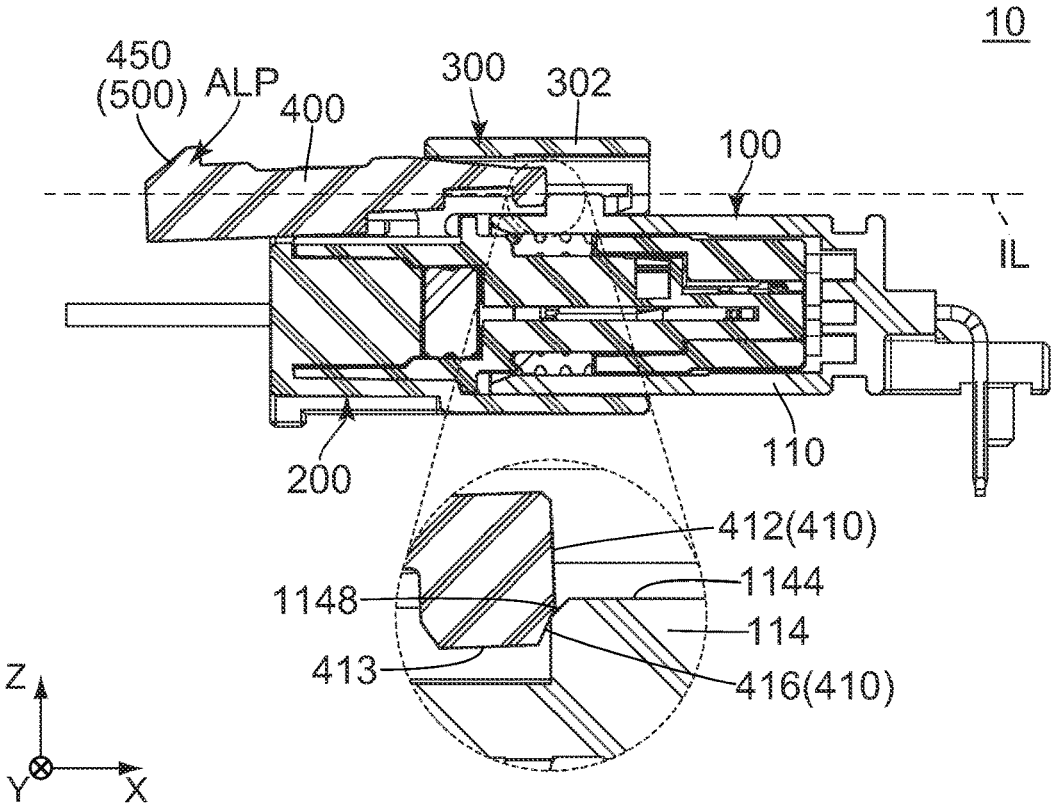
FIG. 25 is a cross-sectional view showing the connector assembly of FIG. 23, taken along line Q-Q. In the figure, a part of the connector assembly is illustrated enlarged.
Figure 26:
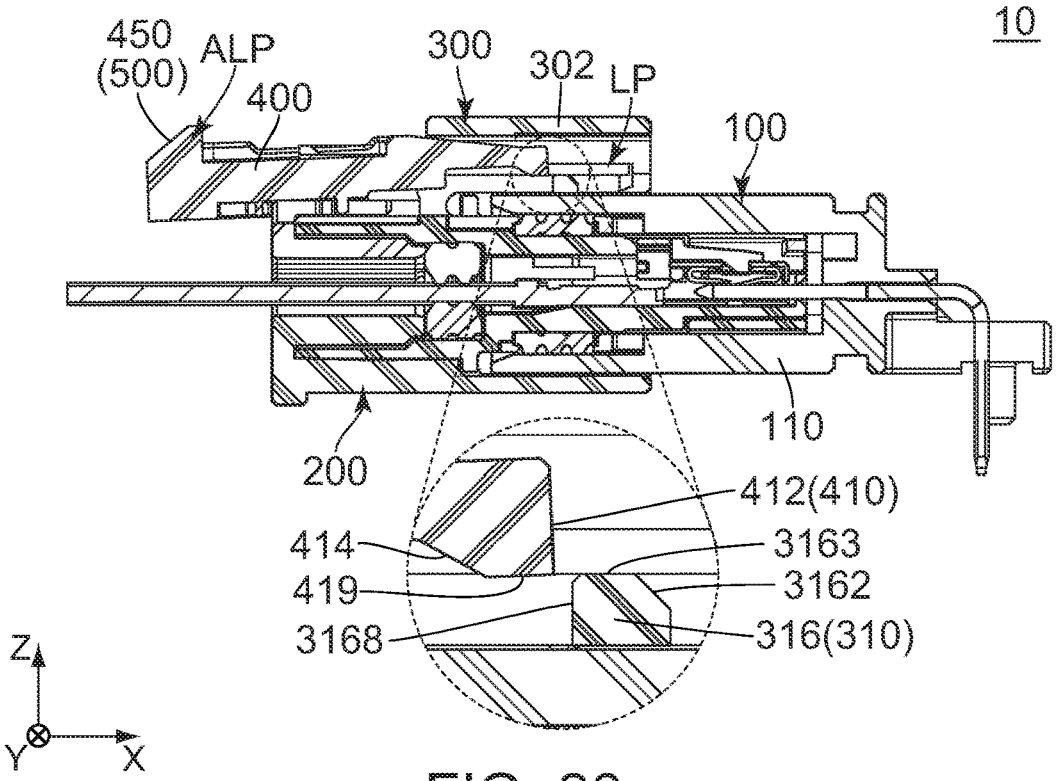
FIG. 26 is a cross-sectional view showing the connector assembly of FIG. 23, taken along line R-R. In the figure, a part of the connector assembly is illustrated enlarged.
Figure 27:
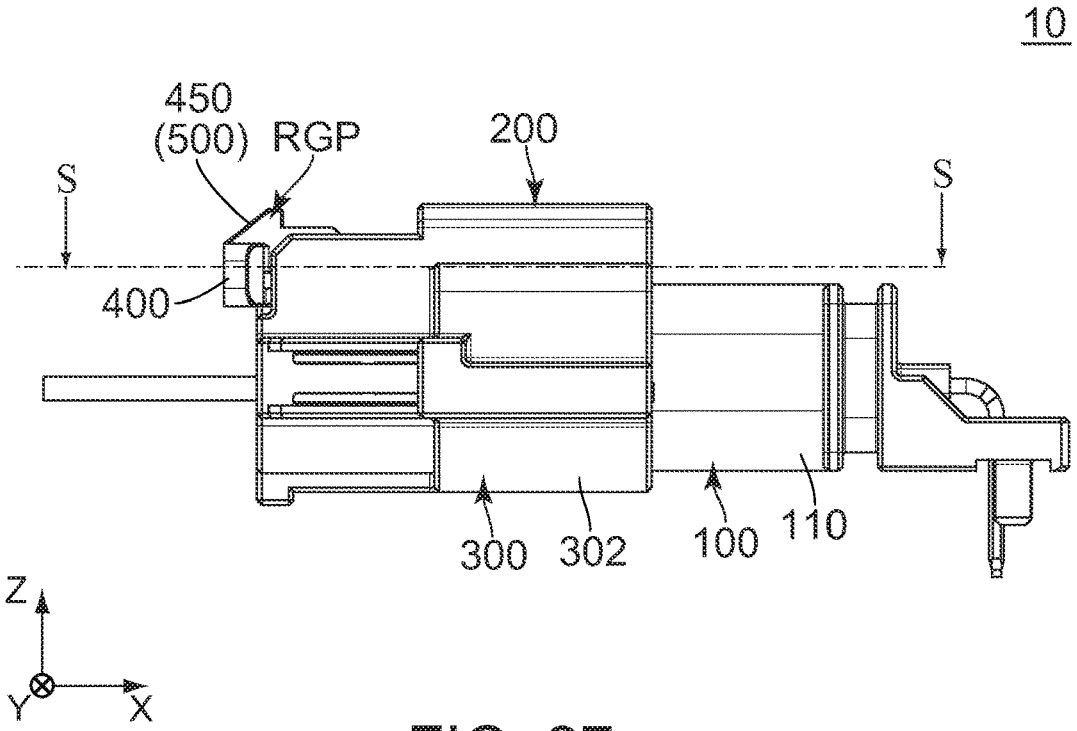
FIG. 27 is yet still another side view showing the connector assembly of FIG. 1. In the figure, the first lock portion of the first connector and the second lock portion of the second connector lock the mated state of the second housing with the first housing while the mating detecting member is positioned at the regulating position.
Figure 28:
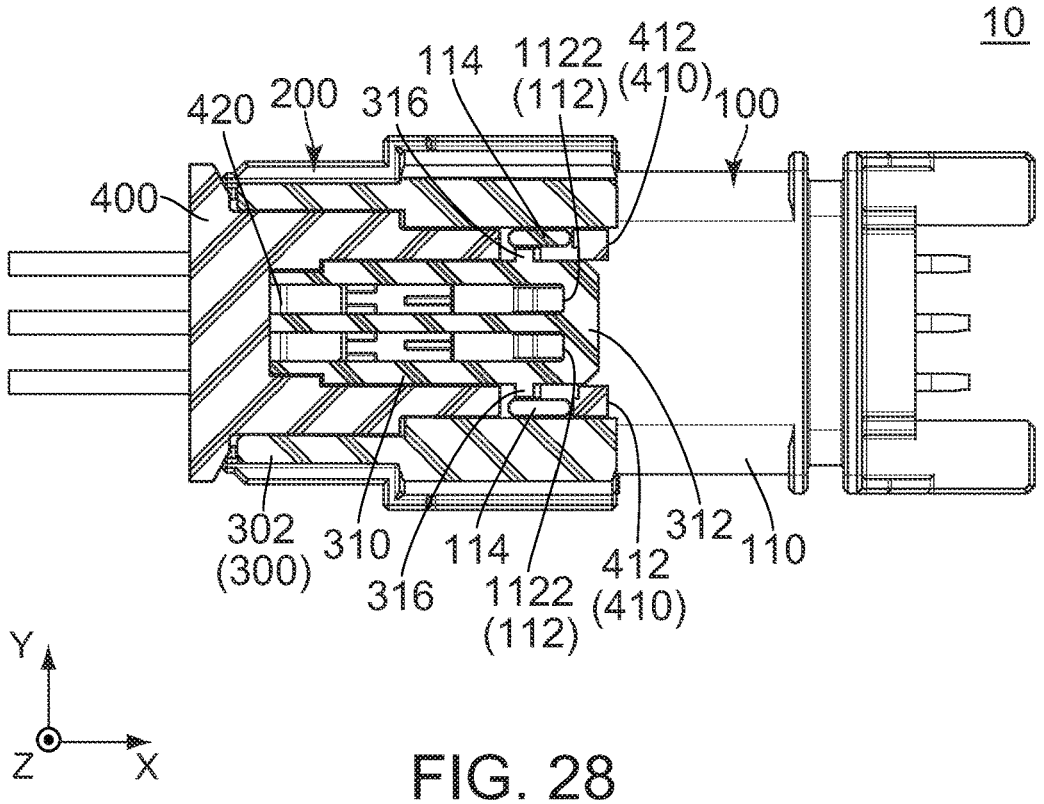
FIG. 28 is a cross-sectional view showing the connector assembly of FIG. 27, taken along line S-S.
Figure 29:
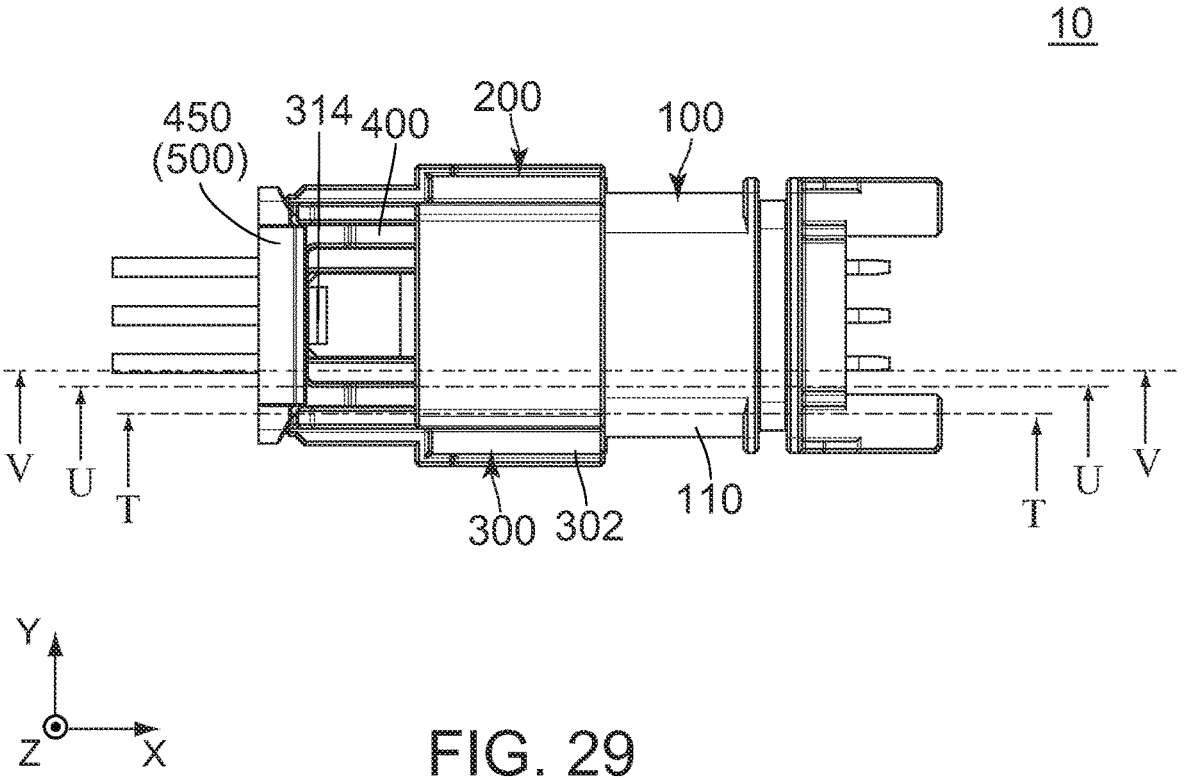
FIG. 29 is a top view showing the connector assembly of FIG. 27.
Figure 30:
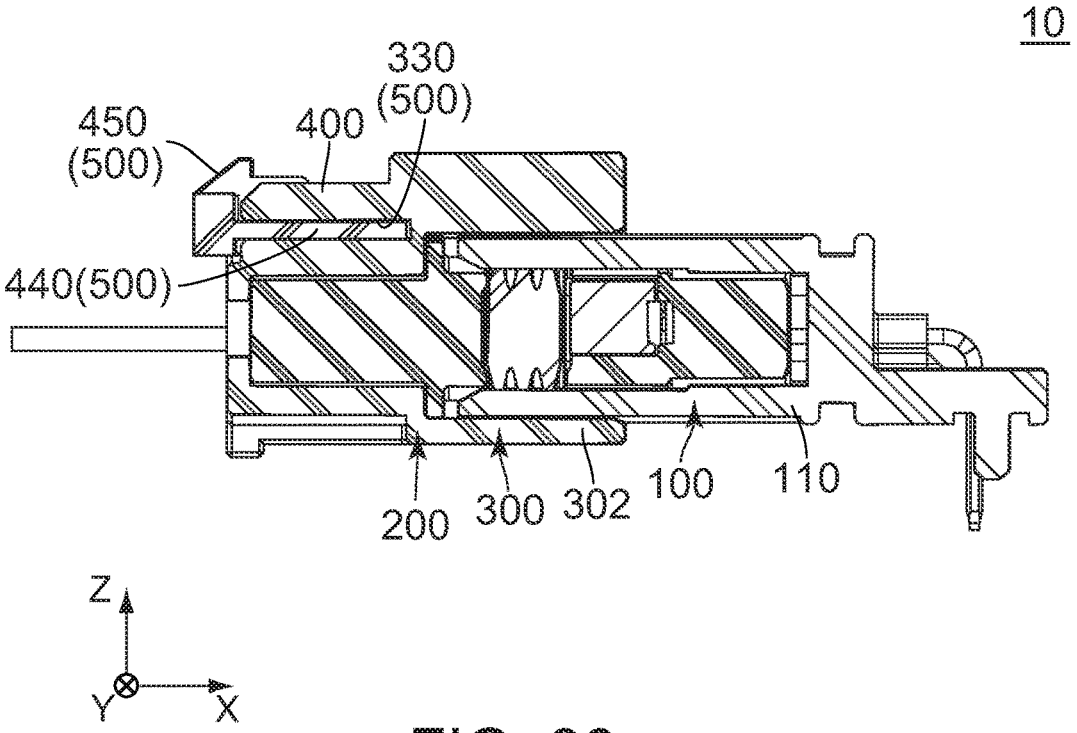
FIG. 30 is a cross-sectional view showing the connector assembly of FIG. 29, taken along line T-T.
Figure 31:
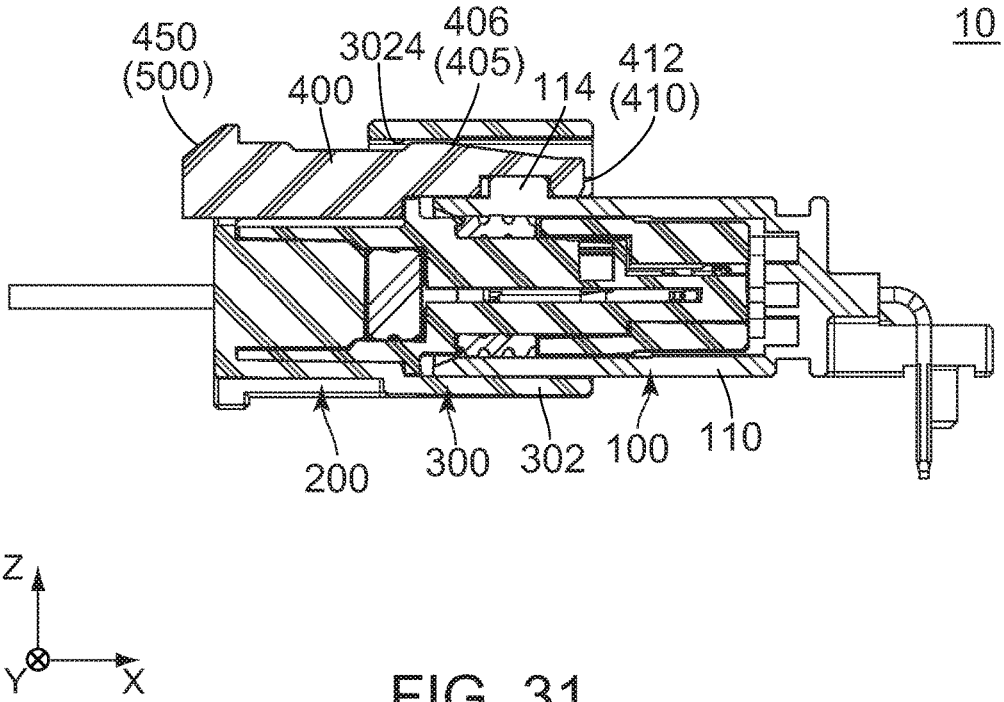
FIG. 31 is a cross-sectional view showing the connector assembly of FIG. 29, taken along line U-U.

Referring to FIG. 10, the shift mechanism 500 consists of the guiding portions 330, the guided portions 440 and the shift operation portion 450. In other words, the guiding portions 330, the guided portions 440 and the shift operation portion 450 form the shift mechanism 500. Referring to FIGS. 18, 25 and 26, each of the abutment portions 412 is movable in the direction intersecting with the front-rear direction by an operation of the shift mechanism 500. More specifically, each of the abutment portions 412 is moved upward by the shift operation portion 450 of the shift mechanism 500 being pushed down.

As shown in FIG. 52, the mating detecting member 400 is formed with oblique surfaces 414. The oblique surfaces 414 correspond to the projecting portions 410, the guided portions 440, and the click protrusions 430, respectively.

Figure 12:
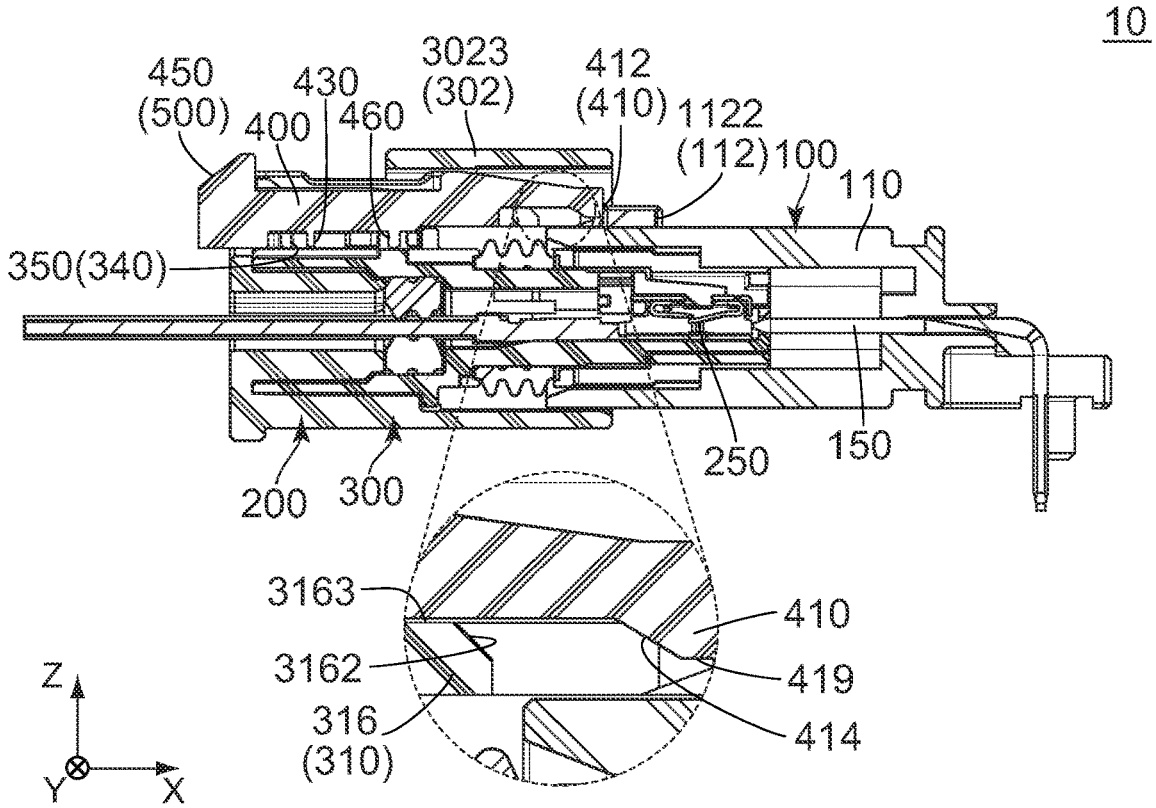
FIG. 12 is a cross-sectional view showing the connector assembly of FIG. 9, taken along line H-H. In the figure, a part of the connector assembly is illustrated enlarged.

As shown in FIG. 52, each of the oblique surfaces 414 of the present embodiment is positioned rearward of the abutment portion 412 of the projecting portion 410 corresponding thereto in the front-rear direction. Each of the oblique surfaces 414 is positioned inward of the guided portion 440 corresponding thereto in the right-left direction. Each of the oblique surfaces 414 is positioned inward of the first lower surface 413 of the projecting portion 410 corresponding thereto in the right-left direction. Each of the oblique surfaces 414 is positioned at a position same as a position of the click protrusion 430 corresponding thereto in the right-left direction. Each of the oblique surfaces 414 is positioned rearward of the second lower surface 419 of the projecting portion 410 corresponding thereto in the front-rear direction. As shown in FIG. 12, each of the oblique surfaces 414 faces rearward and downward. Each of the oblique surfaces 414 extends rearward and upward. Each of the oblique surfaces 414 is a plane oblique to the front-rear direction.

Referring to FIG. 6, each of the second terminals 250 of the present embodiment is made of metal and is a so-called socket contact. The second terminals 250 are held by the socket housing 304. Referring to FIG. 20, the second terminals 250 are connected with the first terminals 150, respectively, when the first connector 100 and the second connector 200 are mated with each other.

[Mating Operation]

A further description will be made below about a usual operation of mating the first connector 100 with the second connector 200 and behaviors of components of the connector assembly 10 upon the usual mating operation.

First, referring to FIG. 2, the second connector 200, whose mating detecting member 400 is positioned at the regulating position RGP, is arranged rearward of the first connector 100 in the front-rear direction. Meanwhile, the abutment portions 412 of the second connector 200 are positioned rearward of the stoppers 114, respectively, of the first connector 100 in the front-rear direction, and each of the abutment portions 412 faces the stopper 114 corresponding thereto in the front-rear direction. In other words, when the second housing 300 starts to be mated with the first housing 110, the abutment portion 412 is positioned on an imaginary line IL which extends in the front-rear direction and passes through the stopper 114 corresponding thereto.

Next, the second housing 300 is moved forward relative to the first housing 110 so as to approach the first housing 110 in the front-rear direction in this state. Then, the first housing accommodating portion 3022 of the second connector 200 accommodates a part of the first housing 110 of the first connector 100 while the socket housing accommodating portion 111 of the first housing 110 of the first connector 100 accommodates a part of the socket housing 304 of the second connector 200. Specifically, the connector assembly 10 changes its state into a mating start state shown in each of FIGS. 7 to 13.

Under the mating start state, none of the second terminals 250 of the second connector 200 are connected with the first terminals 150 of the first connector 100. Under the mating start state, each of the abutment portions 412 is positioned rearward of the stopper 114 corresponding thereto in the front-rear direction and is brought into abutment with the stopper 114 corresponding thereto in the front-rear direction. Under the mating start state, the click protrusions 430 of the mating detecting member 400 are positioned forward in the front-rear direction beyond the retaining portions 350, respectively, of the shroud cover 302. Under the mating start state, the front end 3126 of the locking lug 312 of the second lock portion 310 is not in contact with any of the first lock portions 112 in the front-rear direction. In other words, the front end 3126 of the locking lug 312 of the second lock portion 310 is spaced rearwardly away from any of the first lock portions 112 in the front-rear direction under the mating start state. Specifically, the second lock portion 310 is positioned away from any of the first lock portions 112 in the front-rear direction when the mating detecting member 400 is positioned at the regulating position RGP while the abutment portion 412 abuts against the stopper 114 corresponding thereto.

Under the mating start state, the second housing 300 is moved forward relative to the first housing 110 so as to further approach the first housing 110. Then, the mating detecting member 400 is moved rearward of the second housing 300 in the front-rear direction while the front end 3126 of the locking lug 312 of the second lock portion 310 of the second connector 200 is brought into contact with the oblique surfaces 1126 (see FIG. 56) of the first lock portions 112 of the first connector 100 in the front-rear direction. Meanwhile, the regulating portion 420 of the mating detecting member 400 is positioned below the release operation portion 314 of the second lock portion 310, and thereby the pushing down of the release operation portion 314 is still regulated.

In this state, the second housing 300 is moved forward relative to the first housing 110 so as to still further approach the first housing 110. Then, the mating detecting member 400 is moved further rearward relative to the second housing 300 in the front-rear direction, and the front end 3126 of the locking lug 312 is lifted upward so that the resilient supporting portion 317 of the second lock portion 310 is resiliently deformed. Meanwhile, the oblique surfaces 414 of the projecting portions 410 of the mating detecting member 400 abut against the oblique surfaces 3162 of the movement regulating projections 316, respectively, of the second lock portion 310 in the front-rear direction so that each of the projecting portions 410 is lifted upward.

The second housing 300 is moved forward relative to the first housing 110 so as to yet further approach the first housing 110 under the aforementioned state where the resilient supporting portion 317 of the second lock portion 310 is resiliently deformed. Then, the lower surface 3124 of the locking lug 312 rides over the upper surfaces 1124 (see FIG. 56) of the first lock portions 112, and the second lower surface 419 of each of the projecting portions 410 of the mating detecting member 400 rides over the upper surface 3163 of the movement regulating projection 316 corresponding thereto of the second lock portion 310. In this state, the second housing 300 is moved forward relative to the first housing 110 so as to yet still further approach the first housing 110. Then, the locking lug 312 rides over the first lock portions 112 to be moved forward beyond the first lock portions 112, and each of the projecting portions 410 of the mating detecting member 400 rides over the movement regulating projection 316 corresponding thereto of the second lock portion 310 to be moved rearward beyond the movement regulating projection 316 corresponding thereto. Accordingly, the connector assembly 10 changes its state into a mating completion state shown in each of FIGS. 14 to 20, and the mating detecting member 400 reaches the allowable position ALP. Specifically, the mating detecting member 400 is positioned at the allowable position ALP when the mating of the second housing 300 with the first housing 110 is completed. In other words, the mating detecting member 400 is positioned at the allowable position ALP when the mating of the second connector 200 with the first connector 100 is completed.

The above operations and behaviors are summarized as follow: when the second housing 300 is mated with the first housing 110 under a state where the mating detecting member 400 is positioned at the regulating position RGP, the abutment portion 412 abuts against the stopper 114, and the mating detecting member 400 is moved from the regulating position RGP toward the allowable position ALP; and, when the mating detecting member 400 is moved from the regulating position RGP to the allowable position ALP, the oblique surface 414 abuts against the movement regulating projection 316, and the abutment portion 412 is moved upward in the up-down direction, and then the abutment portion 412 rides over the movement regulating projection 316 to be moved rearward in the front-rear direction beyond the movement regulating projection 316.

The second lock portion 310 is positioned at the lock position LP under the aforementioned mating completion state. Under the mating completion state, each of the click protrusions 430 of the mating detecting member 400 is positioned rearward in the front-rear direction beyond the retaining portion 350 corresponding thereto of the shroud cover 302. Under the mating completion state, the second lock surfaces 3122 of the locking lug 312 are positioned forward of the first lock surfaces 1122 of the first lock portions 112, respectively, in the front-rear direction, and each of the second lock surfaces 3122 faces the first lock surface 1122 corresponding thereto in the front-rear direction. In other words, under the mating completion state, the first lock portions 112 and the second lock portion 310 lock the mated state where the second housing 300 is mated with the first housing 110.

Under the mating completion state, the abutment portion 412 of each of the projecting portions 410 of the mating detecting member 400 is positioned rearward of the rear surface 3168 of the movement regulating projection 316 corresponding thereto in the front-rear direction and faces the rear surface 3168 thereof in the front-rear direction. Under the mating completion state, each of the retaining portions 350 is positioned rearward in the front-rear direction beyond the retained portion 460 corresponding thereto. Under the mating completion state, the second terminals 250 of the second connector 200 are connected with the first terminals 150, respectively, of the first connector 100. As described above, the mating detecting member 400 is positioned at the allowable position ALP under the mating completion state. Thus, under the mating completion state, the regulating portion 420 is positioned rearward in the front-rear direction beyond the release operation portion 314 so that the pushing down of the release operation portion 314 is allowed. Under the mating completion state, each of the abutment portions 412 is still positioned rearward of the stopper 114 corresponding thereto in the front-rear direction and still abuts against the stopper 114 corresponding thereto in the front-rear direction.

As described above, the connector assembly 10 in the mating completion state is configured as follows: the mating detecting member 400 is positioned at the allowable position ALP; the second lock portion 310 is positioned at the lock position LP; and the abutment portion 412 of each of the projecting portions 410 of the mating detecting member 400 is positioned rearward in the front-rear direction beyond the rear surface 3168 of the movement regulating projection 316 corresponding thereto and faces the rear surface 3168 thereof in the front-rear direction. Thus, even if the mating detecting member 400 is intended to be moved forward relative to the second housing 300 under the mating completion state, each of the abutment portions 412 abuts against the rear surface 3168 of the movement regulating projection 316 corresponding thereto from behind, and thereby the mating detecting member 400 is prevented from being moved forward relative to the second housing 300. In other words, when the mating detecting member 400 is positioned at the allowable position ALP while the second lock portion 310 is positioned at the lock position LP, the movement regulating projection 316 is positioned forward in the front-rear direction beyond the abutment portion 412 corresponding thereto to regulate a movement of the mating detecting member 400 to the regulating position RGP.

In a first process where the connector assembly 10 changes its state from the mating start state to the mating completion state, the rear slope portion 434 (see FIG. 52) of the click protrusion 430 of the mating detecting member 400 is brought into contact with the retaining portion 350 corresponding thereto of the shroud cover 302. Upon the contact of the rear slope portion 434 with the retaining portion 350, the resilient portion 360 (see FIG. 54) is resiliently deformed inward in the right-left direction, and thereby the protrusion 340 is moved inward in the right-left direction. Thus, the click protrusion 430 can be moved rearward beyond the retaining portion 350 corresponding thereto in the first process.

When the shift operation portion 450 of the mating detecting member 400 is pushed down under the aforementioned mating completion state, the abutment portion 412 is moved upward in the up-down direction to be positioned above the movement regulating projection 316 corresponding thereto, and thereby the connector assembly 10 changes its state into a regulation release state shown in each of FIGS. 21 to 26. Specifically, when the shift mechanism 500 is operated under a state where the mating detecting member 400 is positioned at the allowable position ALP, the abutment portion 412 is moved to a position which is deviated from the imaginary line IL.

Under the regulation release state, the abutment portion 412 is positioned above the rear surface 3168 of the movement regulating projection 316 corresponding thereto in the up-down direction and does not face the rear surface 3168 thereof in the front-rear direction. Accordingly, the abutment portion 412 does not abut against the movement regulating projection 316 corresponding thereto when the mating detecting member 400 is moved forward relative to the second housing 300 under the regulation release state. In other words, the movement regulating projections 316 do not prevent a forward movement of the mating detecting member 400 relative to the second housing 300 under the regulation release state. Specifically, the regulation of the mating detecting member 400 by the movement regulating projections 316 is released when the abutment portions 412 are moved by the operation of the shift mechanism 500 under a state where the mating of the second housing 300 with the first housing 110 is completed while the second lock portion 310 is positioned at the lock position LP. Additionally, both of the abutment portion 412 and the front slope portion 416 of each of the projecting portions 410 are brought into contact with a rear slope portion 1148 of the stopper 114 corresponding thereto in the front-rear direction under the regulation release state.

Under the regulation release state, forward force is applied to the mating detecting member 400. Then, the second lower surface 419 of the projecting portion 410 passes above the upper surface 3163 of the movement regulating projection 316 corresponding thereto while the first lower surface 413 of the projecting portion 410 rides over the upper surface 1144 of the stopper 114 corresponding thereto.

When the forward force is further applied to the mating detecting member 400 in this state, the oblique surface 414 of the projecting portion 410 is moved forward beyond the oblique surface 3162 of the movement regulating projection 316 corresponding thereto while the projecting portion 410 rides over the stopper 114 corresponding thereto to be moved forward beyond the stopper 114 corresponding thereto. Accordingly, the connector assembly 10 changes its state into a mating detecting state shown in each of FIGS. 27 to 32, and the mating detecting member 400 reaches the regulating position RGP. In other words, the mating detecting member 400 is moved from the allowable position ALP to the regulating position RGP when the mating detecting member 400 is pushed forward in the front-rear direction under a state where the abutment portion 412 is deviated from the imaginary line IL.

Under the mating detecting state, each of the click protrusions 430 of the mating detecting member 400 is positioned forward in the front-rear direction beyond the retaining portion 350 corresponding thereto of the shroud cover 302. Under the mating detecting state, each of the abutment portions 412 is positioned forward in the front-rear direction beyond the stopper 114 corresponding thereto and does not face the stopper 114 corresponding thereto in the front-rear direction. Under the mating detecting state, the regulating portion 420 is positioned below the release operation portion 314 of the second lock portion 310 to regulate the pushing down of the release operation portion 314.

In a second process where the connector assembly 10 changes its state from the mating completion state to the mating detecting state, the front slope portion 432 (see FIG. 52) of the click protrusion 430 of the mating detecting member 400 is brought into contact with the slope portion 355 (see FIG. 54) of the shroud cover 302 to provide a clicking sensation to an operator of the mating detecting member 400. Accordingly, in the second process, the clicking sensation enables the operator of the mating detecting member 400 to clearly perceive that the mating detecting member 400 is being moved from the allowable position ALP to the regulating position RGP. Behaviors of the resilient portion 360 (see FIG. 54) and the protrusion 340 upon the contact of the front slope portion 432 of the click protrusion 430 with the slope portion 355 of the shroud cover 302 in the second process are similar to the behaviors of the resilient portion 360 and the protrusion 340 upon the contact of the rear slope portion 434 of the click protrusion 430 with the retaining portion 350 in the first process as described above. Specifically, when the front slope portion 432 of the click protrusion 430 is brought into contact with the slope portion 355 of the shroud cover 302 in the second process, the resilient portion 360 is resiliently deformed inward in the right-left direction, and thereby the protrusion 340 is moved inward in the right-left direction. Thus, the click protrusion 430 can be moved forward beyond the retaining portion 350 corresponding thereto in the second process.

In the second process, a part of the upper surface 406 of the arm portion 405 of the mating detecting member 400 abuts against the preventing portion 3024 of the shroud cover 302 from below in the up-down direction. Thus, the arm portion 405 is prevented from being excessively moved upward in the second process.

The description is made above about the usual mating operation of the first connector 100 with the second connector 200, which is arranged rearward of the first connector 100 and whose mating detecting member 400 is positioned at the regulating position RGP, and the behaviors of the components of the connector assembly 10 upon the usual mating operation. Alternatively, the connector assembly 10 might be operated in an unusual manner where the second connector 200 begins to be mated with the first connector 100 after the second connector 200, whose mating detecting member 400 is not returned to the regulating position RGP and is still positioned at the allowable position ALP, is arranged rearward of the first connector 100. The unusual mating operation and behaviors of the components of the connector assembly 10 upon the unusual mating operation are similar to the usual mating operation and their behaviors upon the usual mating operation except that the mating detecting member 400 is not moved relative to the second housing 300 in a process where the connector assembly 10 changes its state from a mating start state to a mating completion state. However, in the aforementioned unusual mating operation where the second connector 200, whose mating detecting member 400 is positioned at the allowable position ALP, is mated with the first connector 100, there might occur a special situation that the mating detecting member 400 is erroneously moved relative to the second housing 300 from the allowable position ALP toward the regulating position RGP in a state before the connector assembly 10 reaches the mating completion state, namely, in a mating incompletion state where the mating of the second housing 300 with the first housing 110 is not completed. A further description will be made later about behaviors of the components of the connector assembly 10 in the special situation.

In a case where the mating detecting member 400, which is positioned at the regulating position RGP, and the second housing 300 are intended to be simultaneously pushed forward into the first housing 110 under the mating start state, each of the abutment portions 412 of the mating detecting member 400 is in abutment against the stopper 114 corresponding thereto of the first housing 110 from behind as described above. Accordingly, in this case, the mating of the second housing 300 with the first housing 110 is not completed, and thereby the connector assembly 10 never changes its state into the mating completion state. In other words, the connector assembly 10 of the present embodiment is prevented from changing its state into the mating completion state while the mating detecting member 400 maintains its location at the regulating position RGP.

[Behaviors of the Components of the Connector Assembly in the Special Situation]

As described above, in the usual mating operation, the second housing 300 begins to be mated with the first housing 110 after the second connector 200, whose mating detecting member 400 is positioned at the regulating position RGP, is arranged rearward of the first connector 100. Accordingly, in the usual mating operation, the connector assembly 10 takes a usual state where the mating detecting member 400 is positioned at the regulating position RGP under the mating incompletion state where the mating of the second connector 200 with the first connector 100 is not completed. Alternatively, the unusual mating operation, which is dissimilar to the usual mating operation, might be done as described above. In such an unusual mating operation where the second housing 300 starts to be mated with the first housing 110 after the second connector 200, whose mating detecting member 400 is not returned to the regulating position RGP and is still positioned at the allowable position ALP, is arranged rearward of the first connector 100, the connector assembly 10 takes an unusual state where the mating detecting member 400 is still positioned at the allowable position ALP even under the mating incompletion state where the mating of the second connector 200 with the first connector 100 is not completed. A further description will be made below about behaviors of the components of the connector assembly 10 in the special situation where the mating detecting member 400 is moved from the allowable position ALP toward the regulating position RGP in the unusual state which is different from the usual state.

First, in the unusual state, the mating detecting member 400 is moved forward while the shift operation portion 450 is pushed down. Then, the connector assembly 10 changes its state into a movement regulating state shown in each of FIGS. 41 to 44. Under the movement regulating state, each of the movement regulating projections 316 is positioned forward in the front-rear direction beyond the abutment portion 412 corresponding thereto while the rear surface 3168 of each of the movement regulating projections 316 is in contact with the abutment portion 412 corresponding thereto in the front-rear direction. Under the movement regulating state, the mating detecting member 400 is still positioned at the allowable position ALP while the second lock portion 310 is positioned at the release position RP. Specifically, a movement of the mating detecting member 400 from the allowable position ALP to the regulating position RGP is regulated under the movement regulating state.

In other words, when the mating detecting member 400 is positioned at the allowable position ALP even while the second lock portion 310 is positioned at the release position RP, each of the movement regulating projections 316 is positioned forward in the front-rear direction beyond the abutment portion 412 corresponding thereto to regulate the movement of the mating detecting member 400 to the regulating position RGP.

Next, the mating detecting member 400 is further moved forward under the movement regulating state. Then, the movement regulating projections 316 are pushed forward by the mating detecting member 400, and thereby the second lock portion 310 is moved forward relative to the first connector 100 together with the mating detecting member 400.

After that, the mating detecting member 400 is still further moved forward. Then, the second lock surface 3122 reaches a position same as a position of the first lock surface 1122 corresponding thereto in the front-rear direction. At this time, the resilient supporting portion 317 restores its original shape, and thereby the locking lug 312 of the second lock portion 310 is moved downward. Specifically, the second lock portion 310 is moved to the lock position LP (see FIG. 20) at this time. Accordingly, each of the second lock surfaces 3122 of the locking lug 312 is positioned forward in the front-rear direction beyond the first lock surface 1122 of the first lock portion 112 corresponding thereto and faces the first lock surface 1122 thereof in the front-rear direction. In other words, the mating of the second housing 300 with the first housing 110 is completed.

The above operations and behaviors are summarized as follow: when the mating detecting member 400 is moved forward in the front-rear direction under the mating incompletion state where the mating of the second housing 300 with the first housing 110 is not completed, the movement regulating projections 316 are pushed by the mating detecting member 400 until the mating of the second housing 300 with the first housing 110 is completed.

After the completion of the mating of the second housing 300 with the first housing 110, the connector assembly 10 can change its state into the mating detecting state by an operation similar to the usual mating operation as described above. Specifically, the operation as follows: after the completion of the mating of the second housing 300 with the first housing 110, the mating detecting member 400 is moved forward while the shift operation portion 450 is pushed down. By the operation, the mating detecting member 400 can reach the regulating position RGP, and thereby the connector assembly 10 can change its state into the mating detecting state.

Since the connector assembly 10 of the present embodiment is configured as described above, the connector assembly 10 of the present embodiment has an advantage as follows: even if the mating detecting member 400 is erroneously moved from the allowable position ALP toward the regulating position RGP under the mating incompletion state where the mating of the second housing 300 with the first housing 110 is not completed, the mating of the second housing 300 with the first housing 110 is always completed before the mating detecting member 400 reaches the regulating position RGP.

[Release Operation to Release the Mating]

A further description will be made below about an operation of releasing the mating of the first connector 100 with the second connector 200.

First, rearward force is applied to the mating detecting member 400 under the aforementioned mating detecting state. Then, the connector assembly 10 changes its state into a release start state shown in each of FIGS. 33 to 38. Under the release start state, the rear slope portion 418 of the projecting portion 410 is in contact with a front slope portion 1146 of the stopper 114 corresponding thereto in the front-rear direction. Under the release start state, the oblique surface 414 of the projecting portion 410 is still positioned forward beyond the oblique surface 3162 of the movement regulating projection 316 corresponding thereto.

Next, the rearward force is further applied to the mating detecting member 400 under the release start state. Then, the abutment portion 412 rides over the stopper 114 corresponding thereto to be moved rearward beyond the stopper 114 corresponding thereto, while the abutment portion 412 of the projecting portion 410 passes above the movement regulating projection 316 corresponding thereto to be moved rearward beyond the movement regulating projection 316 corresponding thereto. Thus, the mating detecting member 400 reaches the allowable position ALP. In other words, the connector assembly 10 changes its state into the mating completion state shown in each of FIGS. 14 to 20.

In a third process where the connector assembly 10 changes its state from the release start state to the mating completion state, a part of the upper surface 406 of the arm portion 405 of the mating detecting member 400 abuts against the preventing portion 3024 of the shroud cover 302 from below in the up-down direction. Thus, the arm portion 405 is prevented from being excessively moved upward in the third process.

Under the mating completion state, the second connector 200 is moved rearward relative to the first connector 100 while the second lock portion 310 is moved to the release position RP (see FIG. 40) by the pushing down of the release operation portion 314 of the second lock portion 310. Then, the mating of the first connector 100 with the second connector 200 is released Although the specific explanation about the present invention is made above referring to the embodiments, the present invention is not limited thereto and is susceptible to various modifications and alternative forms.

The connector assembly 10 of the present embodiment is configured so that, when the mating detecting member 400 is positioned at the regulating position RGP, the movement of the second lock portion 310 from the lock position LP to the release position RP is regulated by the regulating portion 420 being positioned below the release operation portion 314 in the up-down direction to regulate the pushing down of the release operation portion 314. However, the present invention is not limited thereto. Specifically, the connector assembly 10 may be modified so that, when the mating detecting member 400 is positioned at the regulating position RGP, the movement of the second lock portion 310 from the lock position LP to the release position RP is regulated by the regulating portion 420 being positioned above the locking lug 312 to regulate the upward movement of the locking lug 312.

The second connector 200 of the present embodiment is configured so that the position of the locking lug 312 upon the second lock portion 310 being at the lock position LP is positioned below the position of the locking lug 312 upon the second lock portion 310 being at the release position RP. However, the present invention is not limited thereto. Specifically, the second connector 200 may be modified so that the position of the locking lug 312 upon the second lock portion 310 being at the lock position LP is positioned above the position of the locking lug 312 upon the second lock portion 310 being at the release position RP.

Although the connector assembly 10 of the present embodiment changes its state into the regulation release state by each of the abutment portions 412 being moved upward to be positioned above the movement regulating projections 316 corresponding thereto, the present invention is not limited thereto. Specifically, a movement direction of the abutment portion 412 is not limited, provided that the regulation of the mating detecting member 400 by the movement regulating projections 316 is released by the movement of the abutment portion 412 in the movement direction intersecting with the front-rear direction.

Although the second connector 200 of the present embodiment is configured so that the click protrusions 430 and the retained portions 460 are provided on the mating detecting member 400 while the retaining portions 350 are provided on the shroud cover 302, the present invention is not limited thereto. Specifically, the reverse configuration is also possible. In other words, the second connector 200 may be modified so that the click protrusion 430 and the retained portion 460 are provided on the shroud cover 302 while the retaining portion 350 is provided on the mating detecting member 400.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, wherein:

the first connector comprises a first housing;

the first housing is provided with a first lock portion and a stopper;

the second connector comprises a second housing, a mating detecting member and a shift mechanism;

the second housing is mateable with the first housing along a front-rear direction;

the first housing is positioned forward of the second housing in the front-rear direction;

the second housing is provided with a second lock portion;

the second lock portion is positionable at any of a lock position and a release position;

when the second lock portion is positioned at the lock position, the first lock portion and the second lock portion lock a mated state where the second housing is mated with the first housing;

the mating detecting member is movable relative to the second housing in the front-rear direction between a regulating position and an allowable position;

the allowable position is positioned rearward of the regulating position in the front-rear direction;

a movement of the second lock portion from the lock position to the release position is regulated when the mating detecting member is positioned at the regulating position;

the movement of the second lock portion from the lock position to the release position is allowed when the mating detecting member is positioned at the allowable position;

the mating detecting member has an abutment portion;

the abutment portion is movable in a direction intersecting with the front-rear direction by an operation of the shift mechanism;

when the second housing starts to be mated with the first housing, the abutment portion is positioned on an imaginary line which extends in the front-rear direction and passes through the stopper;

when the second housing is mated with the first housing under a state where the mating detecting member is positioned at the regulating position, the abutment portion abuts against the stopper, and the mating detecting member is moved from the regulating position toward the allowable position;

the mating detecting member is positioned at the allowable position when a mating of the second housing with the first housing is completed;

when the shift mechanism is operated under a state where the mating detecting member is positioned at the allowable position, the abutment portion is moved to a position which is deviated from the imaginary line; and the mating detecting member is moved from the allowable position to the regulating position when the mating detecting member is pushed forward in the front-rear direction under a state where the abutment portion is deviated from the imaginary line.

2. The connector assembly as recited in claim 1, wherein:

the second lock portion has a locking lug and a release operation portion;

the second lock portion is positioned at the lock position when in its initial state;

when the release operation portion is pushed down, the locking lug is moved upward in an up-down direction perpendicular to the front-rear direction so that the second lock portion is moved to the release position;

the mating detecting member has a regulating portion;

when the mating detecting member is positioned at the regulating position, the regulating portion is positioned below the release operation portion in the up-down direction to regulate a pushing down of the release operation portion; and when the mating detecting member is positioned at the allowable position, the regulating portion is positioned rearward in the front-rear direction beyond the release operation portion so that the pushing down of the release operation portion is allowed.

3. The connector assembly as recited in claim 1, wherein:

the second housing is provided with a guiding portion;

the mating detecting member is provided with a guided portion and a shift operation portion;

one of the guiding portion and the guided portion is an elongated protrusion extending in the front-rear direction;

a remaining one of the guiding portion and the guided portion is a guide rail which extends in the front-rear direction and guides the elongated protrusion;

the guiding portion and the guided portion guide a movement of the mating detecting member between the regulating position and the allowable position;

an operation of the shift operation portion in a perpendicular direction perpendicular to the front-rear direction is regulated when the mating detecting member is positioned at the regulating position;

the shift operation portion is operable in the perpendicular direction when the mating detecting member is positioned at the allowable position;

the guiding portion, the guided portion and the shift operation portion form the shift mechanism; and the abutment portion is moved in a direction intersecting with the front-rear direction when the shift operation portion is operated in the perpendicular direction.

4. The connector assembly as recited in claim 3, wherein a movement direction of the second lock portion is the perpendicular direction.

5. The connector assembly as recited in claim 1, wherein:

the second housing has a retaining portion;

the mating detecting member has a retained portion; and the retaining portion and the retained portion prevent a rearward movement of the mating detecting member in the front-rear direction relative to the second housing beyond the allowable position.

6. The connector assembly as recited in claim 1, wherein the second lock portion is positioned away from the first lock portion in the front-rear direction when the mating detecting member is positioned at the regulating position while the abutment portion abuts against the stopper.

7. The connector assembly as recited in claim 2, wherein:

the second lock portion is provided with a movement regulating projection;

when the mating detecting member is positioned at the allowable position while the second lock portion is positioned at the lock position, the movement regulating projection is positioned forward in the front-rear direction beyond the abutment portion to regulate a movement of the mating detecting member to the regulating position;

when the mating detecting member is positioned at the allowable position while the second lock portion is positioned at the release position, the movement regulating projection is positioned forward in the front-rear direction beyond the abutment portion to regulate the movement of the mating detecting member to the regulating position;

when the mating detecting member is moved forward in the front-rear direction under a state where the mating of the second housing with the first housing is not completed, the movement regulating projection is pushed by the mating detecting member until the mating of the second housing with the first housing is completed; and regulation by the movement regulating projection is released when the abutment portion is moved by the operation of the shift mechanism under a state where the mating of the second housing with the first housing is completed while the second lock portion is positioned at the lock position.

8. The connector assembly as recited in claim 7, wherein:

the mating detecting member is formed with an oblique surface;

the oblique surface is positioned rearward of the abutment portion in the front-rear direction; and when the mating detecting member is moved from the regulating position to the allowable position, the oblique surface abuts against the movement regulating projection, and the abutment portion is moved upward in the up-down direction, and then the abutment portion rides over the movement regulating projection to be moved rearward in the front-rear direction beyond the movement regulating projection.

9. The connector assembly as recited in claim 7, wherein:

the second lock portion has a fulcrum portion;

the second lock portion is movable in a seesaw manner with the fulcrum portion acting as a fulcrum;

the locking lug is positioned forward of the fulcrum portion in the front-rear direction;

the release operation portion is positioned rearward of the fulcrum portion in the front-rear direction; and the movement regulating projection is nearer to the locking lug than to the fulcrum portion.

* * * * *